US011077012B2

(12) United States Patent
Wang

(10) Patent No.: US 11,077,012 B2
(45) Date of Patent: Aug. 3, 2021

(54) HEALTH-REGAIN DEVICE AND SYSTEM THEREOF

(71) Applicant: Jiang Wang, Nantong (CN)

(72) Inventor: Jiang Wang, Nantong (CN)

( * ) Notice: Subject to any disclaimer, the term of this patent is extended or adjusted under 35 U.S.C. 154(b) by 0 days.

(21) Appl. No.: 17/111,458

(22) Filed: Dec. 3, 2020

(65) Prior Publication Data

US 2021/0106494 A1 Apr. 15, 2021

Related U.S. Application Data

(63) Continuation of application No. 15/775,004, filed as application No. PCT/CN2017/109124 on Nov. 2, 2017.

(60) Provisional application No. 62/516,088.

(30) Foreign Application Priority Data

Feb. 11, 2016 (CN) ..... 201610952089.0
Sep. 15, 2017 (CN) ..... 201710835053.9
Oct. 23, 2017 (CN) ..... 201710995463.X

(51) Int. Cl.
*A61H 9/00* (2006.01)
*A61H 1/02* (2006.01)

(52) U.S. Cl.
CPC ... *A61H 9/0078* (2013.01); *A61H 2001/0233* (2013.01); *A61H 2201/0188* (2013.01); *A61H 2201/0207* (2013.01); *A61H 2201/10* (2013.01); *A61H 2201/5056* (2013.01); *A61H 2201/5071* (2013.01); *A61H 2230/605* (2013.01)

(58) Field of Classification Search
CPC ..... A61H 9/0078; A61H 2201/0188; A61H 2201/5071; A61H 2201/5056; A61H 2201/0119; A61H 2205/081; A61H 2203/0456; A61H 2001/0233; A61H 1/0218; A61H 1/0292; A63B 21/00047; A63B 21/0085; A63B 21/4037–4039
See application file for complete search history.

(56) References Cited

U.S. PATENT DOCUMENTS 6,652,564 B1 * 11/2003 Harris ..... A61H 1/0292 602/32
7,264,601 B2 * 9/2007 Liao ..... A61H 9/0078 601/149
7,503,927 B1 * 3/2009 Vetanze ..... A61N 1/0476 607/91
10,406,397 B1 * 9/2019 Graham ..... A61H 1/0218
2002/0173780 A1 * 11/2002 Altshuler ..... A61B 18/203 606/9
2012/0265107 A1 * 10/2012 Smith ..... A61H 7/001 601/15
2014/0303533 A1 * 10/2014 Zeutzius ..... A61H 9/0092 601/151
2014/0364778 A1 * 12/2014 Leftly ..... A61F 7/007 601/18

(Continued)

*Primary Examiner* — Colin W Stuart
*Assistant Examiner* — Douglas Y Sul
(74) *Attorney, Agent, or Firm* — Raymond Y. Chan; David and Raymond Patent Firm

(57) ABSTRACT

A health-regain device, includes a driving portion, a health portion disposed on one side of the driving portion, and a control module communicably connected to the driving portion, wherein the control module controls the driving portion driving the health portion in rhythmic reciprocating motion.

16 Claims, 41 Drawing Sheets

(56) References Cited

U.S. PATENT DOCUMENTS

| | | | | |
|---|---|---|---|---|
| 2016/0001034 | A1* | 1/2016 | Rembrand | A61H 9/0078 600/27 |
| 2016/0243395 | A1* | 8/2016 | Ban | A61H 9/0078 |

* cited by examiner

A-A

B-B

HEALTH-REGAIN DEVICE AND SYSTEM THEREOF

CROSS REFERENCE OF RELATED APPLICATION

This is a Continuation application that claims the benefit of priority under 35 U.S.C. § 120 to a non-provisional application, application Ser. No. 15/775,004, filed May 10, 2018, which is a non-provisional application that claims the benefit of priority under 35 U.S.C. § 120 to a provisional application, application No. 62/516,088, filed Jun. 6, 2017, and also is a U.S. National Stage under 35 U.S.C. 371 of the International Application Number PCT/CN2017/109124, filed Nov. 2, 2017, which claims priority under 35 U.S.C. 119(a-d) to Chinese application number CN 201610952089.0, filed Nov. 2, 2016, Chinese application number CN 201710835053.9, filed Sep. 15, 2017 and Chinese application number CN 201710995463.X, filed Oct. 23, 2017, which are incorporated herewith by references in their entities.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to health equipment, and more particularly to a health-regain device and system thereof, wherein the health-regain device provides stretching effect to the spine for the health and rehabilitation of the spine of a human body.

Description of Related Arts

Spinal disease is a condition impairing sclerotin, interspinel disk, ligament, muscle to have pressure and stretch to spinal cord, spinal nerves, vein, vegetative nervous to be complicated and varied symptoms. Some common disease of spinal disease are cervical spondylosis and lumbar spondylosis.

It is worth to mention that the spinal disease is becoming popular among younger people. People in 40s have different kinds of disease in spine which relates to incorrect pose when sitting to study and work. The incorrect pose will be easy to lead the spine to bend to be in flexion or some specific position in long time which not only causes increasing of the pressure of the interspinel disk but also leads ligament and muscle of the spine in non-coordinated state of force in a long time and causes spinal lesions.

It is a common treatment for cervical spondylosis and lumbar spondylosis to stretch for healthy spine. When stretching to treat cervical spondylosis, it is needed to provide the force along the direction of the head for a certain time to pull the cervival spine. Cervical stretch can increase the interspinel space, expand the narrowing of the interspinel foramen, make the nerve root and spinel artery have enough room for movement, avoid spinel artery from the squeeze and maintain smooth, and improve blood supply. As nerve roots are away from oppression and squeezing, the inflammation caused by oppression of adhesions will be absorbed, so that both of numbness caused by oppression, or pain caused by adhesions inflammation are gradually alleviated. In the stretch of the lumbar spine, it is needed to provide force to the lumbar spine for a period of time to stretch along lumbar spine, so that the interspinel space is widened and the recess is larger. The widening of the interspinel space is benefited to the interspinel disc, and the lateral recess becomes larger and the nerve channel becomes wider. With avoiding the nerve root to be pressed by extrusion of the protrusion, it is reduced or eliminated a series of stimulating sensory abnormalities caused by the nerve root compression, such as pain, numbness, feeling sleepy, soreness, etc., to achieve therapeutic purposes. It is worth to mention that the stretch on the cervical spine or lumbar spine applied by the force are along the direction of the spine, which is to increase the interspinel space.

Stretch on the cervical spine has side effects. The stretch of the cervical spine is away from the direction of the cervical spine in a period of time. Cervical stretch mainly forces on the neck where gathered small muscle cluster, and the surrounding ligament is weak to be damaged by improper force. When doing cervical stretch, it is needed to pay attention to the angle of stretch. Cervical spine has a physiological bending itself; the direction of force has to be at a flat angle with the spine. If the user in sitting pose for stretch treatment, as the force is vertical upward, the force applied on interspinel space is uneven, which the maximum force is at the top of the arc which is difficult to accept by patient. The position of cervical jaw stretch belt has to avoid carotid fat, or it may cause syncope. The stretch for lumbar treatment of lumbar spine disease also has side effects which can not be ignored. As in the lumbar stretch, the force is away from the spine to be applied along the spinal axis in a period of time. In anatomical structure, sacral spine muscle is near both sides of the spine which the spinous process has the interspinous ligament and longitudinal spinous process has spinous ligament. The interspinel space is significantly widened under the action of tension. At the same time, the ligaments of the muscles are also elongated. When the ligament is under long-time stretch, it will inevitably cause relaxation of the ligament, so that the stability of the lumbar spine is decreased and the lumbar can not afford heavy weight. Lumbar muscle is pulled to make the muscle spindle longer to cause muscle fatigue, and even cause lumbar spondylolisthesis.

It is worth to mention that lumbar treatment and cervical treatment need to use different kinds of equipment respectively. In other words, there is no such stretch equipment on the market for the lumbar spine and cervical health-regain at the same time. The reason is that the cervical spine and lumbar spine are in different positions. When using the stretch for treatment, one kind of force can not be applied to the cervical and lumbar spine at same time. Such as the stretch to the cervical spine care, the head needs to be fixed, and then the force is applied to the head to be under the force of away from the cervical spine. However, the fixation of the head and the application of force can not be applied to the waist of the fixed and stretched. There is a kind of pillow with an arc on the market which is capable of holding the head restraint in the pillow to restore the original physiological bending of the cervical spine. But the physiological bending of the cervical spine and physiological bending of lumbar spine are different. So, the pillow is not suitable for lumbar spine. And lumbar pillow does not adapt to cervical spine. What is to worth mention that when the head is lying on the pillow, the cervical spine is passively restored the physiological curve. But the neck muscles or ligaments are in a non-coordinated state. In other words, after the cervical spine off the pillow, the neck muscles or ligaments are in a non-coordinated state which the cervical spine can not be maintained its physiological curve. In addition, the traditional health-regain device for the lumbar spine is only for the health care. But the waist muscles and waist skin have no appropriate measures. In other words, the traditional lumbar health care device does not have the thought of considering the lumbar spine, waist muscles, and waist skin as a whole thing. Similarly, the cervical health care device is only for cervical health care. For the neck muscles and neck skin have no corresponding health care measures. Further, there are other ways for health care to cervical or lumbar spine, such as thermal health-regain care, massage, light health-regain and so on. Each kind of health care has to be corresponding to a kind of equipment. In other words, there is no such a device for the cervical spine or lumbar spine to provide a variety of ways of health care.

Another thing which is worth to mention that, in the stretch health care, if the hospital, the doctor will give the level of stretch or the time lasting recommendations according to the situation of each person. But this requires patients going to the hospital for health care. And not everyone is able to be in the hospital to a certain time to receive health care. For the hospital, due to limited resources, priority of serious level of patients will be considered in treatment. In other words, the time of patient's health care may not be guaranteed. In response to this situation, some manufacturers offer household stretch equipment to stretch at home. The force provided by the stretch equipment is controlled by the user. The time of stretch using the stretch device is also controlled by the user. In one situation, the user will stop using the stretch device when feeling uncomfortable. This way is affected by the subjective feeling of the user. At different time, the user's physical condition is different. Therefore, when the user does not feel comfortable is in different situation. In this way to control the stretch equipment or the stretch and the use of time is not able to have the expected effect of health care. Therefore, the manufacturer will attach with an instruction with the stretch equipment. Instructions is illustrated the recommended time and recommended stretch for the stretch equipment. It is worth to mention that the recommended time and recommended stretch of the stretch equipment are the average of the data collected by the manufacturer. In other words, the recommended time of stretch equipment is the average use of time. The recommended stretch force for the stretch equipment is the average stretch force. Maybe it is better to use recommended time and recommended stretch than the use time and stretch force which depends on user's feeling. But the recommended time and recommended stretch may not be suitable for every user. It is an urgent problem to set up the time and the stretch force which is suitable for every user for having an effective health care.

Keeping healthy is a constant topic of social life which is also an emphasized consideration in today's society.

As the growth of the age and the long-time hard work, many aged people who should have comfortable and easy life is experiencing hardship of bearing the pain caused by the malaise of body. The diseases, such as lumbar disc herniation, feeling cold legs, arthritis, periarthritis, and so on is afflicting many aged people.

Nowadays, not only the aged people suffer from the pain caused by the bone and arthritis, but many young people also suffer from the pain caused in the sub-health state. The development and progress of technology liberates physical labor, more and more people need to be sitting for long-time in daily life. Comfortable office environment and working manner make people comfortable and trouble. If consumers can't prevent in the way of taking rehabilitation exercise, keeping in the long-time seat position may cause some diseases. The pain in the waist and neck is a common sickness among the office workers. Many consumers do not take the sickness serious until the sickness has affected their work and life. They may seek for help from some health massage institutions or physical therapy clinics to cure their sickness or release pain. But the disease, like the spinal deformity, can't be cured easily by medicine treatment. As the form of the spinal deformity is a long-time process, the cure of the spinal deformity is also a long-time process. It cost time, energy and money for many patients to go to the health institutions or physical therapy clinics to cure the illness or sickness. As a result, continuous treatment is impossible for many patients, and they choose to cure the sickness and illness only when the symptom is in really poor condition and give up the recovering treatment when the symptom becomes mild, which has no doubt to make the treatment more difficult.

As described above, there are many kinds of health-regain devices on the market, such as waist pillow, neck pillows and so on, to ease the pain of users who suffered from pain on waist and neck. However, these health-regain devices can't meet the needs of the users at all. Taking the waist pillow as an example, many waist pillows support the waists of the users to help the consumers to keep their waists in a certain radian to support while making the waist having a stretch. But many waist pillows only provide a support, the radian and strength of the support can't be adjusted according to different users. Also, the way of keeping the lumbar spinee fixed to a fixed radian does not work effectively to release the lumbar spine pain and restore the spinal shape which may cause uncomfortable feelings. Reciprocating stretch will give the user a comfortable feeling and keep and recuperate the spine health. However, the waist pillows on the market can not have effect of reciprocating stretch.

SUMMARY OF THE PRESENT INVENTION

The invention is advantageous in that it provides a health-regain device and system thereof, wherein the health-regain device provides rhythmical driving force.

Another advantage of the invention is to provide a health-regain device and system thereof, wherein the health-regain device is for spine stretching by providing rhythmical driving force.

Another advantage of the invention is to provide a health-regain device and system thereof, wherein the health-regain device is relaxing adjacent two spines by providing rhythmical driving force.

Another advantage of the invention is to provide a health-regain device and system thereof, wherein the health-regain device provides rhythmical driving force by an adjusting device.

Another advantage of the invention is to provide a health-regain device and system thereof, wherein the adjusting device of the health-regain device provides rhythmical driving force by electrical driving.

Another advantage of the invention is to provide a health-regain device and system thereof, wherein the health-regain device is through a housing, wherein the adjusting device provides rhythmical driving force to drive the housing reciprocating.

Another advantage of the invention is to provide a health-regain device and system thereof, wherein the housing provides fully support to the waist of the user.

Another advantage of the invention is to provide a health-regain device and system thereof, wherein the housing provides fully support to the neck of the user.

Another advantage of the invention is to provide a health-regain device and system thereof, wherein the housing is made in rigid material.

Another advantage of the invention is to provide a health-regain device and system thereof, wherein the adjusting device provides driving force by air pressure.

Another advantage of the invention is to provide a health-regain device and system thereof, wherein the adjusting device provides driving force in mechanical manner.

Another advantage of the invention is to provide a health-regain device and system thereof, wherein the adjusting device provides a gasbag which offer driving force by inflation for reciprocating the house.

Another advantage of the invention is to provide a health-regain device and system thereof, wherein the health-regain device further provides a control module to control the frequency of the driving force provided by the adjusting device.

Another advantage of the invention is to provide a health-regain device and system thereof, wherein the health-regain device further provides a heat source to adjust temperature.

Another advantage of the invention is to provide a health-regain device and system thereof, wherein the health-regain device further provides a lighting device to provide light.

Another advantage of the invention is to provide a health-regain device and system thereof, wherein the health-regain device further provides an adjust module to adjust the control module, the heat source and the lighting device co-operatedly.

Another advantage of the invention is to provide a health-regain device and system thereof, wherein the health-regain device further provides a massage device to provide massage.

Another advantage of the invention is to provide a health-regain device and system thereof, wherein the health-regain device further provides a power module to offer energy.

Another advantage of the invention is to provide a health-regain device and system thereof, wherein the health-regain device provides bending health by the adjusting device.

Another advantage of the invention is to provide a health-regain device and system thereof, wherein the health-regain device provides regular bending health by the adjusting device.

Another advantage of the invention is to provide a health-regain device and system thereof, wherein the health-regain device provides extension bending health by the adjusting device.

Another advantage of the invention is to provide a health-regain device and system thereof, wherein the health-regain device further provides a health-regain platform which offer an initial environmental value to initialize the health-regain device.

Another advantage of the invention is to provide a health-regain device and system thereof, wherein when processing bending health, the health-regain platform adjusts the health-regain device to provide bending health.

Another advantage of the invention is to provide a health-regain device and system thereof, wherein the health-regain device provides a health-regain portion and a driving portion, wherein the driving portion drives the health-regain portion to provide bending health.

Another advantage of the invention is to provide a health-regain device and system thereof, wherein the driving portion drives the health-regain portion to reciprocate alternately.

Another advantage of the invention is to provide a health-regain device and system thereof, wherein the driving portion drives the health-regain portion to reciprocate rhythmically.

Another advantage of the invention is to provide a health-regain device and system thereof, wherein the driving portion drives the health-regain portion by air pressure.

Another advantage of the invention is to provide a health-regain device and system thereof, wherein the driving portion drives the health-regain portion in electromagnetic manner.

Another advantage of the invention is to provide a health-regain device and system thereof, wherein the driving portion is in a lifting manner.

Another advantage of the invention is to provide a health-regain device and system thereof, wherein the driving portion provides an air adjusting device and an air receiving portion, wherein the air adjusting device adjusts air pressure by the air receiving portion.

Another advantage of the invention is to provide a health-regain device and system thereof, wherein the health-regain device further comprises a control module to control the air adjusting device inflating alternately to the air receiving portion.

Another advantage of the invention is to provide a health-regain device and system thereof, wherein the health-regain device further comprises at least one detector to provide detected data.

Another advantage of the invention is to provide a health-regain device and system thereof, wherein the detector further provides at least one pressure sensor.

Another advantage of the invention is to provide a health-regain device and system thereof, wherein the detector further provides at least one baroceptor.

Another advantage of the invention is to provide a health-regain device and system thereof, wherein the detector further provides at least one electromyographic sensor.

Another advantage of the invention is to provide a health-regain device and system thereof, wherein the health-regain device further provides a health-regain environmental former to provide a health-regain environment.

Another advantage of the invention is to provide a health-regain device and system thereof, wherein the health-regain device further provides a heat source device to adjust temperature of the health-regain environment.

Another advantage of the invention is to provide a health-regain device and system thereof, wherein the health-regain device further provides a lighting device to lightening.

Another advantage of the invention is to provide a health-regain device and system thereof, wherein the health-regain device further provides a health-regain portion to provide magnetic health-regain.

Another advantage of the invention is to provide a health-regain device and system thereof, wherein the health-regain device further provides a massage device.

Another advantage of the invention is to provide a health-regain device and system thereof, wherein the health-regain device can be adapted to provide reciprocating stretch for the spine.

Another advantage of the invention is to provide a health-regain device and system thereof, wherein the health-regain device can be adapted to provide reciprocating stretch for both the spine and lumbar spine.

Another advantage of the invention is to provide a health-regain device and system thereof, wherein the health-regain device provides various aspect of health-regain, wherein the health-regain can be done cooperatedly to provide a better health efficacy.

Another advantage of the invention is to provide a health-regain device and system thereof, wherein the health-regain device is in a relatively small size to be adapted to daily health-regain for the household.

Another advantage of the invention is to provide a health-regain device and system thereof, wherein the health-regain device provides dual health-regain of the stretch and thermotherapy for the waist and the spine, so that the health-regain device provides a better health efficacy.

Another advantage of the invention is to provide a health-regain device and system thereof, wherein the health-regain device provides stretch effect in the way of setting a gasbag, making the health-regain device having the advantages of portability, comfort, easy-performing, well-stretch, and so on.

Another advantage of the invention is to provide a health-regain device and system thereof, wherein the health-regain device can achieve the effect of the reciprocating stretch in the way of inflating and deflating the gasbag, wherein the inflation and deflation of the gasbag can be controlled by electric power.

Another advantage of the invention is to provide a health-regain device and system thereof, wherein the health-regain device can detect the health parameters of users and store the health parameters, that provides the users suitable personalized health regain according the health parameters.

Another advantage of the invention is to provide a health-regain device and system thereof, wherein the health-regain device can acquire the related parameters about the health parameters of the users, so as to provide the user a more suitable personalized health-regain.

Another advantage of the invention is to provide a health-regain device and system thereof, wherein the health-regain device can acquire the related parameters about the health parameters of the user from the other health-regain devices, so as to provide the user a more suitable personalized health-regain.

Another advantage of the invention is to provide a health-regain device and system thereof, wherein the health-regain device can acquire the related parameters about the health parameters of the user recorded by medical institutions, such as hospital, so as to provide the user a more suitable personalized health-regain.

Another advantage of the invention is to provide a health-regain device and system thereof, wherein the health-regain device can acquire user's health parameters when the user is enjoying the health-regain, and upload the health parameters, to help other health-regain devices to acquire and use the health parameters.

Another advantage of the invention is to provide a health-regain device and system thereof, wherein the health-regain device can provide a control method adapted for the situation that the health-regain device is under insufficient power supply.

Another advantage of the invention is to provide a health-regain device and system thereof, wherein the health-regain device can produce different color and shape light by means for illuminating to provide light with more uniform illumination, wherein the illumination refers to the light, the brightness and the spectrum.

Another advantage of the invention is to provide a health-regain device and system thereof, wherein the health-regain device generates heat through a heating film, so as to provide heat effect.

Another advantage of the invention is to provide a health-regain device and system thereof, wherein the rhythm and the frequency of the stretch of health-regain device can be controlled.

Another advantage of the invention is to provide a health-regain device and system thereof, wherein the rhythm and the frequency of the stretch of health-regain device can be set according to different requirement.

Another advantage of the invention is to provide a health-regain device and system thereof, wherein the health-regain device provides a surface that suits with human body skeleton and has a fixed shape, so as to provide a better support effect.

Another advantage of the invention is to provide a health-regain device and system thereof, wherein the health-regain device can provide stretch not only by whole lifting, but also part-lifting.

Another advantage of the invention is to provide a health-regain device and system thereof, wherein the health-regain device provides a flexible connector which is disposed between the health-regain portion and the health-regain environmental former for stopping creating gaps between the health-regain portion and the health-regain environmental former.

Another advantage of the invention is to provide a health-regain device and system thereof, wherein the health-regain device provides at least one supporting portion which is capable of providing magnetic health-regain or infrared health-regain to allow user choosing different kinds of the supporting portion with different function or different types of the supporting portions cooperated with each other.

Another advantage of the invention is to provide a health-regain device and system thereof, wherein the health-regain device allows the user to choose the amount of the supporting portions.

Another advantage of the invention is to provide a health-regain device and system thereof, wherein the driving portion drives the health-regain portion reciprocate rhythmically to transform the health-regain body of the user between a larger bending state and a smaller bending state to do the bending health-regain to the body.

Another advantage of the invention is to provide a health-regain device and system thereof, wherein the driving portion provides at least one fluid receiving cavity which the driving portion generates regular changing of the fluid volume of the fluid receiving cavity to reciprocate rhythmically.

Another advantage of the invention is to provide a health-regain device and system thereof, wherein the driving portion provides a fluid adjusting device which adjusts the fluid volume of each of the fluid adjusting device to change the fluid volume rhythmically.

Another advantage of the invention is to provide a health-regain device and system thereof, wherein the health-regain device provides at least one supporting portion which transforms the health-regain body of the user between a larger bending state and a smaller bending state to do the bending health-regain to the body.

Another advantage of the invention is to provide a health-regain device and system thereof, wherein the health-regain device provides at least one sub-driving device which drives the supporting portion rhythmically to provide the bending health-regain to the body.

Another advantage of the invention is to provide a health-regain device and system thereof, wherein the fluid adjusting device is capable of adjusting the fluid volume to drive the supporting portion moving with rhythm to provide the bending health-regain to the body.

Another advantage of the invention is to provide a health-regain device and system thereof, wherein the supporting portion and the fluid receiving cavity is capable of cooperation with each other to offer larger bending of the health-regain body of the user.

Another advantage of the invention is to provide a health-regain device and system thereof, wherein the fluid adjusting device is capable of adjusting the fluid volume to drive the supporting portion and the sub-driving device to make the supporting portion and the fluid receiving cavity is capable of cooperation with each other to offer larger bending of the health-regain body of the user.

Another advantage of the invention is to provide a health-regain device and system thereof, wherein the amount of the supporting portion is multiple and touching area of the supporting portion is small with the health-regain body of the user which is good for increasing the bending of the health-regain body and doing massage.

Additional advantages and features of the invention will become apparent from the description which follows and may be realized by means of the instrumentalities and combinations particular point out in the appended claims.

According to the present invention, the foregoing and other objects and advantages are attained by a health-regain device comprising:

a driving portion;

a health-regain portion which is set on one side of the driving portion; and a control module which is communicably connected with the driving portion, wherein the control module controls the driving portion to move the health-regain portion reciprocatedly.

According to one embodiment of the invention, the control module controls the driving adjustor to adjust the speed of the driving portion to form the rhythm of the health-regain portion.

According to one embodiment of the invention, the driving portion further comprises:

an air adjusting device; and an air receiving portion, wherein the air adjusting device is communicably connected to the air receiving chamber portion to adjust the amount of air therein, wherein the control module controls the air receiving chamber portion to provide rhythm of the air receiving chamber portion by controlling the air adjusting device to adjust speed of the amount of air.

According to one embodiment of the invention, the driving portion further comprises a gasbag, wherein the air receiving chamber portion is formed by the gasbag which is communicated with the air adjusting device, wherein the control module controls the air adjusting device to adjust the amount of air received in the air receiving portion.

According to one embodiment of the invention, the health-regain portion further comprises a receiving cavity, wherein the air adjusting device is disposed in the receiving cavity, wherein the air adjusting device and the gasbag are separately placed on two sides of the bottom of the health-regain portion.

According to one embodiment of the invention, the bottom of health-regain portion has at least one hole, wherein the air adjusting device is communicated with the air receiving chamber portion via the hole.

According to one embodiment of the invention, the health-regain portion further comprises a health-regain environmental former which forms a health-regain environment, wherein the health-regain environmental former is placed in the center of the health-regain portion.

According to one embodiment of the invention, the health-regain environmental former further comprises a heat source device, wherein the control module is communicably connected with the heat source device, wherein the control module controls the heat source device to form a thermal environment so that the health-regain environment provides the thermal environment.

According to one embodiment of the invention, the health-regain environmental former further comprises a light source device, the light source device is communicably connected with the control module, wherein the control module controls the light source device to form a luminous environment so that the health-regain environment provides the luminous environment.

According to one embodiment of the invention, the light source device further comprises a light source and a non-opaque device, wherein the nonopaque device is covering the light source, wherein the light produced by the light source is passing through the nonopaque device to form the luminous environment.

According to one embodiment of the invention, the heat source device is disposed between the light source and the nonopaque device, wherein the heat source device is preformed to be shown as lightened by the light source.

According to one embodiment of the invention, the health-regain device further comprises a massage device, wherein the massage device is communicably connected with the control module to provide a massage environment, wherein the massage device is disposed in the health-regain portion.

According to one embodiment of the invention, the health-regain device further comprises a magnetic element, wherein the magnetic element is disposed in the health regain portion to provide a magnetic environment.

According to one embodiment of the invention, the health-regain environmental former further comprises at least one detector, wherein the detector is communicably connected with the control module, wherein the control module adjusts the amount of the air in the air receiving chamber portion according to the data feedback by the detector.

According to one embodiment of the invention, the detector further comprises at least one pressure sensor, wherein the pressure sensor is disposed in the health-regain portion to detect the pressure therein, wherein the pressure sensor is communicably connected with the control module adjusts the driving force provided by the driving portion according to the feedback of the pressure sensor.

According to one embodiment of the invention, the detector further comprises a electromyographic sensor, wherein the electromyographic sensor is disposed in the health-regain portion, wherein the electromyographic sensor is communicably connected to the control module to control the driving force provided by the driving portion according to the feedback of the electromyographic sensor.

According to one embodiment of the invention, the health-regain portion further comprises a receiving shell and a top cap, wherein the brim of the receiving shell and the brim of the top cap are connected to form the receiving cavity.

According to one embodiment of the invention, the top cap further has a health-regain environmental forming hole, wherein the health-regain environmental former is embodied in the health-regain environmental forming hole.

According to one embodiment of the invention, the health-regain device further comprises a sub-driving device which is disposed between the outer bottom of the health-regain environmental former and the inner bottom of the health-regain portion to drive the health-regain environmental former.

According to one embodiment of the invention, the sub-driving device is set to be a second gasbag, wherein the second gasbag is connected with the air adjusting device, wherein the control module controls the air adjusting device to adjust the amount of the air in the second gasbag.

According to one embodiment of the invention, the sub-driving device is embodied to be a lifting device, wherein the lifting device is communicably connected to the control module to be controlled cooperatedly with the driving portion.

According to the present invention, the foregoing and other objects and advantages are attained by a health-regain system comprising:

a health-regain platform; and at least one health-regain device, which is communicably connected to the health-regain platform, wherein the health-regain platform acquires health-regain data form the health-regain device to form a health-regain plan, wherein the health-regain plan is delivered to the health-regain device to implement the health-regain plan.

According to one embodiment of the invention, the health-regain platform further comprises:

a data center, which stores the health-regain data provided by the health-regain device;

and an analysis center, which is communicably connected with the data center, wherein the analysis center analyzes the health-regain data to provide a health-regain plan.

According to the present invention, the health-regain further comprises at least one modeling center communicably connected to the data center and the analysis center respectively, wherein the modeling center provides at least one spine model, wherein the analysis center provides the health-regain plan according to the spine model and the health-regain data of a user.

According to one embodiment of the invention, the foregoing and other objects and advantages are attained by a health-regain device comprising:

a driving portion;

a health-regain portion, wherein the driving portion is disposed on the one side of the health-regain portion; and a control module, wherein the control module is communicably connected with the driving portion and the analysis center, wherein the control module receives the health-regain plan sent by the analysis center, wherein the control module controls the health-regain device driving the health-regain portion to reciprocate rhythmically according to the health-regain plan.

According to one embodiment of the invention, the control module controls the health-regain portion to provide a health-regain environment.

According to one embodiment of the invention, the driving portion further comprises:

an air adjusting device; and an air receiving portion, wherein the air adjusting device is communicably connected to the air receiving portion, wherein the control module controls the air adjusting device to adjust the amount of the air in the air receiving portion, wherein the control module controls the air adjusting device to adjust the speed of the amount of air in the air receiving chamber portion to control the air receiving chamber portion to provide the rhythm of the driving force.

According to one embodiment of the invention, the driving portion further comprises a gasbag to form the air receiving portion, wherein the air adjusting portion id connected to the gasbag, wherein the control module controls the air adjusting device to adjust the amount of the air received in the air receiving portion.

According to one embodiment of the invention, the health-regain portion further comprises a health-regain environmental former, wherein the health-regain environmental former forms a health-regain environment, wherein the health-regain environmental former is disposed in the health-regain portion.

According to the present invention, the foregoing and other objects and advantages are attained by a health-regain device comprising:

at least a health-care module adapted to provide health-care function; and [00131] at least a power module adapted to provide power to the health-care module.

According to one embodiment of the invention, the health-care module comprises at least an adjusting device, wherein the adjusting device can be electrically connected to the power module to acquire power from the power module.

According to one embodiment of the invention, the adjusting device can achieve stretch function by ways choosing from the pressure effect, electromagnetism effect, hydraulic effect and machine-lift effect.

According to one embodiment of the invention, the adjusting module comprises at least an expansion module and an inflation module, which is adapted to inflate the expansion module, so as to expand the expansion module.

According to one embodiment of the invention, the adjusting device further comprises at least a pressure sensor module, which is adapted to sense the pressure of the pressure sensor module.

According to one embodiment of the invention, the health-care module further comprises at least a heat source, which is adapted to provide a heat-care environment, wherein the heat source is electrically connected with the power source.

According to one embodiment of the invention, the health-care module further comprises at least a lighting device, which is electrically connected with the power module.

According to one embodiment of the invention, the health-care module further comprises at least a massage, which is electrically connected with the power module.

According to one embodiment of the invention, the health-care module further comprises a adjust-control module, which is electrically connected with the power module.

According to one embodiment of the invention, the health-care module further comprises a support module, which can provide fix and protect for the health-care module and the power module and be adapted to support the user.

According to the present invention, the foregoing and other objects and advantages are attained by a health-regain device, comprising:

a health-regain portion; and a driving portion, wherein the driving portion comprises two fluid receiving portions, wherein each of the fluid receiving portions is disposed on the same side of the health-regain portion, wherein the driving portion drives the health-regain portion reciprocating by adjusting the fluid volume of the each of the fluid receiving portions.

According to one embodiment of the invention, the driving portion further comprises at least one fluid adjusting device connected with the fluid receiving cavity for adjusting the fluid volume of the fluid receiving cavity by the fluid adjusting device.

According to one embodiment of the invention, the driving portion further comprises a control module, wherein the fluid adjusting device is controllably connected with the control module.

According to one embodiment of the invention, the fluid adjusting device is an air pump, and the fluid receiving cavity is a gasbag, wherein the fluid adjusting device drives the health-regain portion reciprocating by adjusting the fluid volume of the fluid receiving cavity.

According to one embodiment of the invention, the health-regain portion further comprises at least one sub-driving device and at least one supporting portion which is driven by the driving device, wherein the health-regain portion has a receiving cavity and at least one through hole communicated with the receiving cavity, wherein each of the sub-driving device is disposed in the receiving cavity of the health-regain portion, wherein each of the supporting portion is extended from the receiving cavity to outside of the health-regain portion by each of the through hole of the health-regain.

According to one embodiment of the invention, the health-regain device further comprises at least one sub-driving device and at least one supporting portion drivably connected to the sub-driving device, wherein the health part has a receiving cavity and a through hole communicating with the receiving cavity, wherein each of the sub-driving devices is disposed in the receiving cavity of the health-regain portion, wherein each of the supporting portion is extended from the receiving cavity to outside of the health-regain portion by each of the through hole of the health-regain, wherein the sub-driving device is a fluid bag and connected to the fluid adjusting device to drive the supporting portion by adjusting the fluid volume of the sub-driving device with the sub-driving device.

According to one embodiment of the invention, the health-regain device further comprises a health-regain environmental former which forms a health-regain environment inside the health-regain portion.

According to one embodiment of the invention, the wellness environment forming device comprises a heat source device disposed in the health-regain portion to form a thermal environment in the middle of the health-regain portion by the heat source device, so that the health-regain environment provides the thermal environment.

According to one embodiment of the invention, the health-regain environment forming device comprises a light source device disposed at the health-regain portion to form a light environment in the middle of the health-regain portion by the light source device, so that the health-regain environment provides the light environment.

According to one embodiment of the invention, the light source device comprises at least one light source and a nonopaque device covered the light source, and the light generated by the light source forms the light environment through the nonopaque device.

According to the present invention, the foregoing and other objects and advantages are attained by a health-regain device, comprising:

a health-regain portion, wherein the health-regain portion has at least one receiving cavity and at least one through hole communicating with the receiving cavity;

a driving portion, wherein the driving portion is disposed at the health-regain portion for driving the health-regain portion to reciprocate;

at least one sub-driving device, wherein each of the sub-driving devices is respectively disposed in the receiving cavity of the health-regain portion; and at least one supporting portion, wherein the driven ends of each of the supporting portions are respectively and movably disposed on each of the sub-driving devices, and the supporting end of each supporting portion is respectively is extended from the receiving cavity of the health-regain portion to the outside of the health-regain portion by the through hole of the health-regain portion According to one embodiment of the invention, the amount of the sub-driving devices is one, and the amount of the supporting portions is four, and the driven ends of the supporting portions are respectively and drivably disposed on the same sub-driving device; or the amount of the sub-driving devices is two, and the amount of the supporting portions is four, and the driven ends of every two of the supporting portions are respectively and drivably disposed on the same sub-driving device; or the amount of the sub-driving devices is four, and the amount of the supporting portions is four, and the driven ends of each of the supporting portions are respectively and drivably disposed on each of the sub-driving devices.

According to one embodiment of the invention, the sub-driving device is a fluid bag, and the sub-driving device drives the supporting portion by adjusting the fluid volume in the sub-driving device.

According to one embodiment of the present invention, the sub-driving device is a lifting device that drives the supporting portion in a lifting and dropping manner.

According to one embodiment of the invention, the device further comprises a health-regain fluid adjusting device, wherein the fluid bag is connected to the fluid adjusting device, wherein the fluid adjusting device adjusts the fluid volume of the sub-driving device to drive the support portion.

According to one embodiment of the invention, the device further comprises a health-regain control module, wherein the fluid adjusting device is controlled and connected to the control module.

According to one embodiment of the invention, the health-regain device further comprises a health-regain environmental former which forms a health-regain environment in the middle of the health-regain portion.

According to one embodiment of the invention, the health-regain environment forming device comprises a heat source device disposed in the health-regain portion to form a thermal environment in the middle of the health-regain portion through the heat source device, so that the health-regain environment provides the thermal environment.

According to one embodiment of the invention, the health-regain environment forming device comprises a light source device disposed at the health-regain portion to form a luminous environment in the middle of the health-regain portion by the light source device so that the health-regain environment provides the luminous environment.

According to one embodiment of the invention, the light source device comprises at least one light source and a nonopaque device that covers the light source, and the light generated by the light source forms the luminous environment through the nonopaque device.

According to the present invention, the foregoing and other objects and advantages are attained by a health-regain device, comprising:

a health-regain portion, wherein the health-regain portion has a receiving cavity and at least one through hole and a connecting slot respectively communicating with the receiving cavity;

a driving portion, wherein the driving portion comprises at least one fluid receiving chamber portion formed in the health-regain portion, and the fluid receiving chamber portion is extended to the receiving cavity through the connecting slot of the health-regain portion; and at least one supporting portion, wherein the driven ends of each of the supporting portions are respectively and movably disposed on the fluid receiving chamber portion of the driving portion, and the supporting place of each supporting portion is respectively connected with each of the through holes is extended from the receiving cavity of the health-regain portion to the outside of the health-regain portion.

According to one embodiment of the invention, the number of the supporting portions can be three, four, five, six, seven or eight.

According to one embodiment of the invention, the driving portion comprises at least one fluid adjusting device, wherein the fluid receiving chamber portion is connected to the fluid adjusting device to the fluid by adjusting the driving portion by way of adjusting the fluid volume of the fluid receiving chamber portion The driving portion reciprocates and drives each of the supports to reciprocate.

According to one embodiment of the invention, the driving portion further comprises a control module, and the fluid adjusting device is controllably connected to the control module.

According to one embodiment of the invention, the fluid adjusting device is an air pump, and the fluid receiving chamber portion is an air bag, wherein the fluid adjusting device drives the health regain portion to reciprocate by adjusting the air volume of the fluid receiving portion.

According to one embodiment of the invention, the health-regain device further comprises a health-regain environmental former, which forms a health-regain environment in the middle of the health-regain portion.

According to one embodiment of the invention, the health-regain environment forming device comprises a heat source device disposed in the health-regain portion to form a thermal environment in the middle of the health-regain portion by the heat source device, so that the health-regain environment provides the thermal environment.

According to one embodiment of the invention, the health-regain environment forming device comprises a light source device disposed at the health-regain portion to form a luminous environment in the middle of the health-regain portion by the light source device so that the health-regain environment provides the luminous environment.

According to one embodiment of the invention, the light source device comprises at least one light source and a nonopaque device that covers the light source, and the light generated by the light source forms the luminous environment through the nonopaque device.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
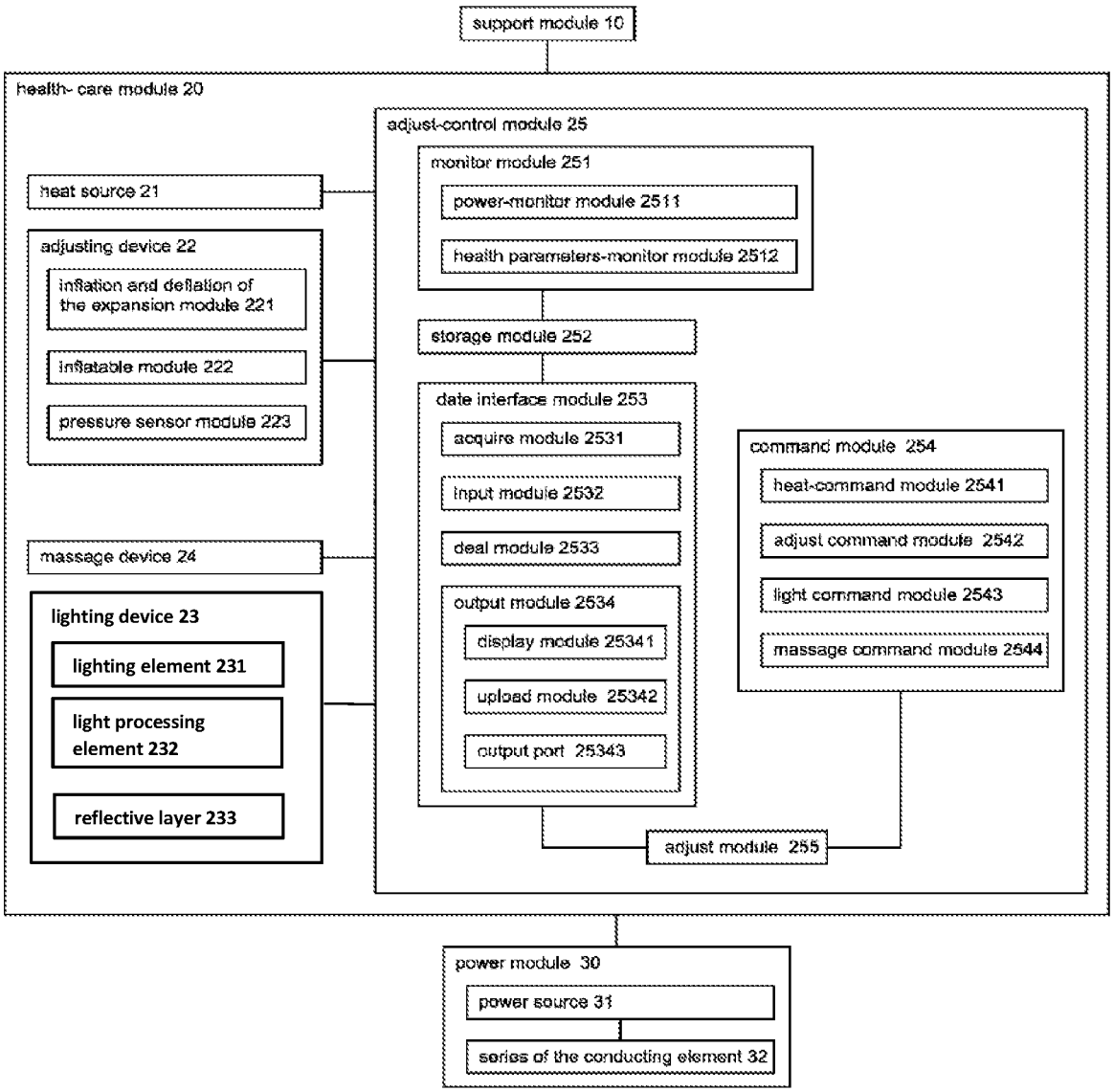
FIG. 1 is a block diagram of a health-regain device according to a first preferred embodiment of the present invention.

FIG. 1 to FIG. 7D illuminate a health-regain device according to a first preferred embodiment of the invention. The health-regain device is adapted to take care and treat the waist and/or the neck. The first preferred embodiment of the invention takes a waist health-regain device as an example. One skilled in art should know the health-regain device can also be adapted to other body parts, such as the neck. This invention in this respect is not restricted. As shown in FIG. 1, the health-regain device which is health device comprises a support module 10, a health-care module 20, and a power module 30. The health-care module 20 is set in the support module 10 so as to be fixed and protected by the support module 10. The power module 30 is adapted to provide power to the health-care module 20 so as to enable the health-care module 20 to provide health caring.

The shape, size and structure of the support module match with the shape, size and structure of the human and human's bone respectively. The health-care module 20 is set in the support module 10, so as to provide health-regain to the user who is supported by the support module 10.

According the first preferred embodiment of the invention, the health-care module 20 comprises a heat source 21, an adjusting device 22, a lighting device23, a massage device 24, and an adjust-control module 25. The heat source 21 is set so the health-regain device can provide hot-care function. The heat source 21 can produce heat, so as to provide a suitable temperature environment to provide hot-care or hot-cure function. The adjusting device 22 is set so that the health-regain device can provide stretch-care function. The lighting device 23 is used to provide predetermined light. The massage device 24 is set so that the health-regain device can provide massaging function. The adjust-control module 25 is set to control and adjust the heat source 21, the adjusting device 22, the lighting device 23, the massage device 24, and the cooperative relationship between each other.

As shown in FIG. 1, the adjust-control module 25 comprises a monitor module 251, a storage module 252, a date interface module 253, a command module 254, and an adjust module 255. The monitor module 251 is used to monitor the health parameters of the user who uses the heath-regain device and the power situation of the power module 30. More particularly, the monitor module 251 can monitor the heat source 21, the adjusting device 22, the lighting device 23, and the massage device 24 so as to acquire the health parameters of the user who uses the heath-regain device. Particularly, the monitor module 251 comprises a power-monitor module 2511 and a health parameters-monitor module 2512. The power-monitor module 2511 is used to monitor the data relating to the power-situation of the power module 30, wherein the data can be acted as the base of the heat source 21, the adjusting device 22, the lighting device 23, and the massage device 24. According to the first preferred embodiment of the invention, the power module 30 is adapted to provide power. Accordingly, the power-monitor module 2511 is adapted to monitor the power-supply situation of the power module 30. For example, when the power-monitor module 2511 monitors the poor-power of the power module 30, the power-monitor module 2511 can adjust the heat source 21, the adjusting device 22, the lighting device 23, the massage device 24, and the cooperative relationship between each other according the power situation of the power module 30. For example, when the power module 30 is poor power, the adjust module 255 can adjust the power module 30 to power the heat source 21 and the adjusting device 22 firstly, and stop powering the lighting device 23 and the massage device 24 to stop the lighting and massaging function of the health-regain device. The order of the power-supply, when the health-regain device is poor power can be set automatically, can be set according to the needs of the user. The invention does not restrict in this respect.

The health parameters-monitor module 2511 of the monitor module 251 is adapted to monitor the date relating to the health parameters of the user of the health-regain device.

The storage module 252 stores the data monitored by the monitor module 251, so that the date interface module 253 can apply these data.

The date interface module 253 comprises an acquire module 2531, an input module 2532, a deal module 2533, and an output module 2534. The acquire module 2531 can acquire the data monitored by the monitor module 251 or the data stored by the storage module 252. This is to say, the acquire module 2531 can acquire the date from the monitor module 251 and the data from the storage module 252. This is to say, the data monitored by the monitor module 251 can be delivered to the acquire module 2531 directly, stored in the storage module 252 firstly, and then delivered to the acquire module 2531 through the storage module 252.

It is worth to mention that the acquire module 2531 can not only acquire the data monitored by the monitor module 251 and stored by the storage module 252, but also acquire the data from other ways. For example, the acquire module 2531 can acquire the data from the internet platform or other systems, platforms and modules of the internet.

The input module 2532 can input the data acquired by the acquire module 2531 into the deal module 2533. The deal module 2533 can deal the data input, so the output module 2534 can output the data.

The output module 2533 comprises a display module 25341 and an upload module 25342. The display module 25341 can display the data which has been input by the input module 2532 and deal by the deal module 2533, so the date can be seen by the users.

The upload module 25342 uploads the data which have been input by the input module 2532 and deal by the deal module 2533, in order to use the data later. The upload module 25342 can upload the data to the storage module 252, so the storage module 252 can storage the data. As a result, when the health-regain device be used again, the health-regain device can reuse the data. This is to say, the health-regain device can trace and record the condition of the users during the continuous using, the health-regain device will be more and more smart and know the needs of the user more and more, so the health-regain device can perform its function better.

In the condition of network, the upload module 25342 can upload the data to the other system, platform or modules to share the data, so the users can use the particular data when the users are undergoing the other health-regain treatment or exercise. For example, the user can health-regain himself by the health-regain device every day, the health-regain device can collect and upload the health data of the user when the user is health cared. And the data can be upload to the system or platform of the hospital, wherein when the user take treated in the hospital, the user can use the data from the system or platform directly. Furthermore, the data can be used by other ways except the direct upload. For example, the user can copy these data from the output module 2534 and carry the copied data to needed situation, such as hospital. Particularly, the output module 2534 further comprises an output port 25343. The output port 25343 can be connected to a storage device, such as USB and mobile phone, to deliver the data to the storage device.

As shown in FIG. 1, the command module 254 comprises a heat-command module 2541, an adjust command module 2542, a light command module 2543, and a massage command module 2544 to command the heat source 21, the adjusting device 22, the lighting device 23, and the massage device 24 respectively.

The adjust module 255 is adapted to adjust the command which the command module 2544 works on the heat source 21, the adjusting device 22, the lighting device 23, and the massage device 24, so the heat source 21, the adjusting device 22, the lighting device 23, and the massage device 24 can cooperate together in a better way.

Figure 2:
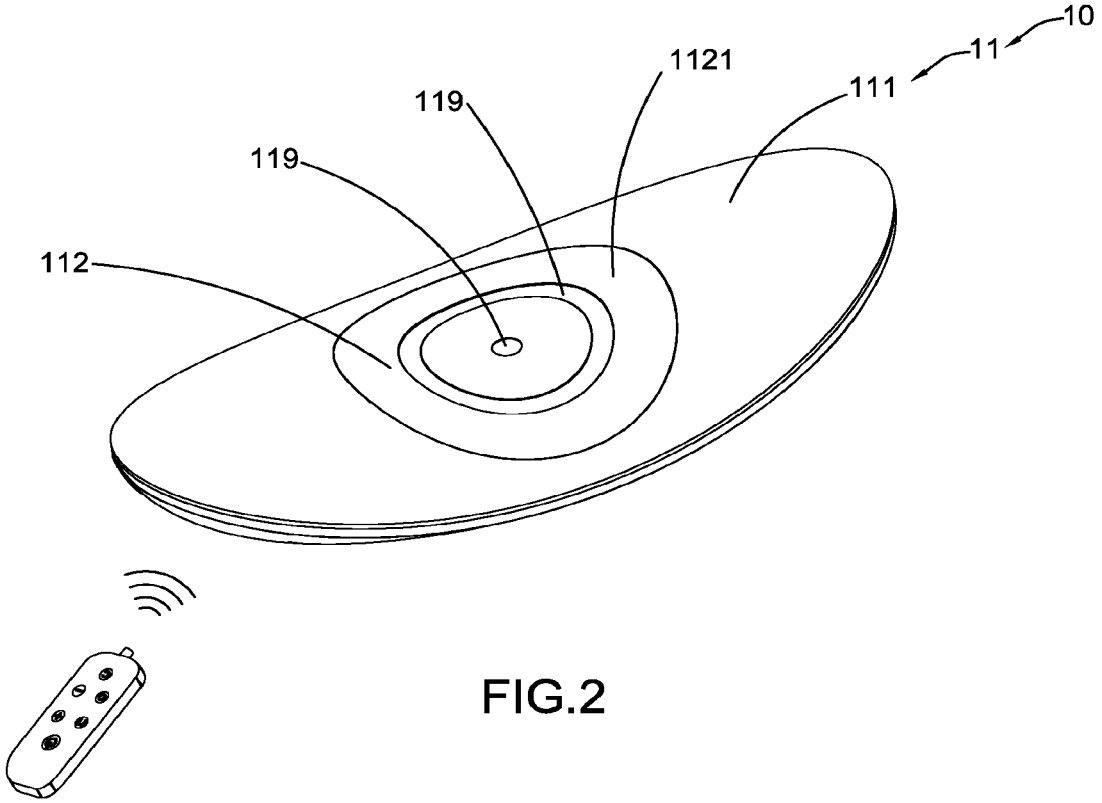
FIG. 2 is a perspective view of the health-regain device according to above first preferred embodiment of the present invention.
Figure 4:
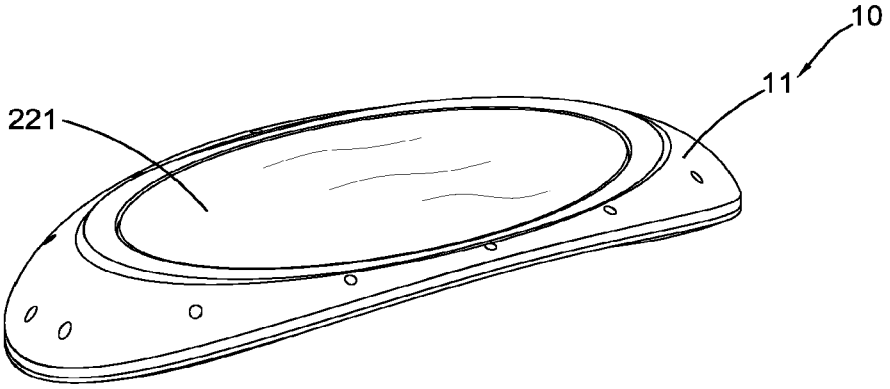
FIG. 4 is a top view of the health-regain device according to above first preferred embodiment of the present invention.
Figure 5:
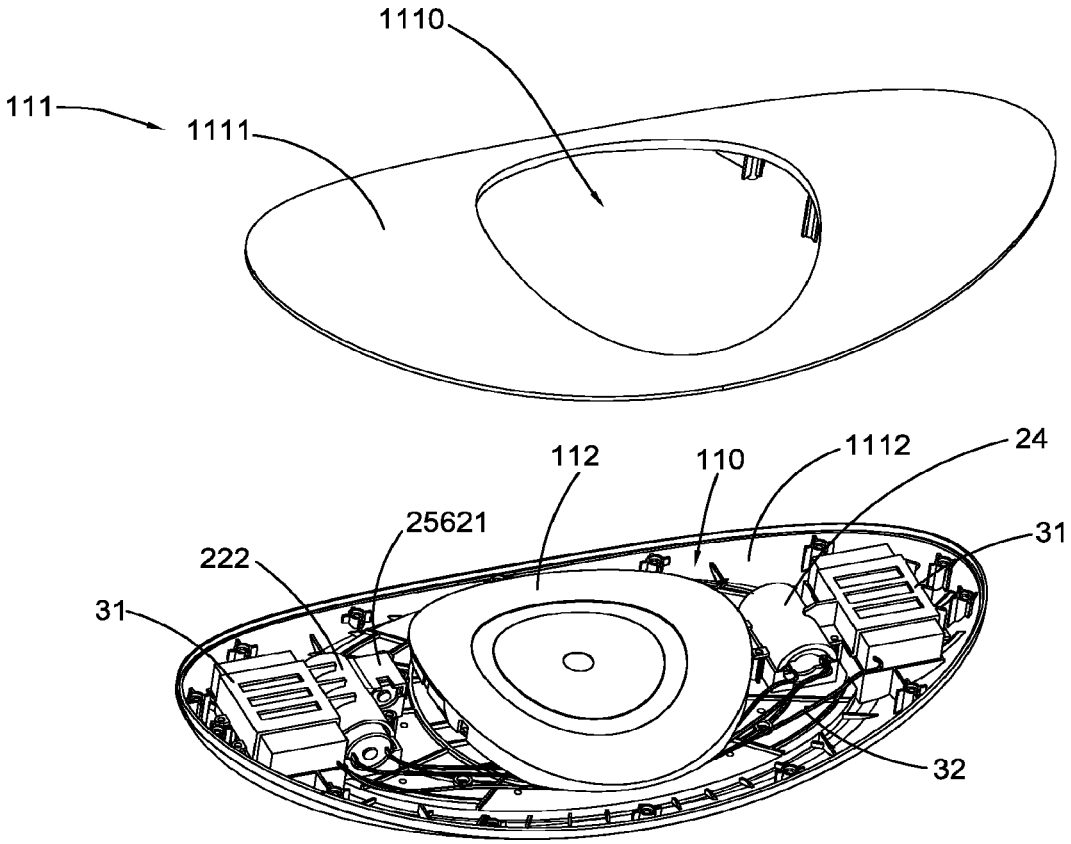
FIG. 5 is an explosive view of the health-regain device according to above first preferred embodiment of the present invention.

As shown in FIG. 2 and FIG. 5, according the first preferred embodiment of the invention, the support module 10 comprises a first housing 11, wherein the first housing 11 and a receiving cavity 110 therein to receive, fix and protect the heat source 21, the adjusting device 22, the lighting device 23, and the massage device 24 of the heat-care module 20 and the power module 30. According the first preferred embodiment of the invention, the heat source 21 is embodied as a heating film21. The stretch of the adjusting device 22 is achieved by the inflation. In particular, the adjusting device 22 comprises an expansion module 221 and inflatable module 222. The inflatable module 222 is adapted to inflate the expansion module 221. The expansion module 221 is expanded after being inflated, so as to drive the first housing 11 to move. As a result, the first housing 11 will work on the waist of the user who lies the first housing 11 placed on a lying surface of the user. According to the first preferred embodiment, the expansion module 221 is embodied as a gasbag 221. The inflatable module 222 is embodied as an air pump 222, wherein the air pump 222 can acquire power from the power module 30 and be connected with the gasbag 221, to inflate the gasbag 221. As shown in FIG. 4, the gasbag is set in the bottom of the first housing 11. When the gasbag 221 is inflated, the gasbag 221 expands to increase its size, so to drive the first housing 11 to move upwardly with respect to the lying surface. At the time, the waist of the user who lies on top of the first housing 11 is pushed upwardly. As a result, the radian of the waist portion increases. When the gasbag 221 lets out an amount of gas, the expansion of the gasbag reduces and the gasbag 221 drives the first housing 11 to move downwardly, so the radian of the waist portion of the user who lies on top of the first housing 11 reduces. The repeated process of the inflation and deflation will produce repeated force to the waist of the user.

Figure 6A:
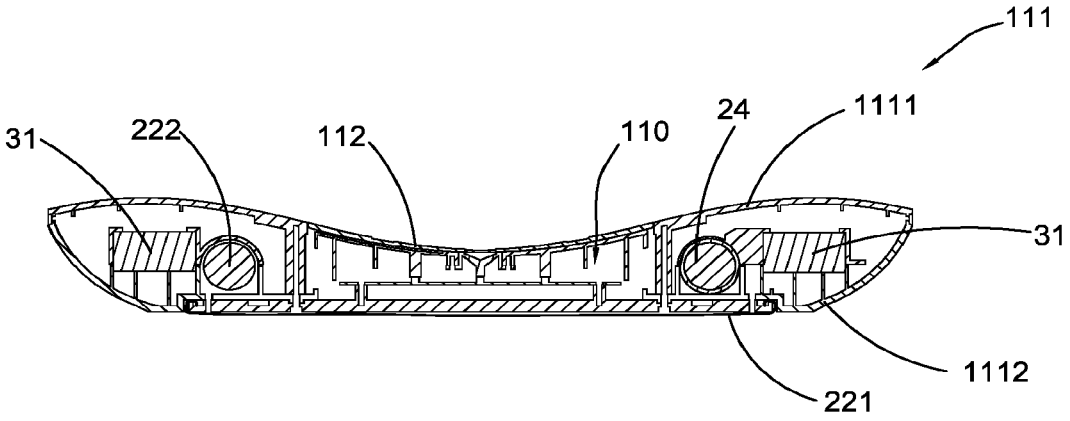
FIG. 6A is a sectional view along line A-A in FIG. 3 of the health-regain device according to above first preferred embodiment of the present invention.

Particularly, as shown in FIG. 6, a top surface 1111 of the first housing 11 has a predetermined radian, to match with the shape of waist portion of the user. As shown in FIG. 7C, when the user lies on the health-regain device, the user is support by the first housing 11, the waist portion of the user is supported to be a predetermined radian. At the time, all the heat source 21 and the massage device 24, and the light device 25 of the health-care module 20 can work on the user. At the time, if the radian of the waist portion of the user needs to be adjusted, the user can control the adjusting device 22 through the command module 254. According to the first preferred embodiment, the expansion of the gasbag 221 can be controlled by the adjust command module 2542. As shown in FIG. 7D, if the curved degree of the waist portion of the user is needed to be increased, the gasbag 221 should be inflated to increase the expansion of the gasbag 221 and lift a position of the first housing 11 with respect to the lying surface, so that the waist of the user who lies on the first housing 11 is lifted, and thus the curved degree of the waist of the user increases. If the curved degree of the waist of the user needs to be decreased, the gasbag 221 should be deflated to reduce the expansion of the gasbag 221 and drop the position of the first housing 11, so that the waist of the user who lies on the first housing 11 is lowered, and thus the curved degree of the waist portion of the user decreases. It is worth to mention that the frequency and degree of the reciprocating motion that caused by the gasbag 221 work on the waist of the user can be controlled by the adjust command module 2542.

According to the first preferred embodiment, the power module 30 comprises a power source 31 and a series of the conducting element 32. The air pump 222 can connect electrically to the power source 31 though the conducting element 32, so as to acquire the power from the power source 31. The reciprocate stretch effect can be better achieved by electrical motion.

As shown in FIG. 1, the adjusting device 22 further comprises a pressure sensor module 223. The inflation command module 2562 of the command module 254 commands the inflation and deflation of the expansion module 221, so as to control the expansion of the expansion module 221. The pressure sensor module 223 is adapted to sense the pressure of the expansion module 221, so as to be the basis of the command that the inflation command module 2562 commands the expansion module 221. For example, different users may have different sizes and their tolerances of the lumbar spine are different, so as to set a pressure value. When the pressure sensor module 223 senses the inner pressure of the expansion module 221 has reached the pressure value, the expansion module 221 stops being inflated.

According to the first preferred embodiment of the invention, the inflation command module 2562 comprises a magnetic valve 25621 and a microcomputer chip 25622. The pressure sensor module 223 is embodied as a pressure sensor 223. The magnetic valve 25621 is set in the gasbag 221 to be adapted to control the air pump 222 to inflate the gasbag 221.

It is worth to mention that the way that achieving stretching though the gasbag is an example of this invention, but not to be limited. According to other embodiments, the stretching can be achieved by other ways, such as by hydraulic pressure, magnetic and mechanical lift. As long as it can achieve the objects of the invention, the invention is not limited in this aspect.

It is worth to mention that the expansion module 221, the inflatable module 222, the inflation command module 2562, and the pressure sensor module 223 can be controlled by the stretch-command module 2562, so as to achieve the choose of the different rhythm of the reciprocating movement and the different stretch strength.

The pressure sensor 223 can sense the pressure of the gasbag 221, so the inflation command module 2562 can control the speed and time of the inflation, so as to control the expansion degree of the gasbag 221, and to control the speed, rhythm, the scope and the stretch of the reciprocating movement.

According to the first preferred embodiment of the invention, the microcomputer chip 25622 is connected with the pressure sensor module 223 that is adapted to control the gasbag 221, the air pump 222 and the magnetic valve 25621 set in the gasbag 221, so as to control the adjusting device 22.

The lighting device 23 comprises a series of the lighting element 231 and a light processing element 232. The lighting element 231 emits light to the light processing element 232. The light emitted by the lighting element 231 is deal by the light processing element 232, so as to form the light which has a big lighting area and an even lighting. According to the first preferred embodiment of the invention, the light processing element 231 is embodied as a displaying material, such a TV display, so that the lighting device 23 is embodied as a "lighting slab" which has the advantage of the even-light, big-area and thin. It is worth to mention that the light processing element 232 embodied as a displaying material is only an example but not a limitation of the invention. According to other embodiments of the invention, the light processing element 232 can be embodied as other material, such as transparent module. As long as it can achieve the objects of the invention, the invention is not limited in this aspect.

It is worth to mention that the feature that the lighting device 23 is thin enables the whole health-regain device being thin, and also makes the health-regain device to be easy-to-carry, small-in-size and easy-to-use.

As shown in FIG. 5, the lighting device 23 is set in a receiving cavity 110 of the first housing 11, and to be fixed and received by the first housing 11. The lighting device 23 is electrical connect with the power sourer 31 though the conducting element 32 to acquire power from the power source 31. The first housing 11 is set with at least a viewing window 119, so the light emits from the lighting device 23 can be out of the receiving cavity 110. Particularly, the viewing window 119 has light-transmittance quality that the light emitted from the lighting device 23 can penetrate out of the viewing window 119. It is worth to mention that the viewing window 119 can be set into kinds of shape, so as to increase the aesthetic feeling and the attraction of the health-regain device. According to the first preferred embodiment of the invention, the lighting device 23 further comprises a reflective layer 233. Compare to the lighting element 231, the reflective layer 233 is set opposed to the lighting element 232, so when the light emitted from the lighting element 231 be cast on the reflective layer 233, the reflective layer 233 can reflect the light back to the light processing element 232, so the lighting element 232 can deal with the light to lighter the light emit from the lighting element 23.

It is worth to mention that the lighting device 23 can not only produce visible light to attract the user, but also the infrared light and LED blue light, and the material of the light processing element 232 can be embodied as ceramics, so the lighting device 23 can provide health-regain to the user. This invention is not limited in this aspect.

According to the first preferred embodiment of the invention, the heat source 21 is embodied as a heating film 21 setting back of the lighting device 23.

Figure 7A:
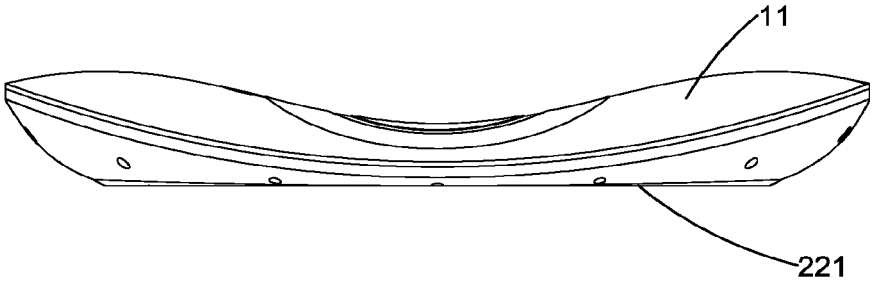
FIG. 7A and FIG. 7B are lateral views of the health-regain device according to the above first preferred embodiment of the invention.
Figure 7B:
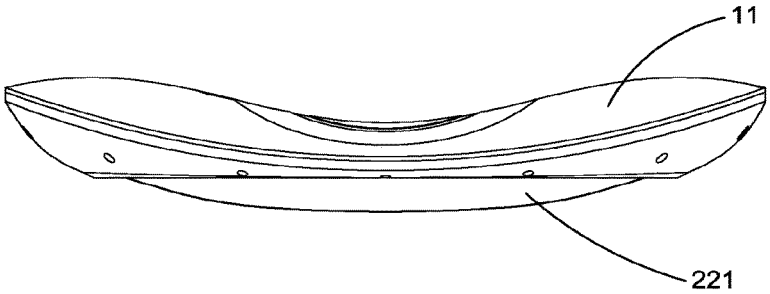

Particularly, the first housing 11 comprises a top housing body 111 and a center housing body 112, wherein the housing body 111 has a top surface 1111 shaped and sized to match the waist portion of the user and a center opening 1110 sized to fit the center housing body 112 to be supported thereat. The housing body 111 further comprises a positive stop portion 1121. As shown in FIGS. 6A and 7A, if the user health cares his waist using the health-regain device, the user lies on the health-regain device and the waist of the user is set on the first housing 11. Particularly, the waist portion of the user is set on the positive stop portion 1121 of the center housing body 112. During the process that the adjusting device 22 adjusts the first housing 11, the first housing 11 is forced by the adjusting device 22 and lifted. The first housing 11 forces on the waist of the user to lift the waist of the user to stretch the spine of the user. During the lifting, the positive stop portion 1121 is configured to restrict the horizontal movement of the waist of the user. When the force that the adjusting device 22 working on the first housing 11 decreases, the waist of the user goes dropping following the first housing 11. During the falling off, the positive stop portion 1121 can restrict the horizontal movement of the waist of the user, and it is worth to mention that the positive stop portion 1121 can be formed by forming a cambered surface on the center housing body 112, in such a manner that the positive stop portion 1121 can meet with the curve of the user to comfortable the using of the health-regain device.

It is worth to mention that, as shown in the A-A section view of FIG. 6A, the center housing body 112 has a concave shape to keep the harmony of the top surface 1111 of the first housing 11 and provide comfortable support for the users.

Figure 6B:
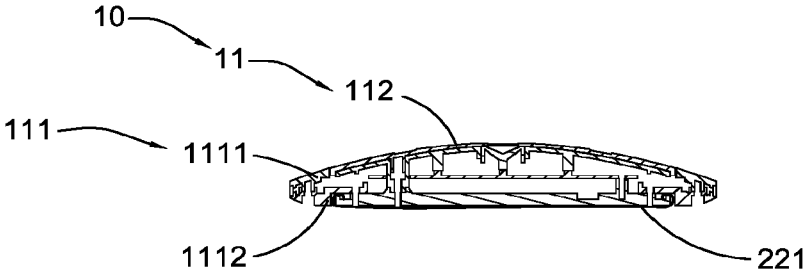
FIG. 6B is a sectional view of the B-B section health-regain device of the FIG. 3 according to the above first preferred embodiment of the invention.
Figure 7C:
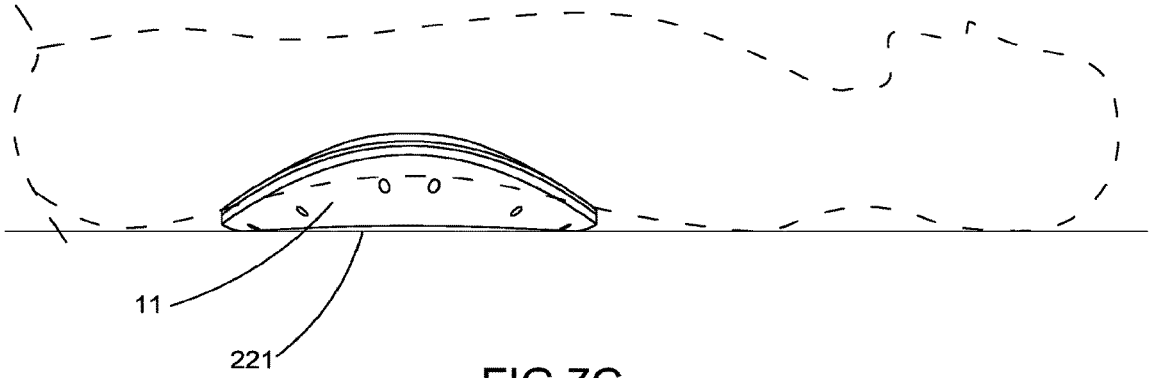
FIG. 7C and FIG. 7D are schematic views illustrating application of the health-regain device according to the above first preferred embodiment of the invention.
Figure 7D:
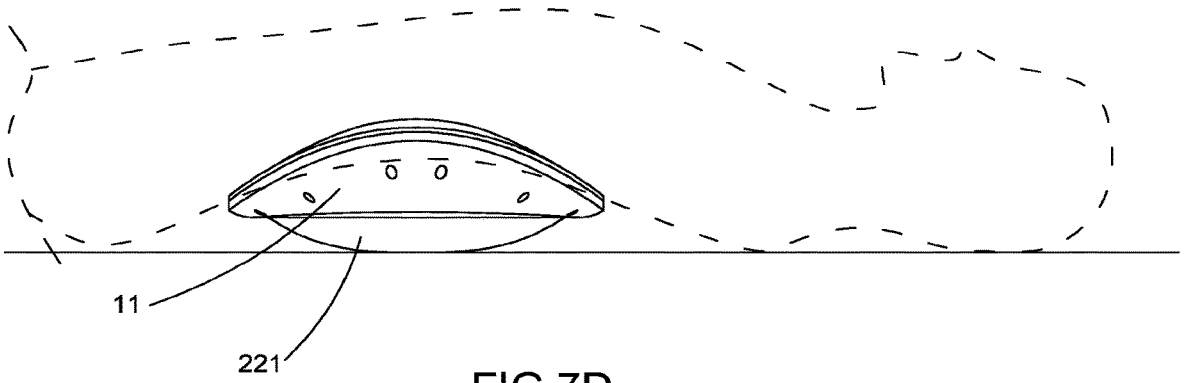
Figure 8:
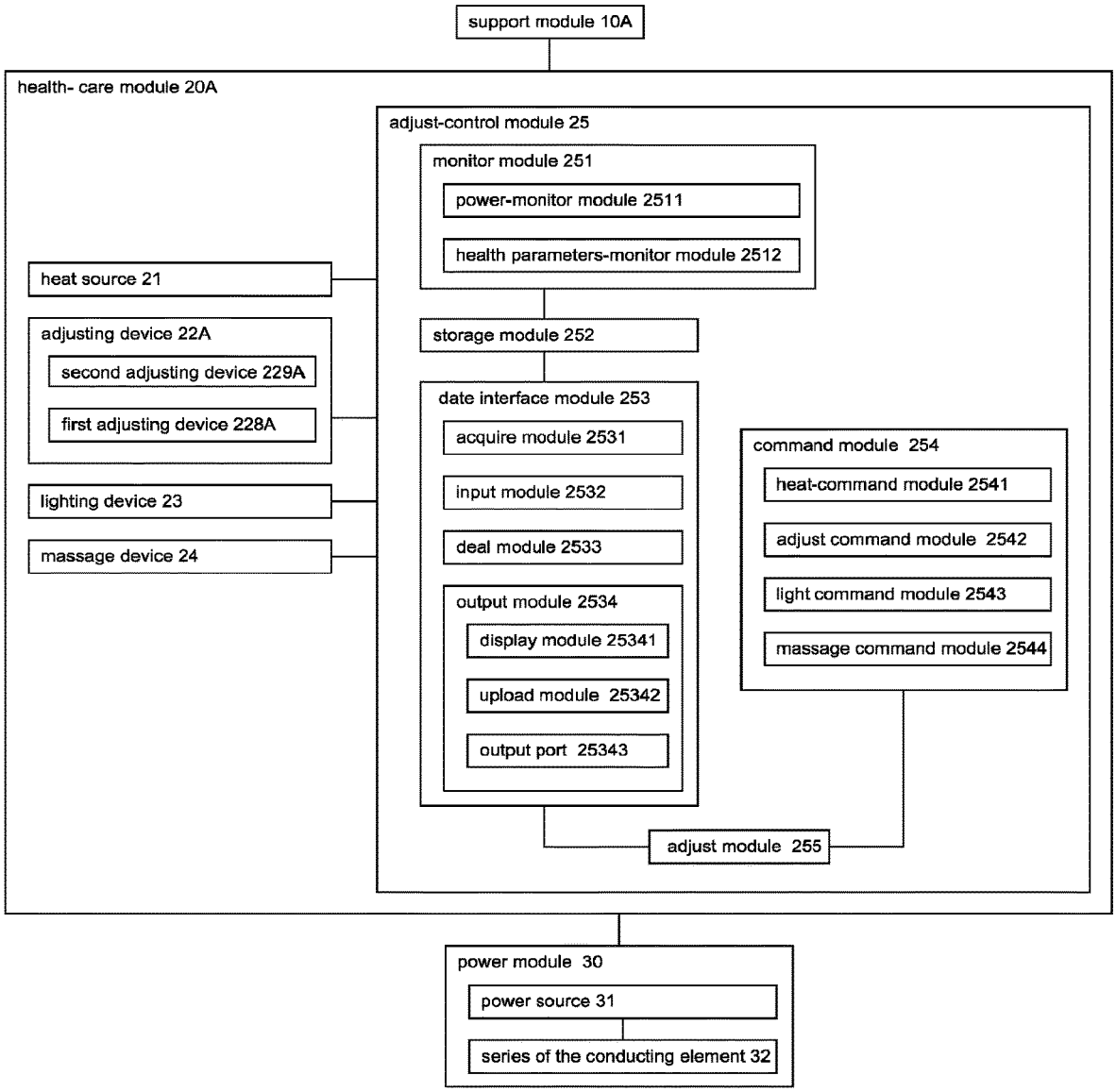
FIG. 8 is a schematic view illuminating a health-regain device according to a second preferred embodiment of the invention.
Figure 9:
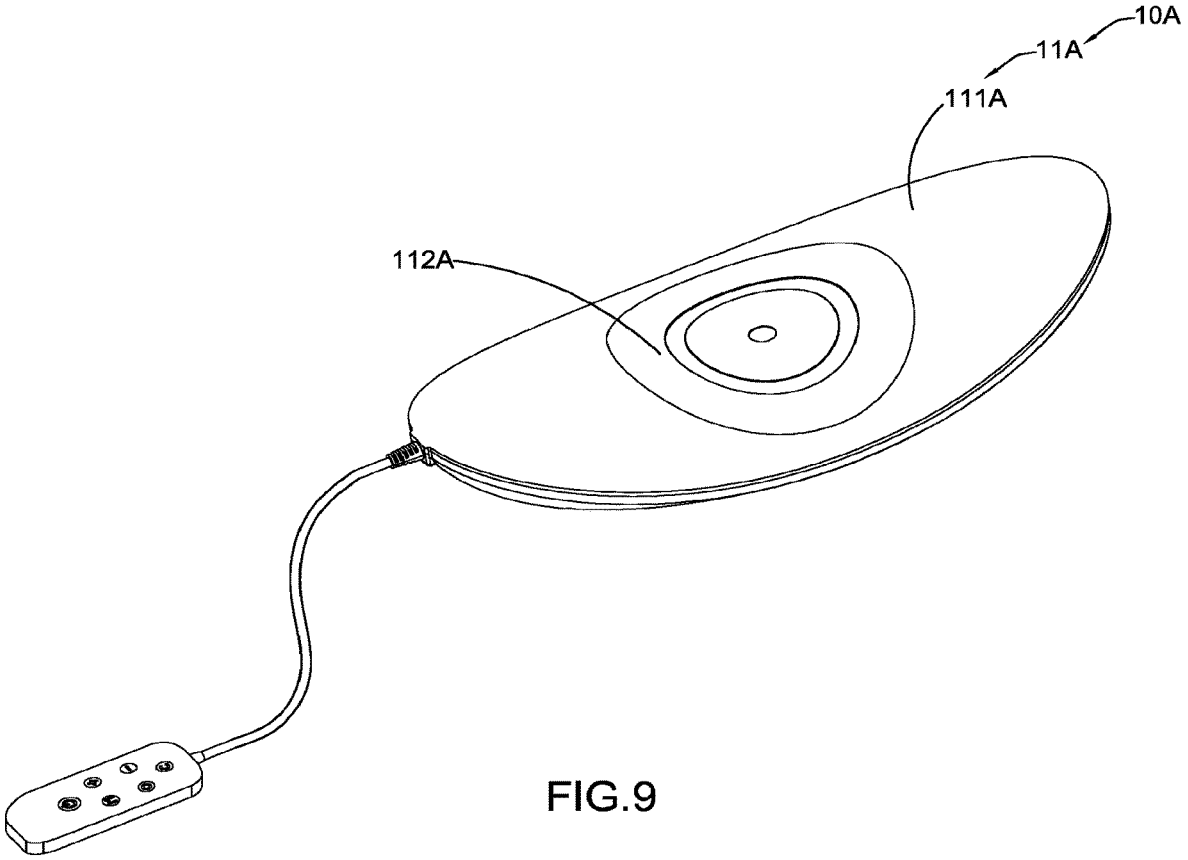
FIG. 9 is a perspective view of the health-regain device according to the above second preferred embodiment of the invention.

On the contrary, when the user lies on the first housing 11, the center housing body 112 should provide a suitable support which meets with shape of the spine to the user, as shown in the B-B section view of FIG. 6B, the center housing body 112 has a convex shape.

Figure 3:
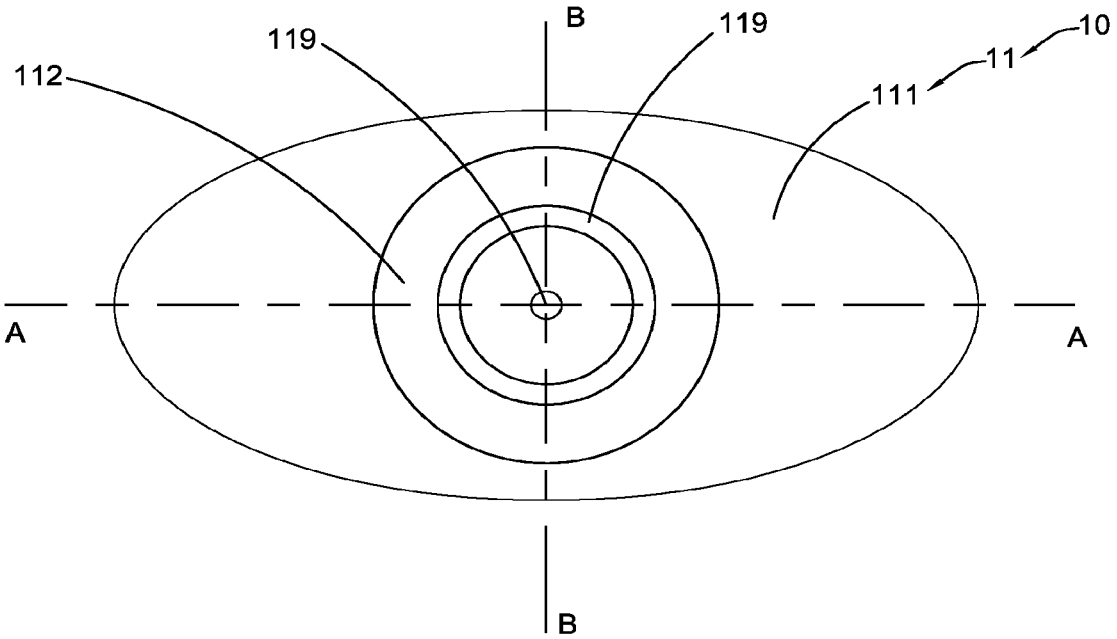
FIG. 3 is a schematic view of the health-regain device according to above first preferred embodiment of the present invention.

As shown in FIG. 2 and FIG. 3, the viewing window 119 is formed on the center housing body 112. It is worth to mention that the way that the housing body 111 and the center housing body 112 which are set independently is only an example but not a limitation, according to the first preferred embodiment of the invention. According to other embodiments, they can be formed integrally so to be connected integrally. As long as it can achieve the objects of the invention, the invention is not limited in this aspect. The lighting device 23 and the heat film 21 are set back of the center housing body 112. It is worth to mention that the heat film 21 is set at a position that be far away from the center housing body 112 relative to the lighting device 23 so as to form an even heat environment on the front surface of the center housing body 112, and to provide a better health-regain to the user, such as a heat cure. One skilled in the art should understand that the way that the heating film 21 is set at a position that away from the center housing body 112 relative to the lighting device 23 is only an embodiment but not a limitation of the invention. According to the other embodiments of the invention, the heating film 21 can also be set on the outside of the center housing body 112. As long as it can achieve the objects of the invention, the invention is not limited in this aspect.

As show in FIG. 5, the housing body 111 comprises a first housing body 111, i.e. the top housing body, and a second housing body 112, i.e. the center housing body. The first housing body 111 and the second housing body 112 can connect with each other by a detachable way, so the user can easily install, disassemble, maintain, and replace the element received on the receiving cavity 110.

It is worth to mention that the heating film 21 can electrically connect with the power source 31 though the conducting element 32, so to acquire the heat power from the power source 31. The heating film 21 can also be connected with the heat control module 2561 of the control module 256, so as to be controlled by the heat control module 2561.

Similarly, the lighting device 23 can be connected with the lighting control module 2563 of the control module 256, so as to be controlled by the lighting control module 2563.

According to the first preferred embodiment of the invention, the massage device 24 is embodied as a vibrating motor 24, wherein the vibrating motor 24 can massage the user by vibrating. The vibrating motor 24 is connected with the first housing 11, so the vibration of the vibrating motor 24 will drive the vibration of the first housing 11, so that the first housing 11 can massage the user by vibrating. The massage device 24 can electrically connect with the power source 31 though the conducting element 32 to acquire the power from the power source 31. The massage device 24 can connect with a massage control module 2564 of the control module 256, so as to be controlled by the massage control module 2564.

It is worth to mention that the adjust-control module 25 can form electricity strategy according to the power module 30. For example, when the power source 31 is poor in power supply, the stretch provided by the adjust-control module 25 of the health-regain device may be weaken until the power source 31 is in off power. However, if the weaken stretch can not meet with the user, it will be a waste of time for the user to take a long-time stretch. At the time, the adjust-control module 25 can short the work-time of the adjusting device 22, so as to guarantee the strength of the stretch provided by the adjusting device 22, so that the user can has a full stretch effect during the poor power situation.

As shown is FIG. 2, the adjust-control module 25 of the health-regain device according the first preferred embodiment can be embodied as a controller.

It is worth to mention that the way that the adjust-control module 25 be embodied as a controller is only an embodiment but not a limitation. According to the other embodiments, the adjust-control module 25 can be set in the first housing 11. According to the other embodiments, the adjust-control module 25 can be embodied as an electrical device, such as an APP of a mobile phone. As long as it can achieve the objects of the invention, the invention is not limited in this aspect.

It is worth to mention that the curved shape of the first housing 11 is helpful to provide a well support to the waist and the neck of the user. The health-regain device can be applied on the waist as well as on the neck. In the process of the application, the function and effect of the health-regain device can be adjusted according the different users and different bodies.

It is worth to mention that the set way, that the first housing 11 and the elements set in the first housing 11 form an integrity and be moved together, is only an embodiment but not a limitation for this invention. According to the other embodiments, the first housing 11 and the elements set in the first housing 11 can be set as different parts and be controlled respectively.

It is worth to mention that set way that the adjusting device 22 is set on the bottom of the first housing 11 is only an embodiment but not intends to limit the scope for this invention. According to the other embodiment, the adjusting device 22 can be embodied as other ways. For example, the first housing 11 can be divided into two layers, and the adjusting device 22 can be set between the two layers.

The set way that the adjusting device 22 be set as a gasbag is only an embodiment but not intends to limit the scope of this invention. According to other embodiments, the set way can be embodied as other ways, such as by magnetic, by hydraulic pressure and by machinery control. As long as it can achieve the objects of the invention, the invention is not limited in this aspect.

It is worth to mention that the way that the health-regain device be set with heat-cure, stretch, massage or lighting is only an embodiment but not a limitation for this invention. According to other embodiments, the health-regain device can be set with other functions, for example, being set with galvanism. It is worth to mention that the health-regain device is set with free space, so the user can add other function element. If the health-regain device needed to be upgraded, the user can only add function element rather than replace the whole health-regain device. For example, the health-regain device will upload to a "medium or low frequency" health-care while the health-regain device be added with a conductive metal piece.

Figure 10A:
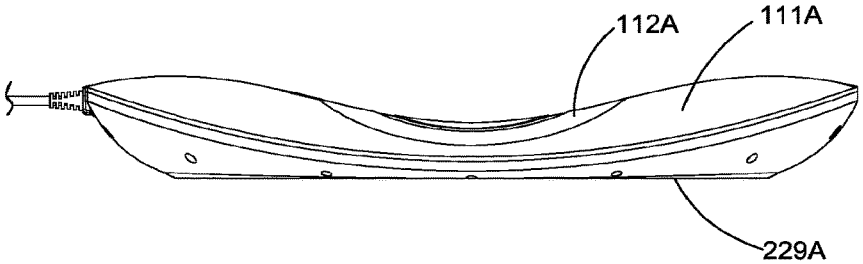
FIG. 10A to FIG. 10D are lateral views of the health-regain device according to the above second preferred embodiment of the invention.
Figure 10B:
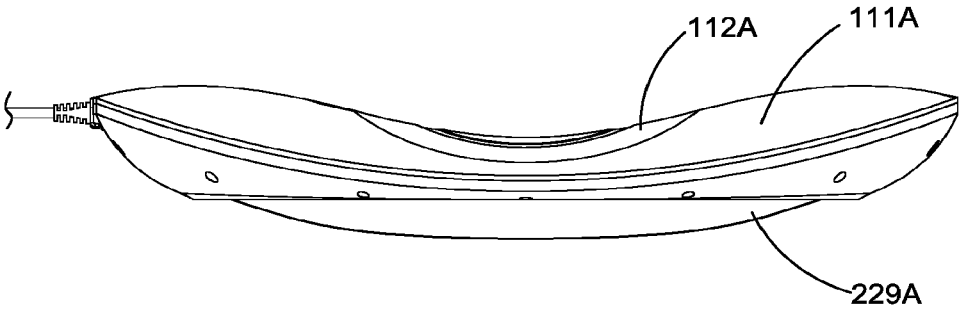
Figure 10C:
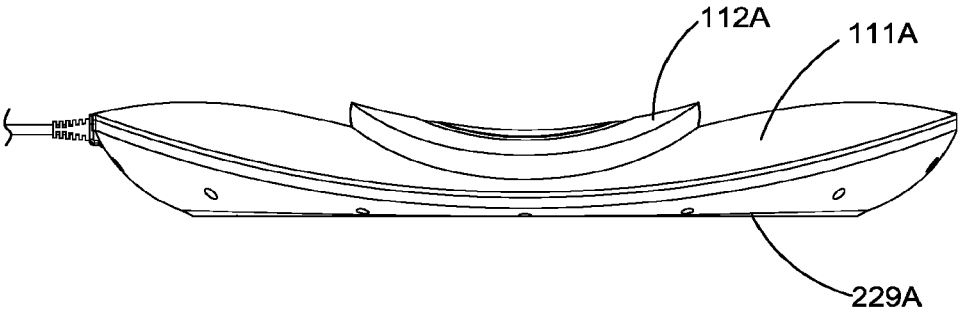
Figure 10D:
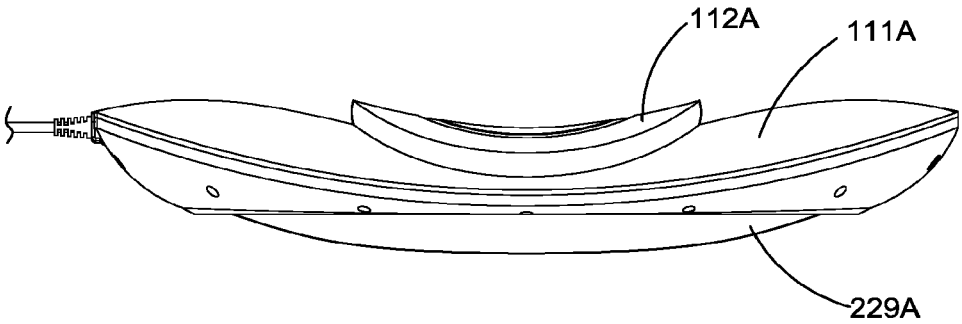
Figure 11:
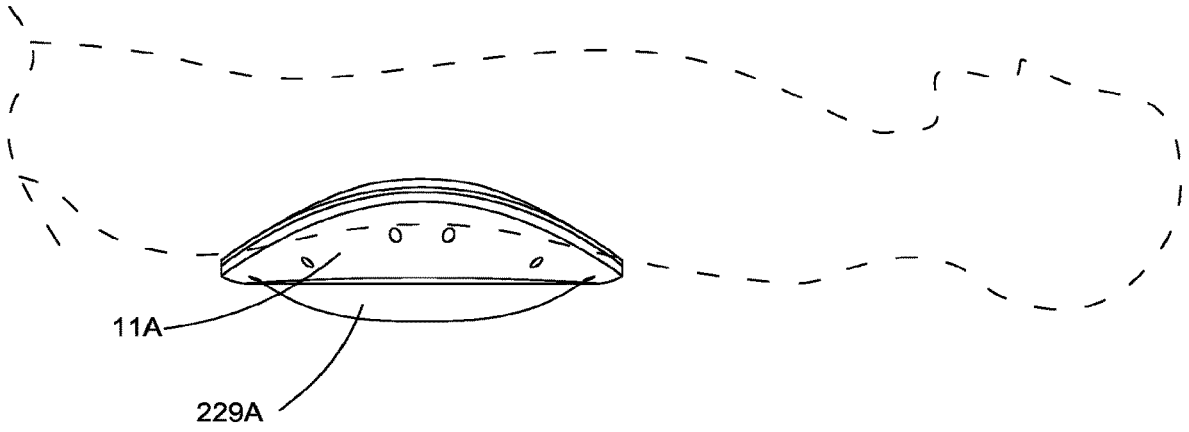
FIG. 11 is a schematic view illustrating an application on the waist of the health-regain device according to the above preferred embodiments of the invention.

FIG. 8 to FIG. 10D illuminate a health-regain device according to a second preferred embodiment of the invention. Differ from the first preferred embodiment, the adjusting module 22A of the health-regain device comprises a first adjusting device 229A and a second adjusting device 228A. The first adjusting device 229A and the second adjusting device 228A can be adjusted at the same time or be adjusted partly. As shown in FIG. 10B, the first adjusting device 228A can drive the whole first housing 11A of the health-regain device to have reciprocating movements so as to be adapted to stretch the waist of the user. As shown in FIG. 10C, the second adjusting device 228A drives the center housing 12A of first housing 11A of the health-regain device to have reciprocating movements so as to be adapted to stretch the waist of the user. As shown in FIG. 10D, the first adjusting device 229A and the second adjusting device 228A can work together to increase the adjustable scope of the middle area. One skilled in the art should understands that the above part-adjust and the whole-adjust is only an embodiment but not intending to limit the scope of the invention. As long as it can achieve the objects of the invention, the invention is not limited in this aspect.

Figure 13:
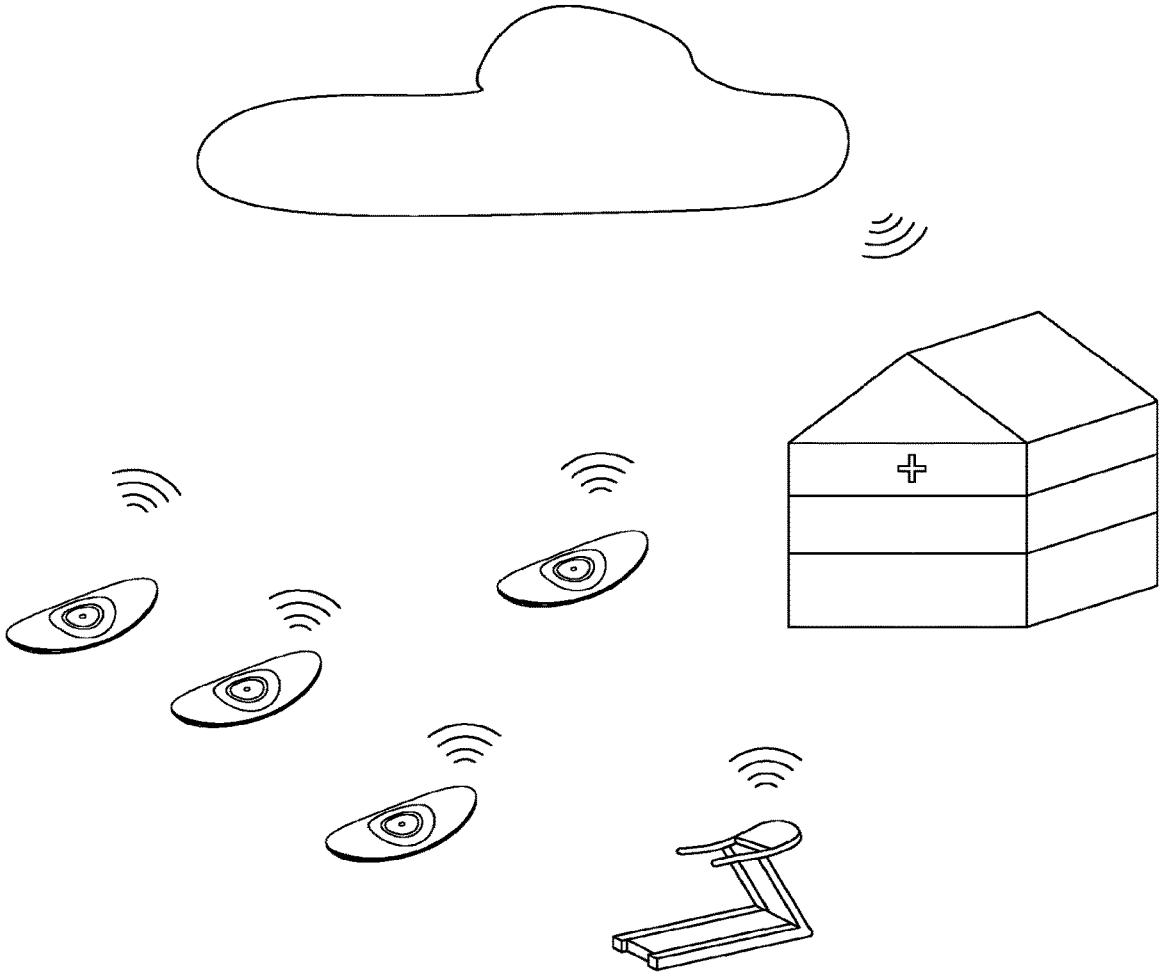
FIG. 13 is a schematic view illuminating a health-regain system of the invention.

FIG. 13 illuminates a heath-regain system according to this invention, the health-regain system comprises at least a health-regain device 1000 and a health-regain platform 2000 to share the data. The data can be acquired by the health institution such as other health-regain equipment or hospital though the health-regain platform 2000, so the user can have a better health-regain surface. Likely, the health-regain device 1000 can acquire other healthy information from other health-regain equipment, hospital of some healthy institution by the health-regain platform 2000, so as to start the health procedure that meets with the personalized need of the users. It is worth to mention that the "health platform" relates to module that can acquire, store, deal and output the healthy information.

According to one embodiment of the present invention, the user is lying to use the health-regain device 1000. In the preferred embodiment, the health-regain device 1000 is disposed on the waist of the user. It is worth to mention that when lying, the user is relaxed with whole body to enhance the efficiency of the health-regain device 1000. As the beginning of using the health-regain device 1000, the adjusting device 22 drives the first housing 11 going up. The adjusting device 22 drives the first housing 11 reaching a high predetermined value, and the adjusting device 22 stops driving the first housing 11. As the first housing 11 is going up, the waist of the user is lifted to increase the bending of the spine. As the adjusting device 22 decreases the driving force to make the first housing 11 going dropping for decrease the bending of the waist of the user. When the first housing 11 is going to reach a low predetermined valve, the adjusting device 22 stops to decrease the driving force. Then, the adjusting device 22 drives the first housing 11 up, and the waist of the user is lifted to increase the bending of the spine. When the first housing 11 is going up to reach the high predetermined value, the adjusting device 22 stops driving the first housing 11. Then the adjusting device 22 decreases the driving force to make the first housing 11 going down. The waist of the user is going dropping to decrease the bending of the spine. When the first housing 11 is going dropping and reaching the low predetermined value, the adjusting device 22 stops to decrease the driving force. In such manner, the adjusting device 22 drives the first housing 11 going up and dropping repeatedly to change the bending of the spine of the user to do bending health-regain. Further, when lifting repeatedly the first housing 11 drove by the adjusting device 22, the muscle on the waist of the user is exercised.

The command module 254 controls the adjusting device 22 to adjust the driving force. In details, the command module 254 controls the adjusting device 22 to provide the driving force to lift the first housing 11. The command module 254 controls the adjusting device 22 to decrease provided driving force to make the first housing 11 going down. It is worth to mention that when the adjusting device 22 drives the first housing 11 to the high predetermined value, the command module 254 is capable of controlling the adjusting device 22 keeping increasing the driving force. The waist of the user is lifted by the first housing 11. And the bending of waist is increased. The command module 254 increases the driving force according to an extension value to control the adjusting device 22. When the driving force provided by the adjusting device 22 reaches the extension value, the command module 254 controls the adjusting device 22 to stop provide the driving force. The command module 254 controls the adjusting device 254 to decrease the driving force to the low predetermined value. And the waist of the user is going dropping along the first housing 11. The bending of the spine of the user is back to the bending before the adjusting device 22 drove the first body 11 lifted. When the driving force provided by the adjusting device 22 is decreased to the low predetermined value, the command module 254 controls the adjusting device 22 to increase the driving force to lift the waist of the user with the first housing 11. The waist of user is lifted, and the bending of the lumbar spine is increased. When the driving force provided by the adjusting device 22 has reached the extension value, the command module 254 controls the adjusting device 22 to stop increasing the driving force. The command module 254 controls the adjusting device 22 to decrease the driving force to the low predetermined value. The waist of the user is going dropping with the first housing 11. And the bending of the lumber spine is back to before the bending of the lumbar spine lifted by the adjusting device 22 driving the first housing 11. In such a manner, the health-regain device 1000 provides extension bending health-regain.

In other words, the health-regain device 1000 provides two stages for the bending health-regain. One is regular health-regain stages, and the other is extension bending health-regain. In the regular health-regain stage, the command module 254 controls the adjusting device 22 to provide driving force to lift the first housing 11 to the high predetermined value. The bending of the waist of the user is increasing. Then, the command module 254 controls the adjusting device 22 to decrease the driving force, to make the first housing 11 going dropping to initial state. And the bending of the user is back to initial state. In the extension health-regain stage, the bending of the lumbar spine can reach the maximum value of the regular health-regain stage. At the time, the command module 254 controls the adjusting device 22 to keep providing the driving force to retain the first housing 11 to be lift. And the bending of the lumbar spine is kept increasing. When the driving force provided by the adjusting device 22 has reached the extension value, the command module 254 controls the adjusting device 22 to stop increasing the driving force. The command module 254 controls the adjusting device 22 to decrease the driving force to low predetermined value. And the waist of the user is going dropping with the first housing 11. And the bending of the lumbar spine is back to the bending when the first housing 11 drove by the adjusting device 22. Preferably, in the extension health-regain stage, the distance of the first housing 11 lifted is less than in the regular health-regain stage. That is to say, the adjusted bending of lumbar spine of the user in the extension health-regain stage is less than the adjusted bending of lumbar spine of the user in the regular health-regain stage. In the regular health-regain stage, when the first housing 11 is lifted to the high predetermined value, the gap between adjacent spine is increased. In extension health-regain stage, when the gap between adjacent spine is increased to a certain level, the gap is continued to increase. As the first housing 11 is lifted to the extension predetermined level, the first housing 11 is going down. And the gap between adjacent spine is decreased. So, the first housing 11 is reciprocated between the predetermined value and the extension value to relax the adjacent spine in such a manner which is helpful to spine health-regain.

Furthermore, the command module 254 controls the adjusting device 254 to provide the rhythm of the driving force. In details, the command module 254 controls the adjusting device 22 to provide the driving force rhythmically to make the first housing 11 lifted. The command module 254 controls the adjusting device 22 to provide the driving force rhythmically to make the first housing 11 downwards. It is worth to mention that the command module 254 controls the adjusting device 22 to change the rhythm of the driving force. In the regular state and the extension state, the command module 254 controls the adjusting device 22 in different kinds of driving rhythm. It is worth to mention that the command module 254 controls the adjusting device 22 to provide the driving force with changing the rhythm. In other words, the command module 254 controls the adjusting device 22 to provide the driving force to change decreasing the driving force by the adjusting device 22 with sustaining the driving force by the adjusting device 22. In other words, during the adjusting device 22 provides the driving force changing to decreasing the driving force, the adjusting device 22 further has a process to sustain the driving force.

In one embodiment of the present invention, the adjusting device 11 is embodied to the gasbag 211 and the inflatable module 222. The command module 254 controls the inflatable module 222 to fill air in the gasbag 211 for inflating to expand and provide driving force which will drive the first housing 11 lifting. As the first housing 11 is drove to the high predetermined value, the command module 254 controls the inflatable module 222 to stop inflating. Then the command module 254 controls the inflatable module 222 to deflate the gasbag 221 to reduce the gasbag 221 and decrease the driving force. The first housing 11 going downwards. The command module 254 controls the rhythm of inflating the gasbag 221 by the inflatable module 222. The command module 254 controls the rhythm of deflating the gasbag 221 by the inflatable module 222. The command module 254 controls the inflatable module 222 to change the gasbag 221. It is worth to mention that the adjusting device 22 provides the driving force in electromagnetic or mechanical manner.

It is worth to mention that the adjust module 255 adjusts the command module 254 for controlling the heat source 21 and the adjusting device 22 working cooperatedly controlled by the command module 254. For example, when the health-regain device 1000 just starts working, if the temperature is low, which is not suitable for doing health-regain by the health-regain device 1000, the adjust module 155 adjust the command module 254 to make the command module 254 control the heat source 21 to start working to heat up and make the temperature suitable to do health-regain for waist muscle. Then the adjust module 255 adjusts the command module 254 to control the adjusting device 22 providing the driving force. The first housing 11 is lifted. And the waist of the user is lifted. The bending of the spine is increased. As the adjusting device 22 provides the driving force to reach the high predetermined value, the command module 254 controls the adjusting device 22 to decrease the driving force and the first housing 11 is going down. During the command module 254 controls the adjusting device 22 to provide health-regain, the adjust module 255 adjusts the command module to control the heat source 21 to sustain the temperature for helping health-regain. In other words, if the temperature is suitable for doing health-regain, the adjust module 255 adjusts the command module 254 to control the heat source 21 stopping to provide heat If the temperature is low, the adjust module 255 adjusts the command module 254 to control the heat source 21 to provide heat. It is worth to mention that, during the bending health-regain, the adjust module 255 adjusts the command module 254 to control the lighting device 23 lightening to doing light health-regain. Such as illuminating the skin by the light provided by the lighting device 23 to do cosmetology of the waist. The adjust module 255 adjusts the command module 254 to control the illumination intensity of the light device 23. Furthermore, the adjust module 255 adjusts the command module 254 to control the heat source 21 and the light device 23 cooperatedly to provide a health-regain environment for bending health-regain. The adjust module 255 adjusts the command module 254 to control the heat source 21, the lighting source 23 and the adjusting module cooperatedly so that the adjusting device 22 provide health-regain in the health—regain environment. It is worth to mention that the heat source 21 is embodied into heating film or thermal fuse.

It is worth to mention that the health parameters-monitor module 2512 is capable of detecting temperature, the electromyographic signal and other signal of the body. The health parameters-monitor module 2512 send the temperature to the adjust module 255. The adjusting module 255 controls the heat source 21 to adjust temperature according the temperature of the body. In details, the adjust module 255 analyzes the temperature of the body. If the temperature of the body is lower to do bending health-regain, the adjust module 255 adjusts the command module 254 to control the heat source 21 to provide heat If the temperature of the body is higher to do bending health-regain, the adjust module 255 adjusts the command module 254 to control the heat source 21 to stop providing heat. It is worth to mention that the adjust module 254 is capable of get the suitable temperature for bending health-regain by analyzing the temperature and the electromyographic signal of the body. What is more, during the bending health-regain, the adjust module 254 separately adjusts the adjusting device 22, the heat source 21 and the lighting device 23 cooperatedly for bending health-regain by analyzing the temperature, the electromyographic signal of the body, pressure data provided by pressure sensor and the illumination intensity of the light device 23.

The health-regain platform 2000 is communicably connected with the health-regain device 1000. In details, the health-regain platform 2000 is communicably connected with the data interface module 253. The adjust module 255 send the temperature, the electromyographic signal of the body, the pressure data and/or the illumination intensity by the data interface module 253 to the health-regain platform 2000. The health-regain platform 2000 is capable of receiving and storing at least one user data. The user data comprises the temperature, the electromyographic signal of the body, the pressure data, the illumination intensity and/or time of doing health-regain by the user. If the user sends the user data to the health-regain platform 2000 by the health-regain device 1000, the health-regain platform 2000 selects multiple the user data to analyze according to the user data for provide an initial environmental data. The initial environmental data is sent to the health-regain device 1000 by the health-regain platform 2000. By the data interface module 253, the initial environmental data is sent to the adjust module 255. The adjust module 255 adjusts the command module 254 to separately control the adjusting device 22, the heat source 21, the lighting device 23 and the massage device 24 cooperatedly according to the initial environmental data. It is worth to mention that the adjust module 255 adjusts the command module 254 to separately control the heat source 21 and the lighting device 23 to form the health-regain environment according to the initial environmental data. After finishing the initialing environment, the adjust module 255 analyzes the temperature, the electromyographic signal of the body, the pressure data and/or the illumination intensity that acquired. After analysis, the adjust module 255 adjusts the command module 254 to separately control the adjusting device 22, the heat source 21 and the massage device 24 cooperatedly according to the analysis result for doing the health-regain.

It is worth to mention that the user can acquire the user data by manner of X-ray test, B-mode ultrasound, CT, Mill and so on. The user data is sent to the health-regain platform 2000 for analysis the user data to make sure the physiological bending of the lumbar spine of the user. The health-regain platform 2000 comprises the physiological bending of the lumbar spine of the user into the initial environmental data. The adjust module 255 analyzes the initial environmental data to acquire the physiological bending of the lumbar spine of the user. The adjust module 255 adjusts the command module 254 to control the adjusting device 22 providing the driving force to lift the first housing 11. By lifting the first housing 11, the waist of the user is lifted to physiological bending of the lumbar spine of the user. Then the adjust module 255 adjusts the command module 254 to control the adjusting device 22 keeping providing the driving force to lift the first housing 11. The bending of the lumbar spine of the user is increased. The adjust module 255 adjusts the command module 254 to control the adjusting device 22 decreasing the driving force. The first housing 11 is going dropping to decrease the bending of the lumbar spine. As the bending of the lumbar spine is decreased to the physiological bending of the lumbar spine of the user, the adjust module 255 adjusts the command module 254 to stop decreasing the driving force. Then the adjust module 255 adjusts the command module 254 to provide force to lift the first housing 11 for increasing the bending form the physiological bending of the lumbar spine of the user. In other words, the bending health-regain further comprises a physiological bending state, the adjusting device 22 adjusts the command module 254 to control the adjusting device 22 providing the driving force to lift the first housing 11. The physiological bending of the lumbar spine of the user is used as the initial value of the regular bending health-regain when the adjusting device 22 adjusts the command module 254 to control the adjusting device 22. It is worth to mention that the health-regain platform 2000 provides to monitor the health-regain device 1000 to do the health-regain. In other words, during the bending health-regain, the health-regain platform 2000 adjust the health-regain device 1000 according to the temperature, the electromyographic signal of the body, the pressure data and/or the illumination intensity.

Figure 14A:
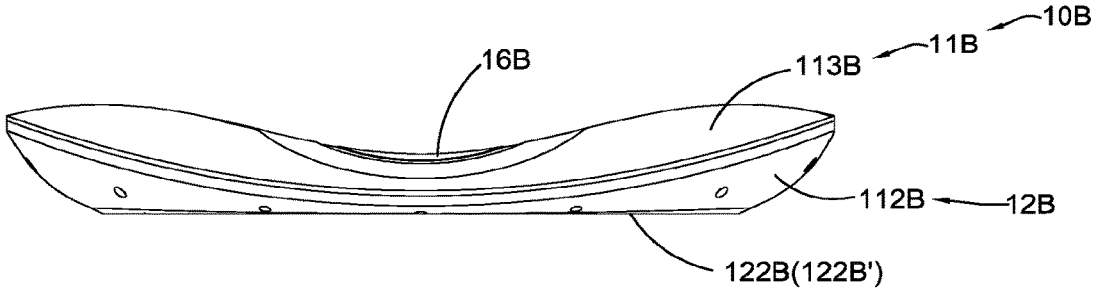
FIGS. 14A and 14B are perspective views of the health-regain device according to another preferred embodiment of the present invention.
Figure 14B:
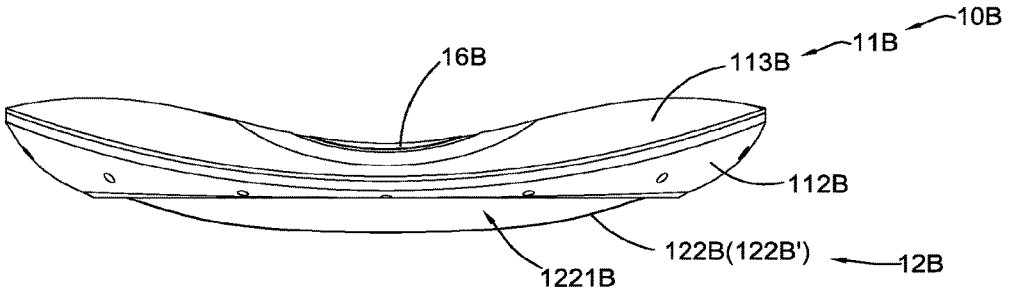

FIGS. 14A to 14B illustrate a health-regain device 10B according to another embodiment of the present invention. The health-regain device 10B which is a health device comprising a driving portion 12B and a health portion 11B. The driving portion 12B drives the health portion 11B to reciprocate for providing bending health-regain. The driving portion 12B drives the health portion 11B at interval. Preferably, the driving portion 12B drives the health-regain 11B rhythmically. The driving portion 12B is disposed on one side of the health portion 11B. Preferably, the driving portion 12B is disposed under the health portion 11B. The health-regain device 10B is adapted for the back health-regain. Preferably, the health-regain device 10B is applied for the waist or the neck health-regain. When the user using the health-regain device 10B, the body portion of the user touched the health device 11B is defined as the health-regain portion of the user. Preferably, the health-regain portion of the user is the waist and the neck. The bending health-regain is adjusting the force between the spine at intervals to relax the adjacent spine. Preferably, the bending health-regain is applied for the lumbar spine. The lumbar spine is forced rhythmically to relax the adjacent lumbar spine. The bending health-regain is also applied on the cervical spine. The cervical spine is forced rhythmically to relax the adjacent cervical spine.

Figure 14C:
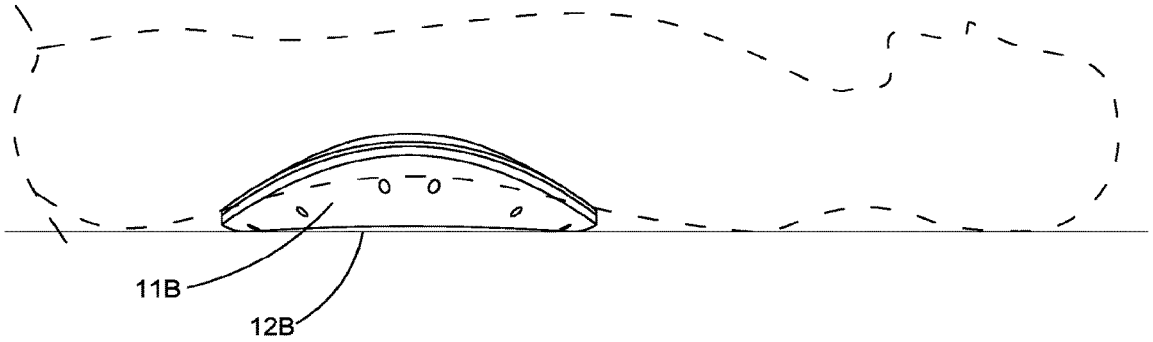
FIGS. 14C and 14D are perspective views of the health-regain device applying on the waist according to another preferred embodiment of the present invention.
Figure 14D:
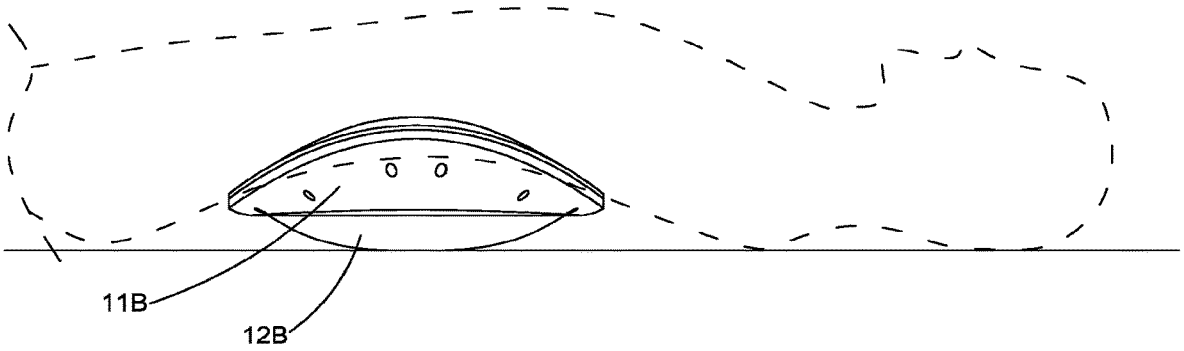

In the embodiment, the health-regain device 10B is applied on the waist of the user to do health-regain, as shown in FIGS. 14C and 14D. the driving portion 12B drives the health portion 11B at interval to provide adjusting force to the waist of the user by the health portion 11B. As increasing the driving force by the driving portion 12B, the health portion 11B is driven to apply on the waist of the user. When the driving force provided by the driving portion 12B is larger than the gravity of the waist of the user, the waist of the user is lifted to increase the bending of the lumbar spine of the user. The driving portion 12B adjusts the driving force, and when the driving force provided by the driving portion 12B is less than the gravity of the waist of the user, the waist of the user is going dropping to decrease the bending of the lumbar spine of the user. By increasing and decreasing the driving force by the driving portion 12B, the health portion 11B is lifted and going dropping so that the bending gap between the spine is increased and decreased for doing the bending health-regain to the waist of the user.

In other words, the driving portion 12B drives the health portion 11B at interval is that changing between increasing the decreasing the driving force at interval. In other words, by adjusting the driving force of adjusting the driving portion 12B, the driving portion 12B drives the health portion 11B reciprocatedly. In details, the driving portion 12B changes into decreasing the driving force after increasing the driving force; the driving portion 12B changes into increasing the driving force after decreasing the driving force. It is worth to mention that between increasing the driving force and decreasing the driving force the driving portion 12B further provides a process of sustaining the driving force. In other words, when the driving portion 12B increases the driving to a predetermined value, the driving portion 12B keeps providing the driving force. The health portion 11B supports the waist of the user to retain the bending of the lumbar spine in predetermined time. After that, the driving portion 12B decreases the driving force and the health portion 11B is going dropping to decrease the bending of the lumbar spine of the user.

It is worth to mention that the time which the driving portion 12B maintains the driving force can be set. The maximum value of the driving force provided by the driving portion 12 may be set. It is worth to mention that, as the user's lumbar spine length is gradually increased in the process, the adjacent lumbar interspinal space gradually increased. The user's lumbar spine is stretched. That is, the effect of forcing on the lumbar spine is that the user's lumbar spine gradually is adapted to the increase in the interval between the adjacent lumbar spine, which contributes to the recovery of the physical lumbar of the user's lumbar spine. Likewise, the bending health-regain is also suitable for cervical spine. It is worth to mention that the driving portion 12B adjusts the force in interval, and the driving portion further controls the gap to form rhythm. Further, the driving portion 12B controls the rotational speed of the driving force to form a driving rhythm. That is, the driving portion 12B controls the increase of the driving force to reduce the speed of the driving force to form the driving rhythm. Further, the driving portion 12B forms driving rhythm by controlling the adjusting speed of the driving force. Specifically, the driving portion 12B controls the speed of the driving force is increased and/or the speed of the driving force is reduced to form the driving rhythm. The rhythm of the reciprocating motion is controlled by the driving rhythm by the driving portion 12B, and the rhythm of the bending health-regain of the user's lumbar spine is also controlled.

Figure 15:
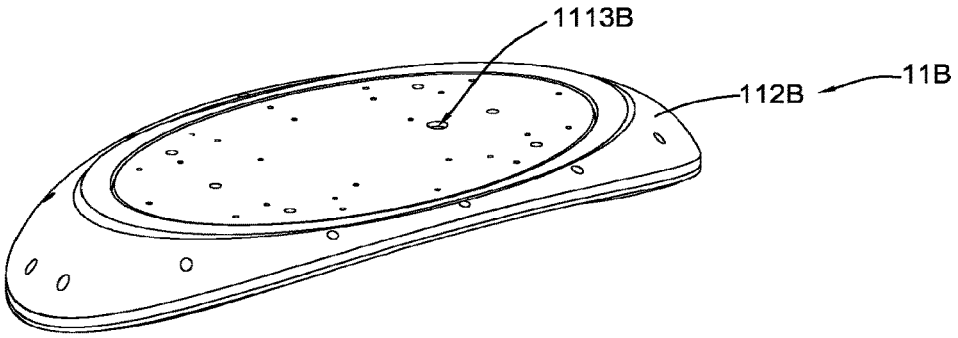
FIG. 15 is a perspective view of the health-regain device according to another preferred embodiment of the present invention.
Figure 16A:
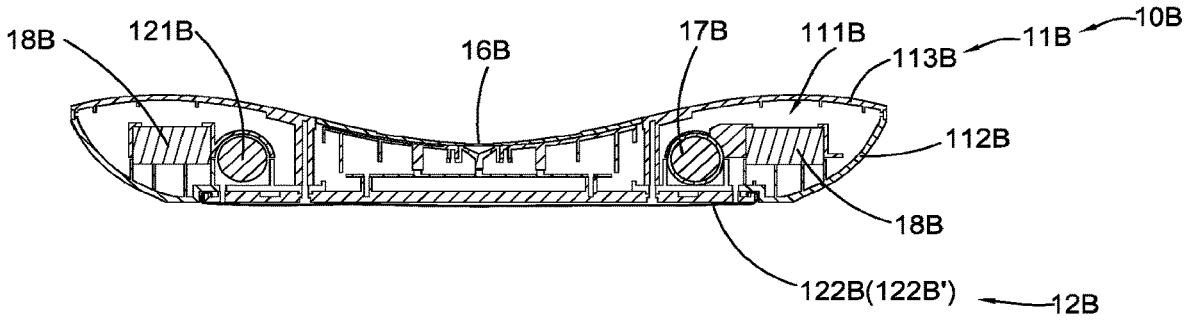
FIG. 16A is a perspective view of the health-regain device according to another preferred embodiment of the present invention, illustrating the curved surface along line A-A.
Figure 16B:
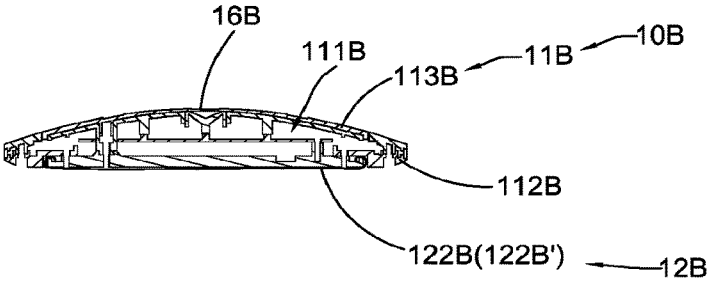
FIG. 16B is a perspective view of the health-regain device according to the preferred embodiment of the present invention, illustrating the curved surface along line B-B.

As shown in FIGS. 16A and 16B, in the preferred embodiment, the driving portion 12B drives the health portion 11B in an air pressure manner. Specifically, the driving portion 12B further comprises an air adjusting device 121B and a resilient covering 122B. The resilient covering 122B is provided at a bottom portion of the health portion 11B. The edge of the resilient covering 122B is sealingly connected to the bottom of the health portion 11B to form an air receiving chamber portion 1221B between the bottom of the health portion 11B and the resilient covering 122B. The health portion 11B further has a receiving cavity 111B. The receiving cavity 111B is located inside the health portion 11B. The air receiving chamber portion 1221B is formed outside the health portion 11B. That is, the air receiving chamber portion 1221B and the receiving cavity 111B are provided on both sides of the bottom of the health portion 11B respectively. The air adjusting device 121B is communicated with the air receiving chamber portion 1221B. The air adjusting device 121B is provided in the receiving cavity 111B. The air adjusting device 121B controls the gas volume of the air receiving chamber portion 1221B. As shown in FIG. 15, the bottom portion of the health portion 11B is provided with at least one hole 1113B. The air adjusting device 121B is communicated with the air receiving chamber portion 1221B through the hole 1113B. The air adjusting device 121B inflates the gas to the air receiving chamber portion 1221B so that the air receiving chamber portion 1221B is filled with gas. The air adjusting device 121B draws gas from the air receiving chamber portion 1221B to discharge the gas of the air receiving chamber portion 1221B. The gas volume of the air receiving chamber portion 1221B is adjusted by the air adjusting device 121B to adjust the air pressure of the air receiving chamber portion 1221B so as to adjust the driving portion 12B to supply the driving force to the health portion 11B. It is worth to mention that the bottom of the health portion 11B has a connecting slot 1112B. The resilient covering 112B is hermetically connected to the connecting slot 1112B. Preferably, the edge of the resilient covering 112B is sealingly connected to the connecting slot 1112B to form the air receiving chamber portion 1221B. It is worth to mention that the resilient covering 112B has well air tightness.

That is, the air receiving chamber portion 1221B formed by the resilient covering 112B has a good airtightness.

It is worth to mention that the resilient cover 122B may be implemented as a gasbag 122C. The gasbag 122C has an air receiving chamber portion 1221C and a connecting opening 1222C. The connecting opening 1222C is communicated with the hole 1113B. The air adjusting device 121B is communicated with the hole 1113B. The air adjusting device 121B is communicated with the connecting opening 1222C through the hole 1113B. The air adjusting device 121B is communicated with the connecting opening 1222B through the hole 1113B to the air receiving chamber portion 1221C. The air adjusting device 121B is communicated with the air receiving chamber portion 1221C to adjust the gas volume of the air receiving chamber portion 1221C.

When the user is using the health-regain device 10B, the user may use a lying or a sitting position. If the user is lying, such as lying on the bed, the health-regain device 10B is placed under the waist so that the health-regain device 10B supports the user's waist. The health-regain device 10B may also be placed under the neck. Preferably, the health-regain device 10B is placed horizontally on the user's waist or neck.

When the health-regain device 10B is used, the health-regain device 10B is placed in a supporter. The supporter supports the health-regain device 10B if the user is lying on the supporter using the health-regain device 10B. When the user is sitting on a chair using the health-regain device 10B, the back is used as the supporter for supporting the health-regain device 100. That is, the health-regain device of the present invention is suitable for lying or sitting. And the user is using the health-regain device 10B in a lying manner as an example. Preferably, the bottom of the health-regain device 10B is placed horizontally on the supporter. The supporter supports the health-regain device 10B. The resilient covering 122B is in contact with the supporter. The air adjusting device 121B inflates the air receiving chamber portion 1221B. After the air receiving chamber portion 1221B is filled with the gas, the gas volume of the air receiving chamber portion 1221B is continuously increased. The air pressure of the air receiving chamber portion 1221B gradually increases. The gas is applied on the health portion 11B and the resilient covering 122B respectively. However, the supporter prevents the air receiving chamber portion 1221B from expanding in the direction of the supporter, and the air receiving chamber portion 1221B is expanded in the direction of the health portion 11B. That is, the air pressure of the air receiving chamber portion 1221B is used as a driving force. When the force of the gas contained in the air receiving chamber portion 1221 is greater than the force applied to the health-regain portion by the user's waist, the health portion 11B moves in a direction away from the supporter. The health portion 11B is pushed away from the initial position. If the health portion 11B is in contact with the user's waist, the health portion 11B apply the force on the waist of the user so that the user's lumbar spine is subjected to the force. The lumbar spine of the user moves in the direction away from the supporter with the health portion 11B is affected by the force of the user's lumbar spine. The bending of the user's lumbar spine is increased. The user's lumbar spinal bending increased, making the adjacent lumbar interspinal space increased. Further, the waist muscles are also passive to get exercise. The air adjusting device 121B is provided with an inflation predetermined value. When the amount of the gas supplied from the air adjusting device 121B to the air receiving chamber portion 1221B reaches the inflation predetermined value, the air adjusting device 121B stops supplying the gas to the air receiving chamber portion 1221B. At this time, the health portion 11B stops moving. The force applied by the gas contained in the air receiving chamber portion 1221B on the health portion 11B supports the current position where the health portion 11B stays. The health portion 11B supports the user's waist. The user's lumbar spine is maintained at the current bending. The user's waist muscles are stretched, and in such a way the user's waist muscles are also got exercised.

The air adjusting device 121B further adjusts the gas volume of the air receiving chamber portion 1221B to adjust the driving force provided by the air receiving chamber portion 1221B by reducing the gas volume of the air receiving chamber portion 1221B. The gas volume of the air receiving chamber portion 1221B is reduced, and the force applied by the gas on the health portion 11B is reduced. The driving force of the health portion 11B is reduced to the provision of the waist of the user. The health portion 11B moves in the direction of the supporter when the health portion 11B applies the force applied to the waist of the user less than the weight of the waist portion of the user. The user's lumbar spine bending is reduced, and the user's lumbar spine gap is reduced. It is worth to mention that the air adjusting device 121B further controls the speed of adjusting the gas volume of the air receiving chamber portion 1221B. Specifically, the air adjusting device 121B further controls the inflation rate and/or the pumping speed to the air receiving chamber portion 1221B by controlling the charging speed and/or the pumping speed of the air receiving chamber portion 1221B to form the driving rhythm. Further, the air adjusting device 121B further controls the switching speed by converting the gas to the air receiving chamber portion 1221B from the inflation to the pumping speed and/or the conversion speed from the suction to the inflation to control the driving rhythm. Further, the air adjusting device 121B controls the amount of the gas in the air receiving chamber portion 1221B to maintain the supplied driving force.

Figure 12:
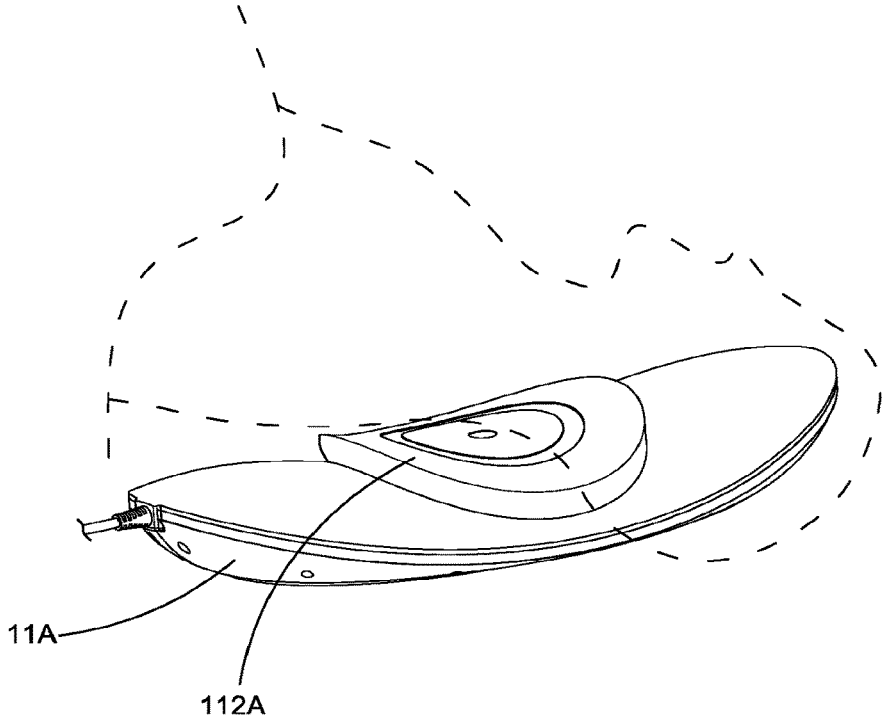
FIG. 12 is a schematic view illustrating another application on the neck of the health-regain device according to the preferred embodiments of the invention.

It is worth to mention that the air adjusting device 121B further provides a gas supplement predetermined value. After the gas volume of the air receiving chamber portion 1221B reaches the gas supplement predetermined value, the air adjusting device 121B inflates gas into the air receiving chamber portion 1221B. The health portion 11B stops moving to the supporter. The health portion 11B moves in a direction against from the supporter when the force of the gas contained in the air receiving chamber portion 1221B is larger than the force applied to the health-regain portion by the user's waist. The user's spinal bending is increased, which is increasing the gap between the two spines. The two adjacent spines are relaxed. When the gas volume of the air receiving chamber portion 1221B reaches the inflated predetermined value, the air adjusting device 121B controls the gas to deflate out of the air receiving chamber portion 1221B. The health portion 11B is suffered by small force of the gas, and the force applied on the user's waist is reduced. The bending of the user's spine is reduced and the gap between the two spines of the user is reduced. The amount of the gas contained in the air receiving chamber portion 1221B is repeatedly adjusted by the air adjusting device 121B, and the health portion 11B reciprocates to adjust the force applied to the user's lumbar spine so that the gap between the lumbar spine of the user has changed continuously. In this way, constantly changing the gap between the two lumbar spines, so that the lumbar spine get exercise, so that the lumbar spine is adapted to the increased gap between the two spines. Furthermore, the user's lumbar muscle is also exercised. It is worth to mention that by adjusting the user's waist under stress to avoid the user's waist for a long time to be in only one state. Such as applying the force for the user's lumbar for a prolonged period of time so that the lumbar spine of the user is maintained to has a larger gap. Long time to keep in the posture as shown in FIG. 12B may cause damage to the lumbar spine. Furthermore, it may also cause damage to the waist muscles.

The health-regain device 10B further comprises a control module 13B. The control module 13B is communicatively connected with the air adjusting device 121B. The control module 13B controls the air adjusting device 121B to adjust the gas volume of the air receiving chamber portion 1221B. The control module 13B controls the air adjusting device 12B to inflate gas into the air receiving chamber portion 1221B at intervals. Furthermore, the control module 13B controls the air adjusting device 12B to inject the gas to the air receiving chamber portion 122 rhythmically. The control module 13B controls the air adjusting device 12 to rhythmically deflate the gas. By controlling the gas volume of the air receiving chamber portion 1221B, the control module 13B controls the force received by the health portion 11B to control the force applied by the health portion 11B to the waist of the user to avoid the user's waist being in one state for a long time. On the other hand, the control module 13B controls the movement height of the health portion 11B by controlling the gas volume of the air receiving chamber portion 1221B. When the force received by the health portion 11B is reduced, the health portion 11B moves to the supporter. When the force applied on the health portion 11B is increased, the health portion 11B moves towards the waist of the user. In this way, the health portion 11B applies force to the waist of the user to change the bending of the user's lumbar spine. Further, the control module 13B is set an exercise range. The exercise range means that the control module 13B controls the air adjusting device 121B so that the force of the user's waist is changed within a certain range for a predetermined period of time, so that the user's lumbar bending varies within a certain range. The user's waist is adapted to the changes in lumbar spine by exercise. At the same time, the user's waist muscles are also exercised within the range of exercise. That is, the control module 13B controls the air adjusting device 121B so that the health portion 11B can provide the force to the user at intervals. Preferably, the control module 13B controls the air adjusting device 121B so that the health portion 11B provides the force on the user in a rhythmic manner.

The health-regain device 10B further comprises at least one detector 14B. The detector 14B is communicatively connected with the control module 13B. The detector 14B further comprises at least one pressure sensor 141B. The pressure sensor 141B is provided in the health portion 11B. The pressure sensor 141B is capable of detecting the pressure applied by the health portion 11B on the waist of the user. The pressure sensor 141B is also capable of detecting the pressure applied by the user on the health-regain device 10B. Preferably, the pressure sensor 141B is provided in the receiving cavity 111B of the health portion 11B. The detector 14B further comprises at least one baroceptor 142B. The baroceptor 142B detects the pressure of the air receiving chamber portion 1221B. The pressure sensor 141B may be provided in the air receiving chamber portion 1221B. Through the baroceptor 142B, the control module 13B obtains the pressure applied by the user's waist to the health portion 11B. The control module 13B obtains the pressure of the gas in the air receiving chamber portion 1221B through the baroceptor 142B. The control module 13B controls the air adjusting device 121B to adjust the gas volume of the air receiving chamber portion 1221B based on the pressure obtained by the user's waist to the health portion 11B and the pressure of the gas in the air receiving chamber portion 1221B, for adjusting the pressure provided by the air receiving chamber portion 1221B.

Figure 17:
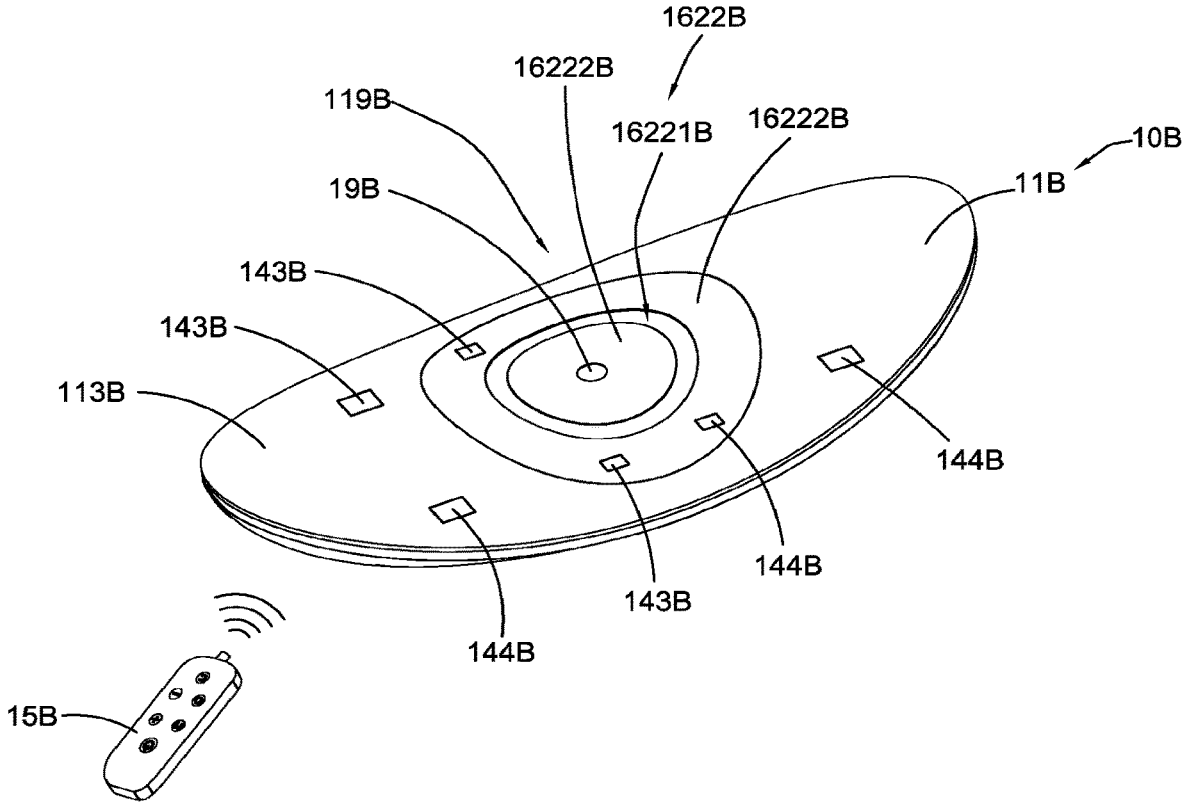
FIG. 17 is a perspective view of the health-regain device according to the preferred embodiment of the present invention, illustrating operation by a terminal.

As shown in FIG. 17, the detector 14B further comprises at least one electromyographic sensor 143B, which is provided in the health portion 11B. In details, the electromyographic sensor 143B is provided on the surface of the health portion 11B. The resilient covering 122B and the electromyographic sensor 143B are provided on two sides of the health portion 11B respectively. The electromyographic sensor 143B obtains the EMG data of the user. In the preferred embodiment, the electromyographic sensor 143B acquires the EMG signal generated by the user's lumbar muscle. In this preferred embodiment, the electromyographic sensor 143B obtains the user's EMG signal in such a manner that the waist skin of the user is in contact with the electromyographic sensor 143B. It is worth to mention that the manner in which the EMG signal is obtained is not limited by the present invention. That is, the manner in which the EMG signal is obtained by contact or non-contact is in the scope of the present invention. The detector 14B further comprises a temperature sensor 144B. The temperature sensor 144B is provided on the surface of the health portion 11B. If the skin of the user's health-regain portion is in contact with the temperature sensor 144B, the temperature sensor 144B obtains the temperature of the skin of the user's health-regain portion.

The electromyographic sensor 143B sends the acquired EMG signal to the control module 13B. The control module 13B obtains the user's lumbar muscle state by analyzing the EMG signal. Further, by analyzing the EMG signal, the control module 13B obtains the lumbar state of the user. The control module 13B controls the air adjusting device 121B to adjust the gas volume of the air receiving chamber portion 121B according to the lumbar state, in order to control the force applied by the health portion 11B on the waist of the user. In this way, the control module 13B adjusts the gas volume in the air receiving cavity by the air adjusting device 121B according to the lumbar state and/or the waist state of the user for controlling the amount of the gas applied to the user force. In this way, the waist state and/or the lumbar state of the user is in real-time detection in order to obtain a better effect when using the health-regain device 10 for health-regain.

Figure 18:
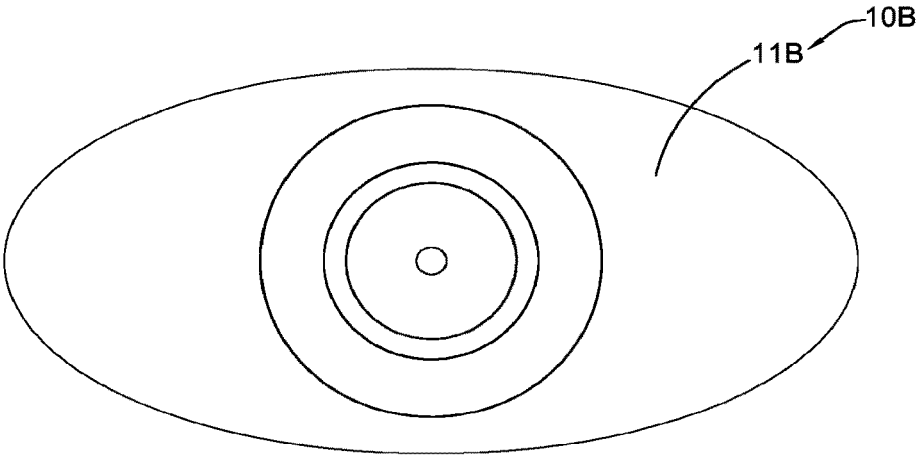
FIG. 18 is a top view of the health-regain device according to the preferred embodiment of the present invention.

As shown in FIG. 18, the health-regain device 10B further comprises at least one health-regain environmental former 16B. The health-regain environmental former 16B forms the health-regain environment 119B. Preferably, the health-regain environmental former 16B is provided in the middle of the health portion 11B. The health-regain environmental former 16B forms a thermal environment by controlling to provide thermal energy. That is, the health-regain environmental former 16B controls the temperature of the thermal environment by controlling the provision of thermal energy. The control module 13B is communicatively connected with the health-regain environmental former 16B. That is, the control module 13B adjusts the temperature of the health-regain environment 119B through the health-regain environmental former 16B. In particular, the health-regain environmental former 16B further comprises at least one heat source device 161B. The heat source device 161B generates thermal energy. The control module 13B is communicatively connected with the heat source device 161B. That is, the control module 13B controls the temperature of the health-regain environment 119B by controlling the heat source device 161B. The control module 13B controls the heat source device 161B to provide heat before the health-regain device 10B is used for bending. On the one hand, the temperature of the health-regain environment 119B is changed to facilitate health. On the other hand, the feeling of discomfort caused by the health-regain portion of the user and the health portion 11B is eliminated, and the user's experience is improved. Furthermore, adjusting the temperature of the health-regain environment 119B is advantageous in shortening the time required for the preparation of the waist muscles, and for improving the efficiency of the user's bending. Furthermore, during the bending health-regain, it is advantageous to keep the health-regain environment 119B at a certain temperature. Such as promoting the blood circulation of the waist. Preferably, the heat source device 161B is implemented as the heat source device 161B, such as a heating film or a heating wire.

The health-regain environmental former 16B further comprises at least one light source device 162B. The light source device 162B is communicatively connected with the control module 13B. The control module 13B controls the light source device 162B to emit light to form a luminous environment. That is, the light intensity of the luminous environment of the health-regain environment is controlled by the control module 13B. If the health-regain portion of the user is in the health-regain environment 119B, the luminous environment of the health-regain environment 119B acts on the skin of the health-regain portion of the user to carry out the lightness of the skin of the user's health-regain portion. What is to say that the light generated by the light source device 162B acts on the skin of the health-regain portion of the user to carry out the light health of the skin of the user's health-regain portion. Furthermore, the light source device 162B further comprises at least one light source 1621B and at least one nonopaque device 1622B. The nonopaque device 1622B is covered on the light source 1621B. The light generated by the light source 1621B is irradiated through the nonopaque device 1622B to form the luminous environment. It is worth to mention that the nonopaque device 1622B is further provided with a high transmittance color conversion layer to provide the nonopaque device 1622B as necessary to obtain the desired color light. Such as absorption of blue light or green light as required, only allow red light through. The nonopaque device 1622B may further deals with the transmitted light so that the transmitted light can illuminate a larger range. The nonopaque device 1622B provides a light transmission process. Preferably, the heat source device 161B is provided between the light source 1621B and the nonopaque device 1622B. Specifically, the heat source device 161B is provided between each of the light source 1621B and the nonopaque device 1622B. The nonopaque device 1622B is provided at the top of the health-regain environmental former 16B. The health-regain portion of the user can be brought into contact with the nonopaque device 1622B. The heat source device 1611B is fixedly disposed below the nonopaque device 1622B. Each of the light source devices 1621B is provided below the heat source device 1611B. It is worth to mention that the heat source device 1611B is provided in a predetermined shape so that the light generated by the light source 1621B passes through the nonopaque device 1622B and is presented in a predetermined shape. It is worth to mention that the heat source device 161B may be replaced by a heating wire. It is worth to mention that the control module 13B controls the heat source device 161B and the light source 1621B respectively, so that the light source 1621B serves as an additional heat source for forming the thermal environment.

FIG. 16A shows a sectional view in FIG. 18 along the A-A line. As shown in FIG. 16A, both ends of the health portion 11B are gradually lowered toward the middle of the health portion 11B in the A-A direction to form a limiting portion 118B in the middle of the health portion 11B. That is, the health portion 11B further includes a limiting portion 118B. Preferably, the limiting portion 118B is provided at the top of the health-regain environmental former 16B. When the user's waist is placed on the limiting portion 118B, the user's waist is restricted from moving horizontally. In such a manner, when the user in the bending health-regain, the user's waist is prevented from moving horizontally for facilitating the maintenance of the waist of the user at the limiting portion 118.

FIG. 16B shows a cross sectional view of the health-regain device 10B shown in FIG. 18 along the B-B line. As shown in FIG. 16B, in the B-B direction, the middle portion of the health portion 11B gradually decreases towards both sides of the health portion 11B to form a curved surface. After the health-regain portion of the user is in contact with the health portion 11B, the curved surface is adapted to the curve of the health-regain portion of the user. Preferably, the curved surface is adapted to the physiological curve of the waist of the user in the B-B direction. It is worth to mention that the top of the health-regain environmental former 16B is lowered from the middle to the sides in the B-B direction. In such a manner that the health-regain device 10B is in use, the user's health site may be attached to the surface. Preferably, the user's waist curve and/or the user's neck curve are suitable.

Figure 25:
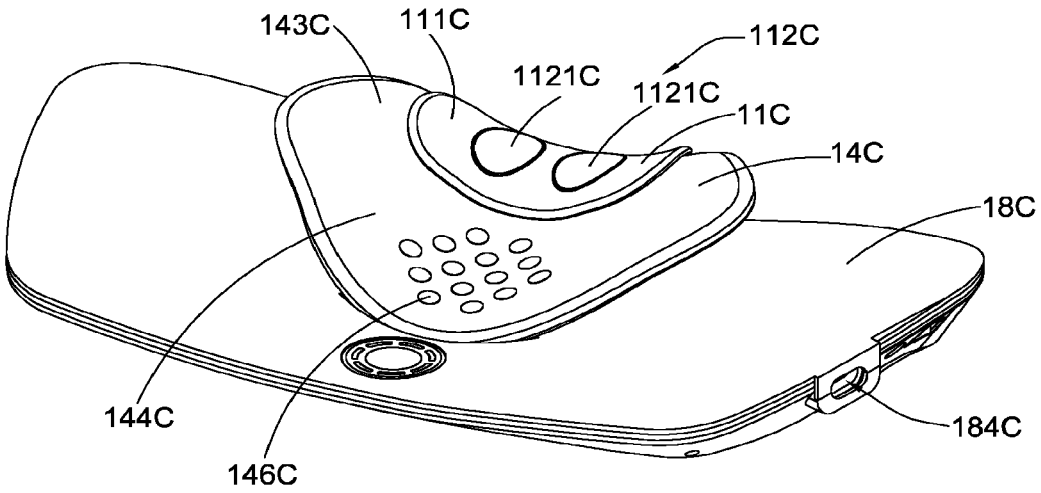
FIG. 25 is a perspective view of the health-regain device according to another preferred embodiment of the present invention.
Figure 26:
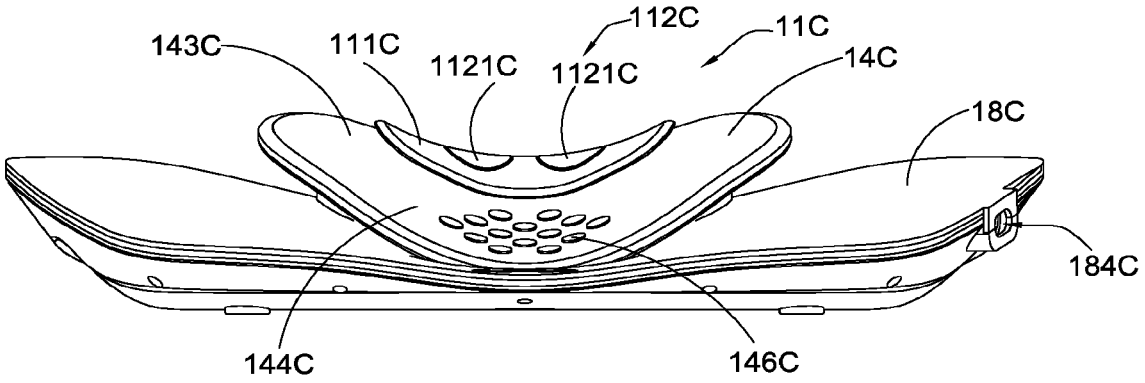
FIG. 26 to FIG. 29 are illustrated the work states of the health-regain device according to the above preferred embodiment of the present invention.
Figure 27:
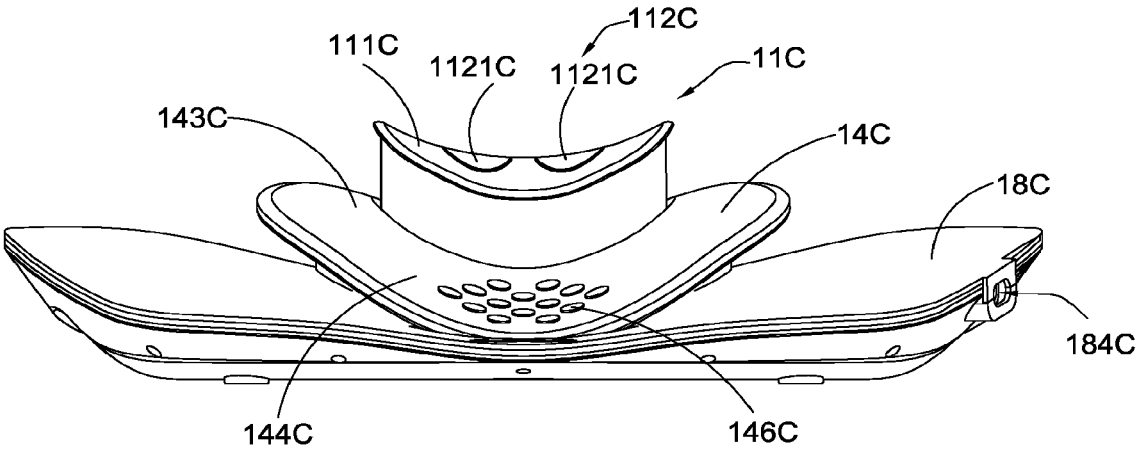

The health-regain device 10B further comprises at least one massage device 17B. The massage device 17B is communicatively connected with the control module 13B. The control module 13B controls the massage device 17B to provide a massage environment. In other words, the health-regain environment further provides a massage environment. The massage device 17B is provided in the health-regain device 10B. The massage device 17B provides a massage in a vibrating manner. That is, the control module 13B provides massage for the health-regain environment 119B by controlling the massage device 17B. It is worth to mention that the control module 13B controls of the massage device 17B before providing the massage to reduce the adaptation time on the health-regain portion of the user before the bending health-regain. Further, when in the bending health-regain in the health-regain portion of the user, the massage device 17B is provided with a massage at the same time so that the health-regain environment 119B is accompanied by a massage when the bending health-regain. Preferably, the massage device 17B is implemented as the vibration motor. The massage device 17B is provided in the receiving cavity 111B. The health-regain device 10B further provides at least one magnetic element 19B. The magnetic element 19B provides a magnetic health-regain environment. The magnetic element 19B is provided in the health-regain device 10B. That is, the health-regain environment 119B further provides a magnetic environment and the magnetic environment is to provide magnetic health-regain. In the bending health-regain of the user, the bending health-regain and the magnetic health-regain can be carried out in the magnetic environment at the same time. Preferably, the magnetic element 19B is provided in the middle of the surface of the health-regain environmental former 16B. As shown in FIG. 18, in details, the magnetic element 19B is provided in the middle of the surface of the nonopaque device 1622B. The health-regain device 10B further comprises at least one power supply device 18B. The power supply device 18B is electrically connected to the driving portion 12B, the control module 13B, the detector 14B, the health-regain environmental former 16B, and the massage module 17B respectively. The power supply device 18B can provide power supply. Preferably, the power supply device 18B is implemented as a power source or as a battery. The power supply device 18B is provided in the receiving cavity 111B. As shown in FIG. 25, the health-regain device 10B further includes at least one controller 15B. The controller 15B is communicatively connected with the control module 13B. The user controls the health-regain device 10B through the controller 15B. The controller 15B may communicate with the control module 13B in a wireless manner or in a wired manner.

Figure 19:
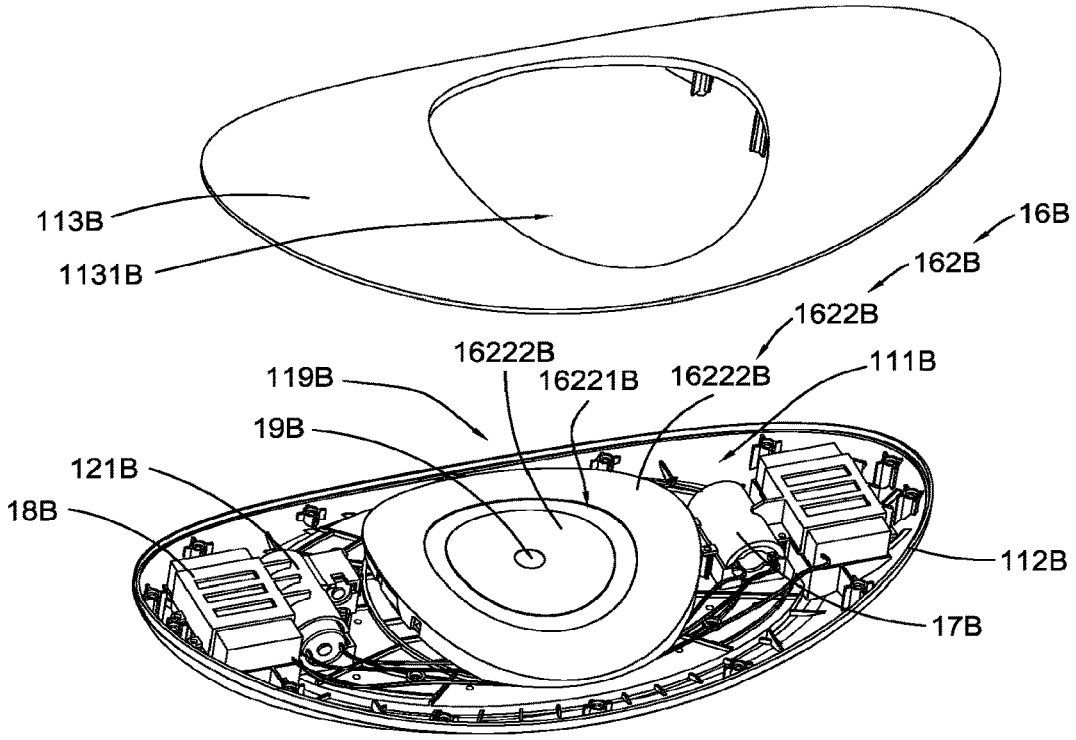
FIG. 19 is a perspective view of the health-regain device according to the preferred embodiment of the present invention, illustrating the top cap is opened.

As shown in FIG. 19, the health portion 11B further includes a receiving shell 112B and a top cap 113B. The edge of the receiving shell 112B is connected to the edge of the top cap 113B to form the receiving cavity 111B inside the receiving shell 112B and the top cap 113B. It is preferable that the edge of the receiving shell 112B is fitted to the edge of the cap 113B. The power supply device 18B, the control module 13B, the air adjusting device 121B, and the massage device 17B are fixedly disposed in the receiving shell 112B. Preferably, the health-regain environmental former 16B is provided in the middle of the receiving shell 112B. The top cap 113B further has a health-regain environment forming hole 1131B. The health-regain environmental forming hole 1131B is provided in the middle of the top cap 113B. After the edge of the top cap 113B is fitted to the edge of the receiving shell 112B, the health-regain environmental former 16B is fitted into the health-regain environmental forming hole 1131B. In this way, the health-regain environment 119B formed by the health-regain environmental former 16B can be extended to the surface of the top cap 113B. Preferably, after the health-regain environmental former 16B is embedded in the health-regain environmental forming hole 1131B, the surface of the top cap 113B is located on the same curved surface as the top surface of the health-regain environmental former 16B. Preferably, the hole 113B is provided on one side of the health-regain environmental former 16B. The air adjusting device 121B is provided on the same side as the hole 113B. The massage device 17B and the air adjusting device 121B are provided on both sides of the health-regain environmental former 16B respectively.

It is worth to mention that the nonopaque device 1622B further has at least one interval slot 16221B. The at least one interval slot 16221B divides the nonopaque device 1622B into two sub-nonopaque devices 16222B. That is, the nonopaque device 1622B further includes at least two sub-nonopaque devices 16222B, wherein the at least one interval slot 16221B is disposed between the two sub-nonopaque device 16222B. That is, the at least one interval slot 16221B is provided between two adjacent sub-nonopaque devices 16222B. At least one of the light source 1621B is provided correspondingly below the two sub-nonopaque devices 16222B. The light source rhythm of the light source 1621B corresponding to each of the sub-nonopaque devices 16222B is controlled by the control module 13B to display the predetermined information by each of the sub-nonopaque devices 16222B. The predetermined information may be used to prompt the user to use the health-regain device 10B for health. It is worth to mention that the nonopaque device 1622B has more sub-light-transmitting portion that the amount of information that the nonopaque device 1622B can display is more.

It is worth to mention that the pressure sensor 141B, which may be provided on the surface of the top cap 113B and/or the surface of the health-regain environment former. Preferably, the electromyographic sensor 143B may be provided in the interval slot 16221B. When the user is using the health-regain device 10B, the skin of the user's health-regain portion can be contact with the EMG sensor to obtain the user's EMG signal of the health-regain device. The pressure sensor 141B may also be provided in the interval slot 16221B. When the user is using the health-regain device 10B, the pressure sensor 141B detects pressure data and transfers the pressure data collected by the pressure sensor 141B to the control module 13B.

And the user's waist is used as an example in the embodiment. The user is using the health-regain device 10B in a lying manner. After the health-regain device 10B is placed under the user's waist, the user's waist contacts the health-regain device 10B. The health-regain device 10B is under the pressure of the user. The pressure sensor 141B detects the pressure applied by the user to the health-regain device 10B. The temperature sensor 144B detects the temperature of the user. The control module 13B receives the pressure information provided by the pressure sensor 141B and the temperature information provided by the temperature sensor 144B respectively. The control module 13B controls the health-regain device 10B to be activated based on the received pressure information and the temperature information. In particular, the control module 13B analyzes the temperature information. If the temperature information reaches the predetermined temperature value, the control module 13B controls the air adjusting device 121B to adjust the amount of the gas contained in the air receiving chamber portion 1221B so that the air receiving chamber portion 121B provides the driving force, so that the health portion 11B is lifted. The health portion 11B applies a driving force to the waist of the user to drive the user's waist to move in the direction in which the health portion 11B moves. It is worth to mention that the electromyographic sensor 143B provides the EMG signal to the control module 13B. The control module 13B judges the user's waist state based on the EMG signal. The control module 13B can further determine the lumbar state of the user based on the EMG signal. The control module 13B controls the air adjusting device 121B to adjust the amount of the gas contained in the air receiving chamber portion 1221B according to the waist state. In details, if the control module 13B judges that the user's waist is unfolded based on the EMG signal, the control module 13B controls the air adjusting device 121B to stop inflating the gas to the air receiving chamber portion 1221B. The control module 13B further controls the air adjusting device 121B to deflate the gas from the air receiving chamber portion 1221B to reduce the amount of the gas in the air receiving chamber portion 1221B for reducing the driving force provided by the gas receiving chamber portion 1221B to the health portion 11B. The health portion 11B moves downward. The user's waist is moved downward. The health portion 11B moves downward to enable the user's lumbar spine to return to the physiological curve of the lumbar spine. The electromyographic sensor 143B continuously supplies the EMG signal to the control module 13B. The control module 13B judges whether or not the air adjusting device 121B stops the deflation of the gas from the air receiving chamber portion 1221B by analyzing the EMG information. After the control module 13B controls the air adjusting device 121B to stop the gas from the air receiving chamber portion 1221B, the control module 13B controls the air adjusting device 121B to supply the gas to the air receiving chamber portion 1221B. The gas storage portion 1221B supplies a driving force to the health portion 11B to drive the health portion 11B to lift. The user's waist is moved upward, and the user's lumbar bending is increased. If the control module 13B analyzes the electromyogram obtained from the electromyographic sensor 143B and stops supplying the gas to the air receiving portion, the control module 13B controls the air adjusting device 121B to stop supplying the air receiving chamber portion 1221B gas. The control module 13B controls the air adjusting device 121B to extract the gas from the air receiving chamber portion 1221B. The health portion 11B is moved downward, and the bending of the user's lumbar vertebra is reduced. The control module 13B continuously controls the lumbar spine of the user by controlling the gas supply and the deflation gas to continuously adjust the lumbar bending of the user by controlling the air adjusting device 121B. It is worth to mention that the control module 13B can judge from the pressure information acquired by the pressure sensor 141B and the air baroceptor 142B respectively, to determine the operation of controlling the air adjusting device 121B. The operation of the control module 13B to control the air adjusting device 121B includes stopping the supply of gas, stopping the deflation of the gas, the inflate gas and the deflation gas. The control module 13B can be combined with the temperature information acquired from the temperature sensor 144B, the pressure information obtained from the pressure sensor 141B, and the EMG signal obtained from the baroceptor 142B and the EMG signal obtained from the EMG signal sensor judgment.

It is worth to mention that the control module 13 may control the light source device 162B to illuminate the user's waist during the user's bending health-regain to provide light health-regain to the user's waist. Such as beauty. The control module 13 may also control the temperature adjustment of the heat source device 161B so that the user's lumbar muscle is suitable for bending.

In another preferred embodiment, the control module 13B analyzes the temperature information provided from the temperature sensor 144B. If the control module 13B judges that the current temperature is unsuitable for bending, the control module 13B controls the heat source device 161B to adjust the temperature. For example, the control module 13B controls the heat source device 161B to raise the temperature to be suitable for bending. It is worth to mention that the control module 13B acquires the light provided by the light source device 162B to provide heat. The control module 13B controls the light source device 162B to emit light to provide heat by light for accelerating the temperature lift to achieve a temperature condition suitable for bending. The control module 13B continuously analyzes the temperature information provided by the temperature sensor 144B. The control module 144B controls the air adjusting device 121B to inflate gas to the air receiving chamber portion 1221 to start the bending health-regain process by analyzing the temperature information provided by the temperature sensor 144B to obtain the current temperature suitable for bending health healthy. The control module 144B controls the light source device 162B to provide a light lake.

Figure 20:
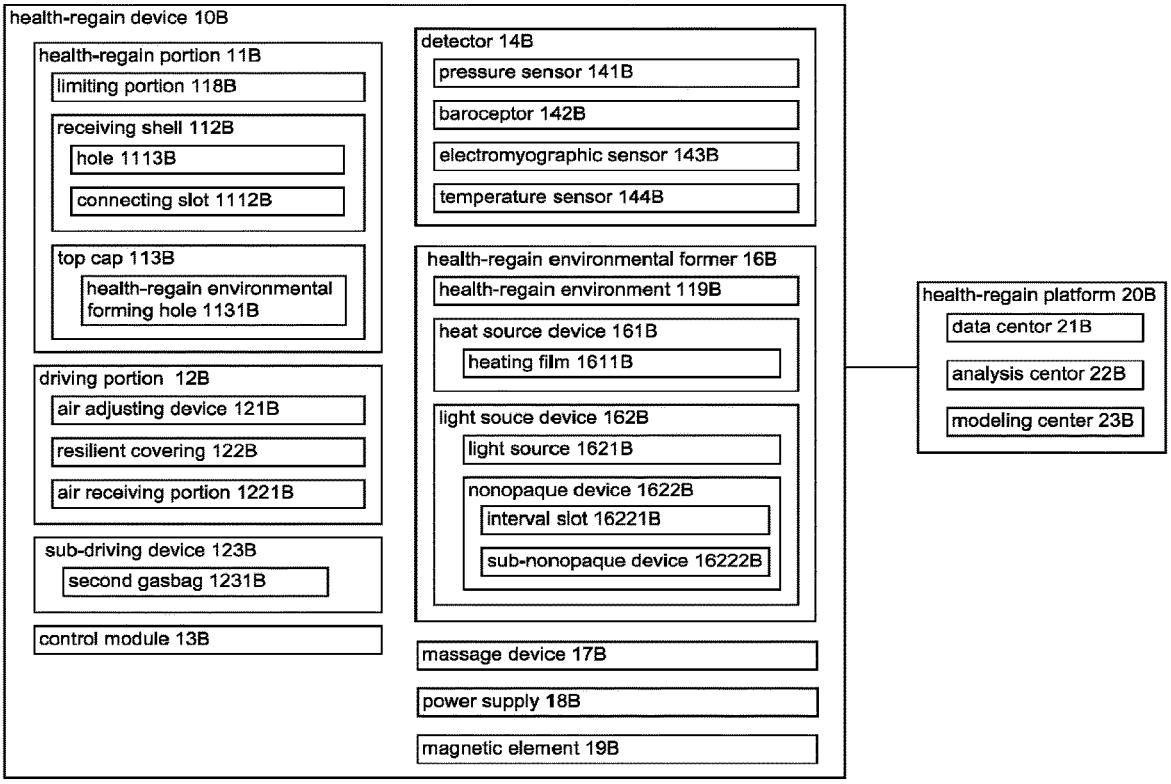
FIG. 20 is a block diagram of the health-regain system according to the preferred embodiment of the present invention.
Figure 21A:
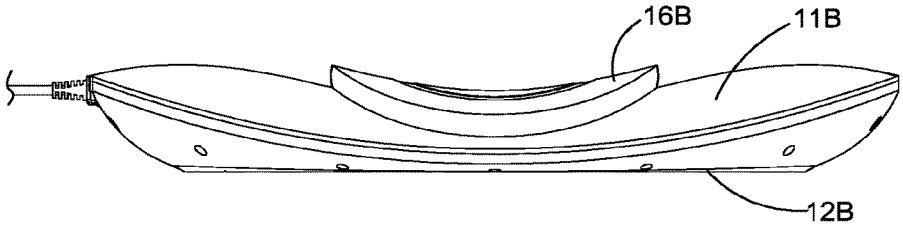
FIGS. 21A and 21B are perspective views of the health-regain device according to the preferred embodiment of the present invention, illustrating the health-regain device environmental former is movable.
Figure 21B:
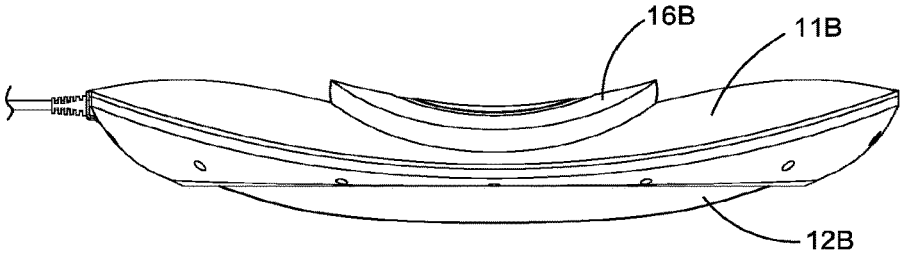
Figure 21C:
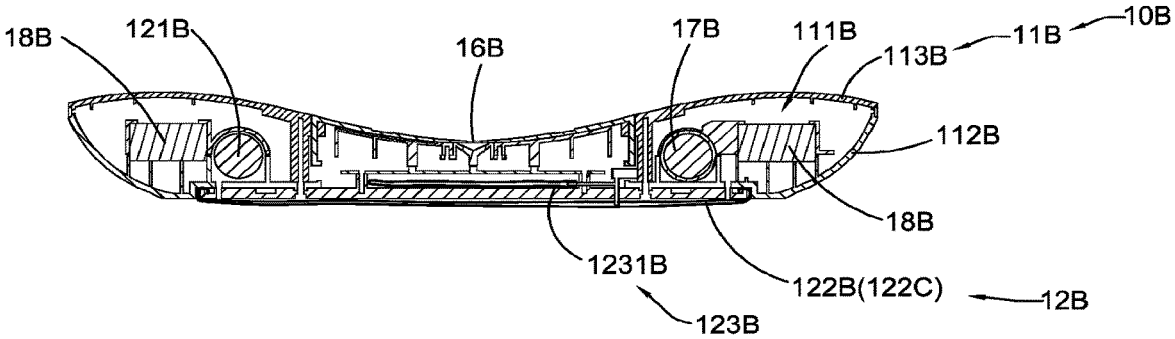
FIGS. 21C and 21D are sectional views of the health-regain device according to the preferred embodiment of the present invention, illustrating the health-regain device environmental former is moved by the sub-driving device.
Figure 21D:
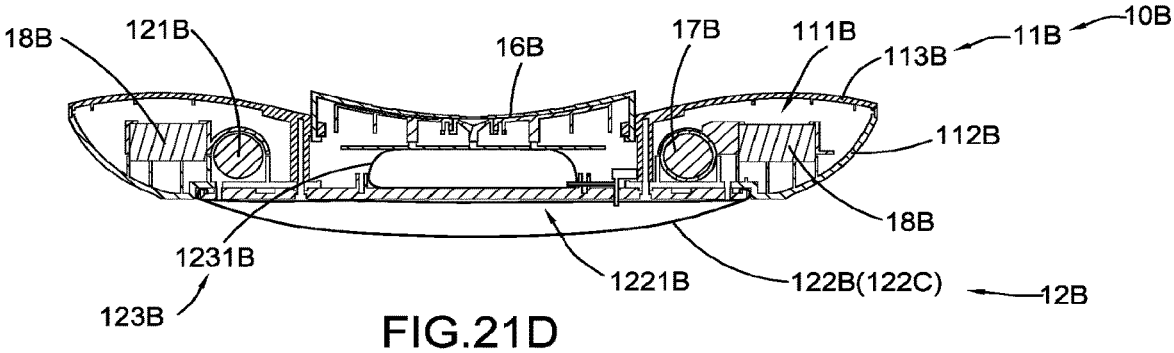

As shown in FIG. 20, the health-regain system of the present invention further comprises a health-regain platform 20B that is communicatively connected with the health-regain device 10B. The health-regain device 10B provides the user's health data to the health-regain platform 20B. After the health-regain platform 20B analyzes the health information of the user, the health-regain platform 20B provides a health-regain plan. The adjustment strategy is sent by the health-regain platform 20B to the health-regain device 10B, which carries out the health-regain plan to adjust the health-regain device 10B to enable the health-regain device 10B to be healthy for the user. In particular, the control module 13B of the health-regain device 10B is communicatively connected with the health-regain platform 20B. The control module 13B provides the user's health information to the health-regain platform 20B. Such as the driving force, the temperature, the light intensity, the range of lumbar pedaling of the user, and the like provided by the user when the user is using the health-regain device 10B.

The health-regain platform 20B further comprises a data center 21B and an analysis center 22B. The data center 21B is communicatively connected with the analysis center 22B. The data center 21B analyzes the storage of at least one of the health data provided by the health-regain device 10B. The health data refers to the data of the control module 13B of the health-regain device 10B during using the health-regain device 10B, and in particular, the data of bending health-regain. For example, as the user in the bending health-regain, the speed of the air adjusting device 121B inflates the gas to the air receiving chamber portion 1221 and deflates the gas of the air receiving chamber portion 1221, the temperature changed when the user is in the bending health-regain, the light intensity provided by the light source device 162, and so on. The analysis center 22B obtains the user's health data from the data center 21B. The analysis center 22B analyzes the user's health data to provide a health-regain plan. The analysis center 22B transmits the health-regain plan to the control module 13B of the health-regain device 10B, which controls the air adjusting device 121B according to the health-regain plan, and the heat source device 161B cooperates with the light source device 162B. The heat source device 161B cooperates with the light source device 162B through the air adjusting device 121B, which provides a health-regain environment suitable for the user. The data center 21B may be implemented as at least one storage module or storage device. The analysis center 22B may be implemented as at least one server.

The health-regain platform 20B further includes a modeling center 23B that is communicatively connected with the analysis center 22B and the data center 21B respectively. The modeling center 23B provides a body model for the user. Preferably, the model is a stereoscopic model. Preferably, the model is the patient's spine model. In particular, the modeling center 23B receives the modeling information provided by the user. The user can provide modeling information to the modeling center 23B by X-ray, B-scan ultrasonography, CT (Computed Tomography), and nuclear magnetic resonance. Such as the user can provide modeling information by scanning the X-ray. The modeling center 23B may also obtain modeling information directly from the X-ray machine. Preferably, the modeling center 23B obtains the modeling information by communicating the X-ray machine in communication. The modeling center 23B acquires the modeling information by communicating the B-agent directly. The modeling center 23B acquires the modeling information by communicating the CT detection device. The modeling center 23B acquires the modeling information by communicating the magnetic resonance device. The modeling center 23B establishes the spinal model of the user based on the acquired modeling information. Preferably, the modeling center 23B establishes the user's three-dimensional spine model based on the acquired modeling information.

The user's spine model is stored in the data center 21B. It is worth to mention that the modeling center 23 provides a communication connection to the display device for displaying a spine model. It is worth to mention that the modeling center 23B provides a communicatively connected intelligent device. That is, the intelligent device is communicably connected to the modeling center 23B. The intelligent devices include smartphones, computers, laptops, smart glasses, and so on. For example, the modeling center 23B is accessed through the smartphone, which is displayed on the smartphone. Professionals, such as doctors and professors, advise the user on the basis of the user's spine. The analysis center is further based on the user's spine model and health data for analysis to provide the health-regain plan. The health-regain device is doing health-regain according to the health-regain plan to improve the health effect.

Furthermore, the control module 13B of the health-regain device 10B is communicatively connected with the modeling center 23B. The control module 13B receives the health-regain plan issued by the data center 23B when the user is using the health-regain device 10B for health-regain. The control module 13B controls the air adjusting device 121B according to the health-regain plan, and the heat source device 161B cooperates with the light source device 162B. By the air adjusting device 121B, the heat source device 161B and the light source device 162B cooperate to form the health-regain environment. Further, the control module 13B transfers the pressure information, the air pressure information, the EMG information, and the temperature information to the modeling center 23B respectively, while the health-regain device 10B is in use. The pressure information is provided by the pressure sensor. The barometric pressure information is provided by the barometric pressure sensor. The EMG signal is provided by the EMG sensor. The temperature information is provided by the temperature sensor. The pressure center 23B analyzes the pressure information, the air pressure information, the EMG information, and the temperature information to send the pressure information, the air pressure information, the EMG information, and the temperature information. The effect of the spine on the user during use is reflected in the user's spine model. That is, the modeling center 23B reflects the effect of the spine of the user on the spine model during use, so that the professionals understand the user's spine state and/or the health-regain device 10B use. That is, the modeling center 13B dynamically displays the user's use of the health-regain device 10B. It is worth to mention that during the use of the health-regain device 10B, the professionals can access the modeling center 23B through a smart device. The professional person checks the use of the health-regain device 10B by the intelligent device. Preferably, the professional can view in real time the situation where the user is using the health-regain device 10B. Further, through the intelligent device, the professional can adjust the health-regain device 10B. In particular, the specialist adjusts the spinal curve in the user's spine model by the intelligent device. The modeling center 23B sends the adjusted spinal curve to the analysis center 22B. The analysis center 22B analyzes the adjusted spine curve, obtains pressure information, temperature information and pressure information. The analysis center 22B provides an adjustment plan based on the obtained pressure information, the temperature information, and the pressure information. The analysis center 22B sends the adjustment plan to the control module 13B. The control module 13B controls the air adjusting device 121B according to the adjustment plan, and the heat source device 161B cooperates with the light source device 162B. In this way, the professional instructs the user to use the health-regain device 10B. It is worth to mention that the professional can access the modeling center 23B through a plurality of intelligent devices respectively, to view the situation where the plurality of users use the health-regain device 10B respectively, so that the plurality of users use the health-regain device 10B monitor the state. Preferably, the practitioner can check the use of the health-regain device 10B in real time. It is worth to mention that the professional also adjusts the health-regain device 10B by setting pressure information, temperature information, pressure information, light intensity, vibration information, or body information of the user. The analysis center 23B generates the adjustment plan based on the pressure information, the temperature information, the pressure information, the light intensity, or the user's body information. The control module 13B controls the air adjusting device 121B, the heat source device 161B, the light source device 162B, and/or the massage module 17B respectively in accordance with the adjustment plan. It is worth to mention that the analysis center 13 further generates a reminder plan to alert the user to the use of the health-regain device 10B. The analysis center 13 sends the reminder plan to the control module 13B. The control module 13B controls the light source device 162B to emit light according to the predetermined rhythm according to the reminder plan to remind the user to use the health-regain device 10B.

As shown in FIGS. 21A to 21D, the health-regain environmental former 16B is movably provided in the health portion 11B. The health-regain device 10B further includes a sub-driving device 123B which is provided between the bottom outside of the health-regain environmental former 16B and the inside of the bottom of the health portion 11B. In the embodiments, the sub-driving device 123B is pneumatically driven to move the health-regain environmental former 16B. The sub-driving device 123B is implemented as a second gasbag 1231B. The second gasbag 1231B is provided between the bottom outer side of the health-regain environmental former 16B and the inside of the bottom of the health portion 11B. The second gasbag 1231B communicates with the air adjusting device 121B. The air adjusting device 121B is capable of adjusting the amount of the gas of the second gasbag 1231B. Specifically, the air adjusting device 121B supplies the second gasbag 1231B with the gas so that the second gasbag 1231B provides a driving force to the health-regain environmental former 16B to drive the health-regain environmental former 16B away from the bottom of the health portion 11B moved. The air adjusting device 121B deflates the gas in the second gasbag so that the driving force provided by the second gasbag to the health-regain environmental former 16B is reduced, so that the health-regain environmental former 16B moves to the bottom of the health portion 11B. It is worth to mention that the control module 13B controls the air adjusting device 121B to adjust the amount of the gas of the second gasbag to adjust the driving force provided by the health-regain environmental former 16B by adjusting the amount of the gas of the second gasbag 1231B. That is, the air adjusting device 121B can also control the amount of the gas of the second gasbag by the control module 13B in the health-regain plan generated by the analysis center 22B. In this manner, the adjustment range and the adjustment speed of the driving force provided by the health-regain device 10B are provided. The control module 13B can control the air adjusting device 121B while simultaneously adjusting the amount of the gas of the air receiving chamber portion 1221B and the amount of the gas of the second gasbag 1231B. It is worth to mention that at least one stopper 169B is provided on the inside of the bottom portion of the health portion 11B. The stopper 169B prevents the outside of the bottom of the health-regain environmental former 16B from coming into contact with the inside of the bottom of the health portion 11B. Further, a holding space 1691B is formed between the bottom outer side of the health-regain environmental former 16B and the outside of the bottom of the health portion 11B for placing the second gasbag 1231B.

Figure 22A:
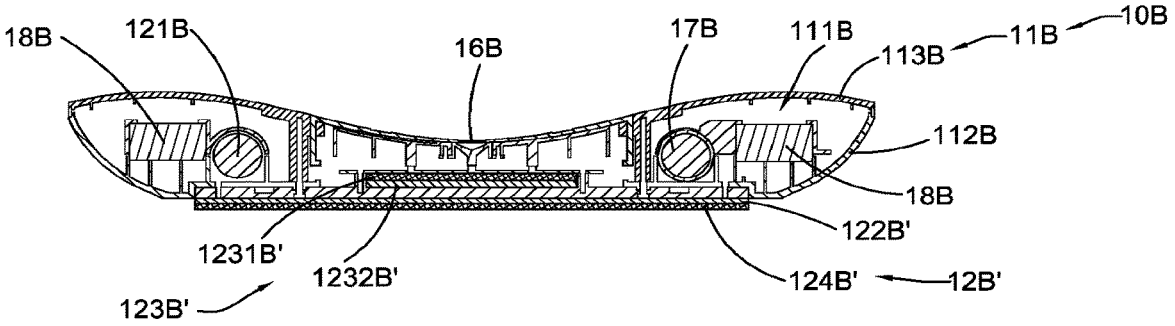
FIGS. 22A and 22B are sectional views of the health-regain device according to the preferred embodiment of the present invention, illustrating an alternative mode of the driving device.
Figure 22B:
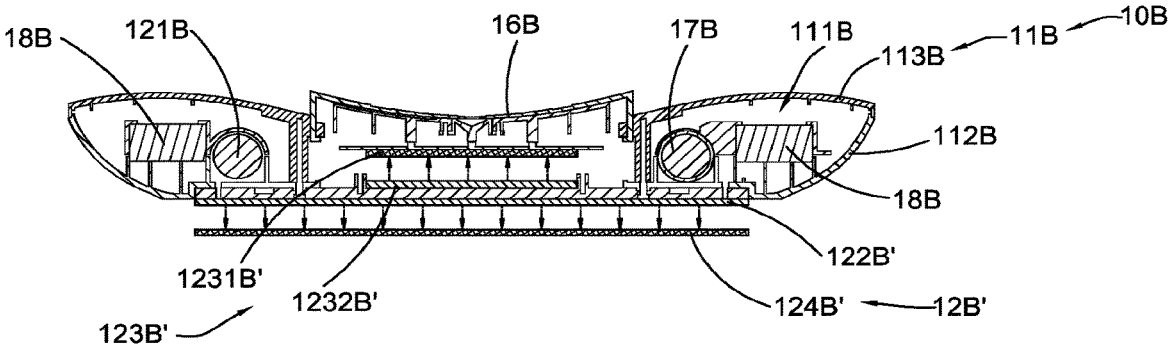

FIGS. 22A and 22B show an alternative embodiment of the driving device 12B the health-regain device of the present invention. The driving device 12B' drives the health portion 11B in an electromagnetic manner. In particular, the driving device 12B' further comprises an electromagnet element 122B' and a permanent magnet element 124B. The electromagnet element 122B' is electrically connected to the power supply device 18B. The electromagnet element 122B' is provided at the bottom of the health portion 11B. The permanent magnet element 123B' has permanent magnetism. Preferably, the electromagnet member 122B' is provided outside the bottom of the health portion 11B. The permanent magnet element 123' is attached to the electromagnet element 122B. The power supply device 18B supplies electric energy to the electromagnet element so that a repulsive force is generated between the electromagnet element 122B' and the permanent magnet element 124B' so that the electromagnet element 122B' is moved away from the direction of the permanent magnet element 124B mobile. The control module 13B is communicatively connected with the power supply device 18B. The control module 13B controls the power supply device 18B to supply electric power to the electromagnet element 122B' to control the magnitude of the repulsive force produced by the electromagnet element 122B' and the permanent magnet element 124B' so as to control the driving force provided by the driving device 12B' of the health-regain device 10B. It is worth to mention that the control module 13B can control the power supply device 18B to supply power to the electromagnet element 122B' according to the health-regain plan. That is, the control module 13B can control the driving device 12B' to work together. The control module 13B controls the driving portion 12B' to drive the health portion 11B at intervals. Preferably, the control module 13B controls the driving portion 12B' to rhythmically drive the health portion 11B.

Figure 24A:
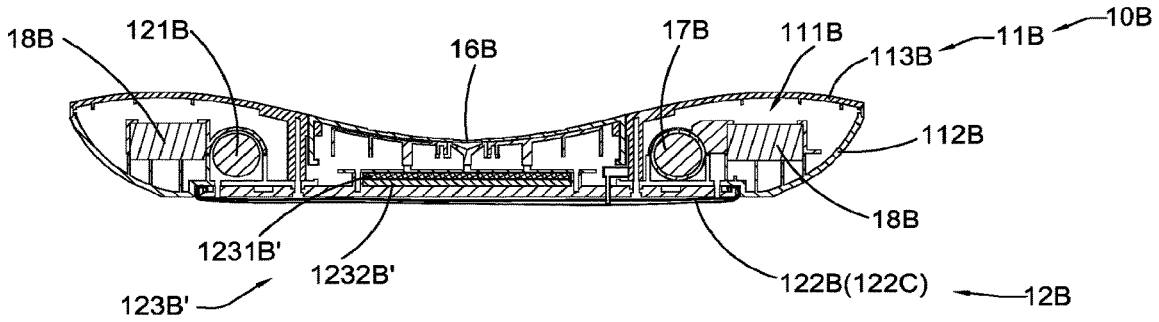
FIGS. 24A and 24B are sectional views of the health-regain device according to the preferred embodiment of the present invention, illustrating an alternative mode of the driving device.
Figure 24B:
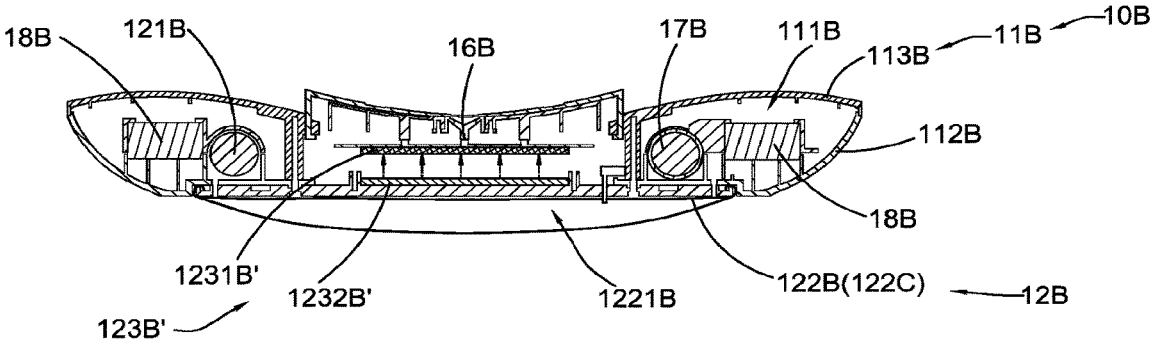
Figure 28:
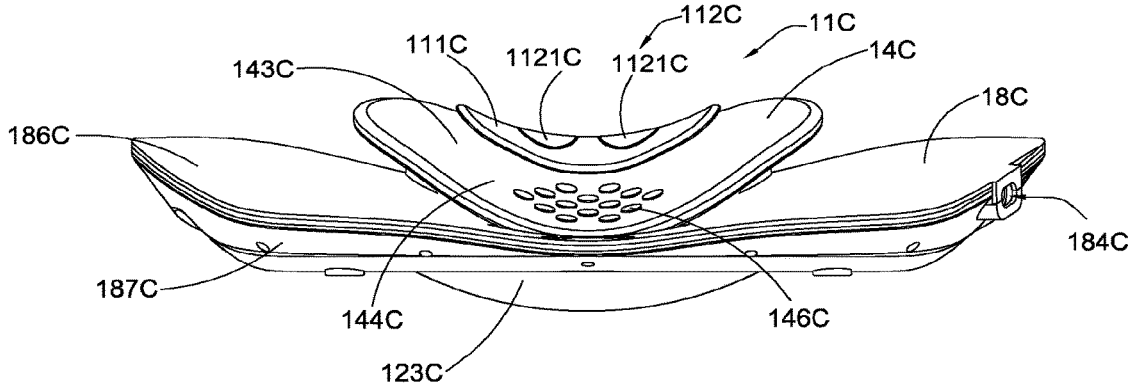
Figure 29:
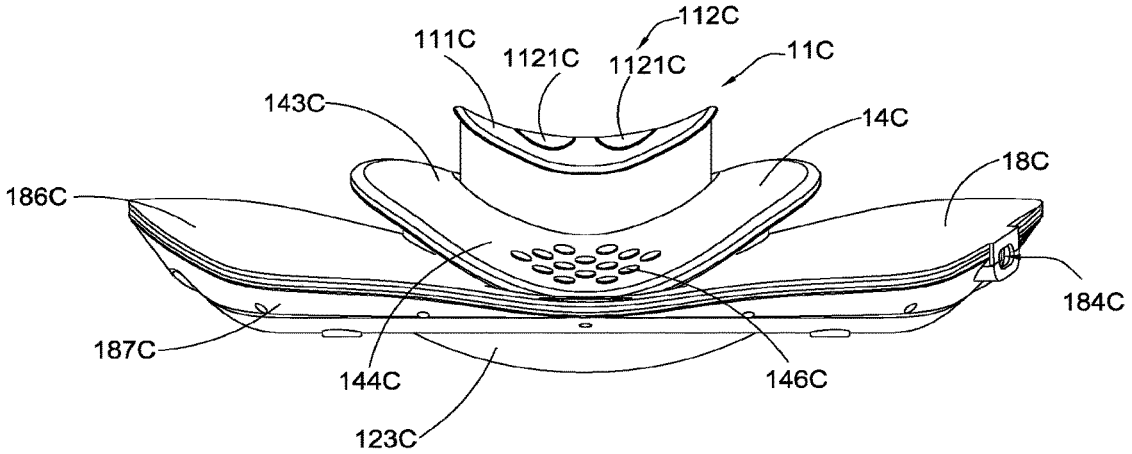
Figure 30:
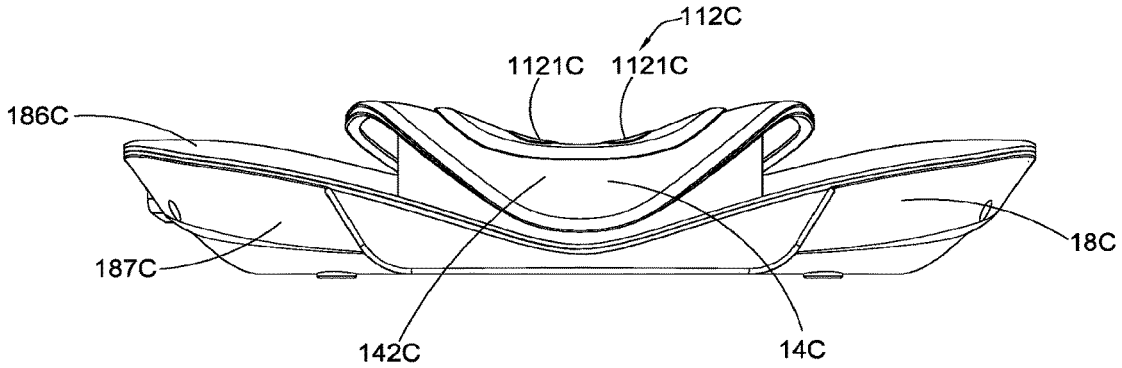
FIG. 30 is a back view of the health-regain device according to the above preferred embodiment of the present invention.
Figure 31:
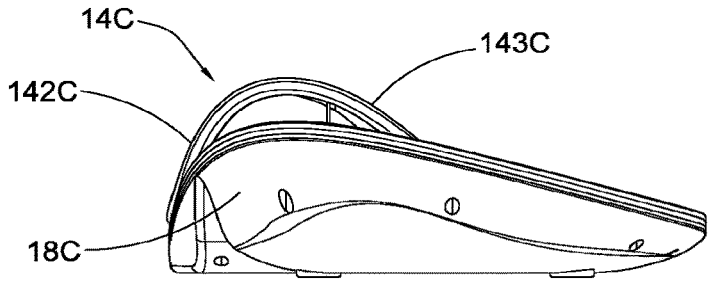
FIG. 31 is a side view of the health-regain device according to the above preferred embodiment of the present invention.

As shown in FIG. 24A and FIG. 28B, in a preferred embodiment of the health-regain device of the present invention, the sub-driving device 123B' is implemented in an electromagnetic manner. The sub-driving device 123B' further includes an electromagnet driving element 1231B' and a permanent magnet driving element 1232B. The electromagnet driving element 1231B' is provided at the bottom of the health-regain environmental former 16B. Preferably, the electromagnet driving element 1231B' is provided outside the bottom of the health-regain environmental former 16B. It is worth to mention that the electromagnet driving element 1231B' may be provided as the bottom of the health-regain environmental former 16B. The permanent magnet driving element 1232B' is attached to the electromagnet driving element 1231B'. The power supply module 18B supplies power to the electromagnet driving element 1231B' so that a repulsive force is generated between the electromagnet driving element 1231B' and the permanent magnet driving element 1232B' to drive the health-regain environmental former 16B away from the direction of the permanent magnet driving element 1232B. The health-regain environmental former 16B is driven to move in a direction away from the permanent magnet drive element 1232B'. The control module 13B controls the power supply module 18B to supply power to the electromagnet driving element 1231B' to reduce the repulsive force generated between the electromagnet driving element 1231B' and the permanent magnet driving element 1232B' so that the electromagnet driving element 1231B' moves in a direction close to the permanent magnet element. The health-regain environmental former 16B is driven to move in a direction close to the permanent magnet element. It is worth to mention that the control module 13B controls the sub-driving device 123B' to drive the health-regain environmental former 16B intermittently. Preferably, the control module 13B controls the driving device 123B' to rhythmically drive the health-regain environmental former 16B. It is worth to mention that the control module 13B can control the sub-driving device 123B' to drive the health-regain environmental former 16B intermittently according to the health-regain plan. Preferably, the control module 13B controls the sub-driving device 123B' to rhythmically drive the health-regain environment former.

Figure 23A:
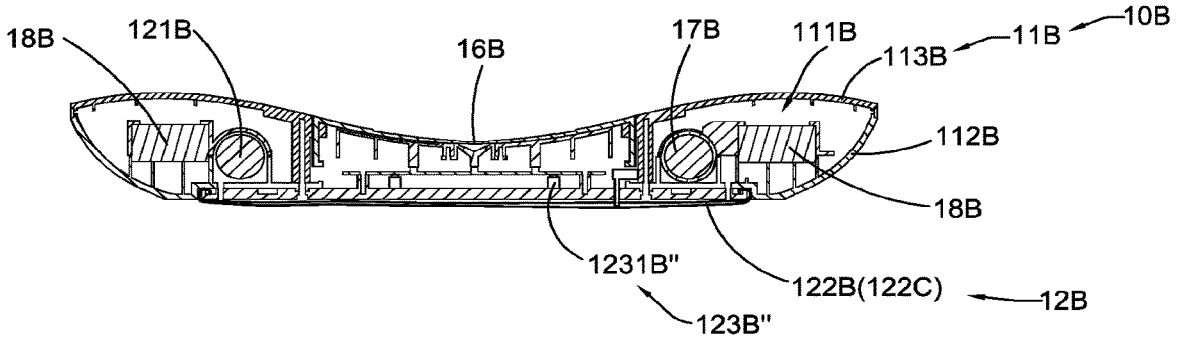
FIGS. 23A and 23B are sectional views of the health-regain device according to the preferred embodiment of the present invention, illustrating an alternative mode of the driving device.
Figure 23B:
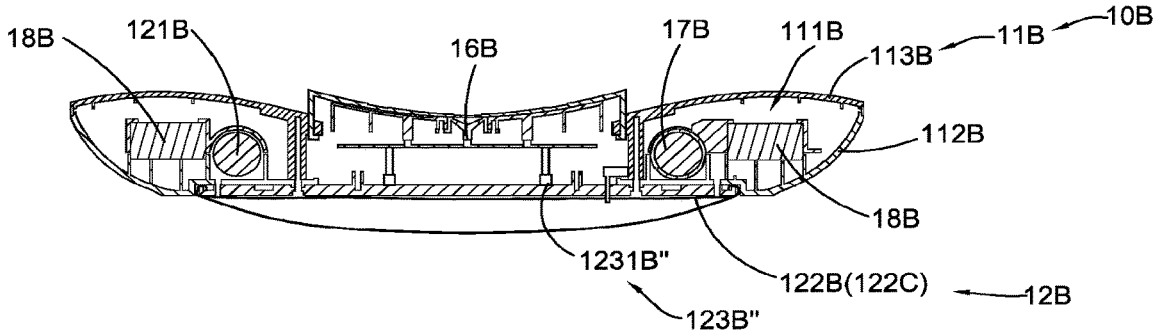

As shown in FIGS. 23A and 23B, in the alternative of the sub-driving device 12B, the sub-driving device 123B" is implemented as a lifting device 1231B". The lifting device 1231B" supports the health-regain environmental former 16B, which further comprises at least one lifting supporter 11231B", and the lifting supporter 11231B" respectively supports the health-regain environmental former 16B. The control module 13B controls the lifting supporter 11231B" to lift to drive the health-regain environmental former 16B to move.

It is worth to mention that the sub-driving device 123B can be implemented as a lifting device 1154B. The lifting device 1154B' is provided below the sub-health portion 114B. As shown in FIGS. 16E and 16F. The lifting device 1154B' supports the sub-health portion 114B. The lifting device 1154B' further comprises at least one lifting supporter 11541B. Each of the lifting supporter 11541B' supports the sub-health portion 114B respectively. The control module 13B is communicatively connected with the lifting supporter 11541B' respectively. The control module 13B controls the movements of the lifting supporter 11541B' to drive the movement of the child health portion 114B so as to apply the force to the used health portion. The control module 13B drives the sub-health portion 114B at intervals by controlling each of the lifting supporter 11541B. Preferably, the control module 13B drives the sub-health portion 114B rhythmically by controlling each of the lifting supporter 11541B. The sub-health portion 114B provides rhythmic health-regain to the health-regain portion of the user. It is worth to mention that the lifting device 1154B' also serves as an alternative embodiment of the driving portion 12B.

Figure 24C:
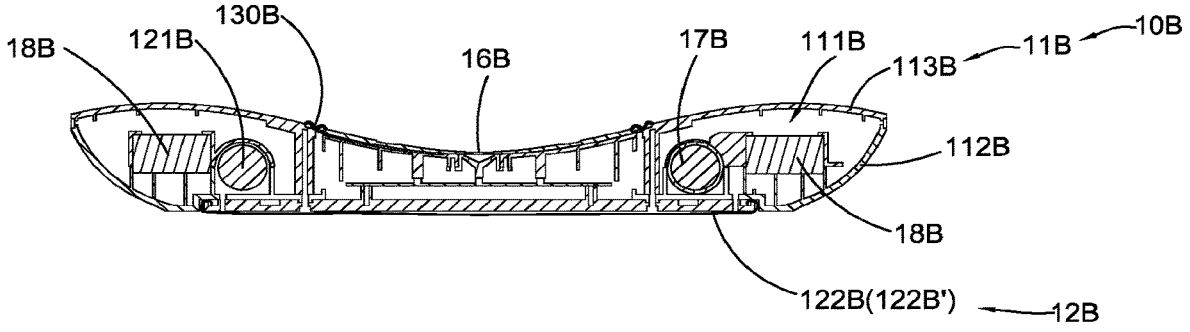
FIGS. 24C and 24D are sectional views of the health-regain device according to the preferred embodiment of the present invention, illustrating two states of an alternative mode of the driving device.
Figure 24D:
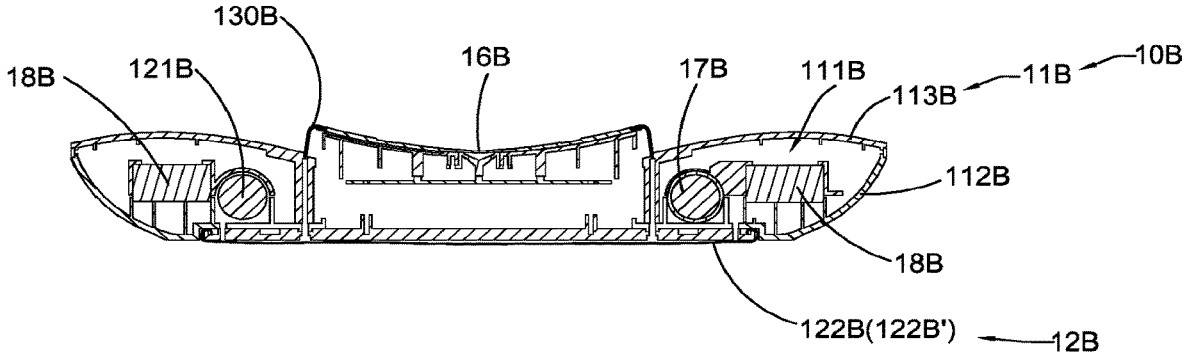

FIGS. 24C and 24D show another alternative mode of the embodiment of health-regain device 10B, wherein the health-regain device 10B further comprises a flexible connector 130B, and the outer edge of the flexible connector 130B is connected to the inner edge of the top cap 113B. The inside edge of the flexible connector 130B is attached to the inside edge of the health-regain environmental former 16B. Preferably, the inner edge of the flexible connector 130B is connected to the is inside edge of the sub-nonopaque device 16222B of the health-regain environmental former 16B to prevent contaminants such as dust and debris from entering the inside of the health-regain device 10B by preventing forming a gap formed between the nonopaque device 16222B and the top cover 113B of the health portion 11B to ensure the hygiene of the health-regain device 10B. When the health-regain environmental former 16B is driven to move against the health-regain device 10B, the flexible connector 130B can prevent forming a gap between the sub-nonopaque device 16222B in the health-regain environmental former 16B and the top covers 113B of the health portion 11B.

It is worth mentioning that the manner in which the outer edge of the flexible connector 130B is connected to the inner edge of the top cover 113B and the manner that the inner edge of the flexible connector 130B is connected to the outer edge of the sub-nonopaque device 16222B are not limited in the health-regain device 10B. For example, in an example of the present invention the health-regain device 10B, the outer edge of the flexible connector 130B may be bonded by glue on the inner edge of the top cover 113B, and the inner edge of the flexible connector 130B may be glued to the outer edge of the top cover 113B. In another example of the health-regain device 10B of the present invention, the flexible connector 130B may also be formed between the top cover 113B and the sub-nonopaque device 16222B by a process such as embedding, that is, the outer edge of the flexible connector 130B is integrally coupled to the inner edge of the top cover 113B and the inner edge of the flexible connector 130B is integrally coupled to the outer edge of the sub-nonopaque device 16222B.

Furthermore, the material of the flexible connector 130B in the present invention is not limited in the health-regain device 10B. For example, the flexible connector 130B may be but is not limited to rubber or silicone. In other words, the flexible connector 130B can be deformed when driven by the health-regain environmental former 16B.

Figure 24E:
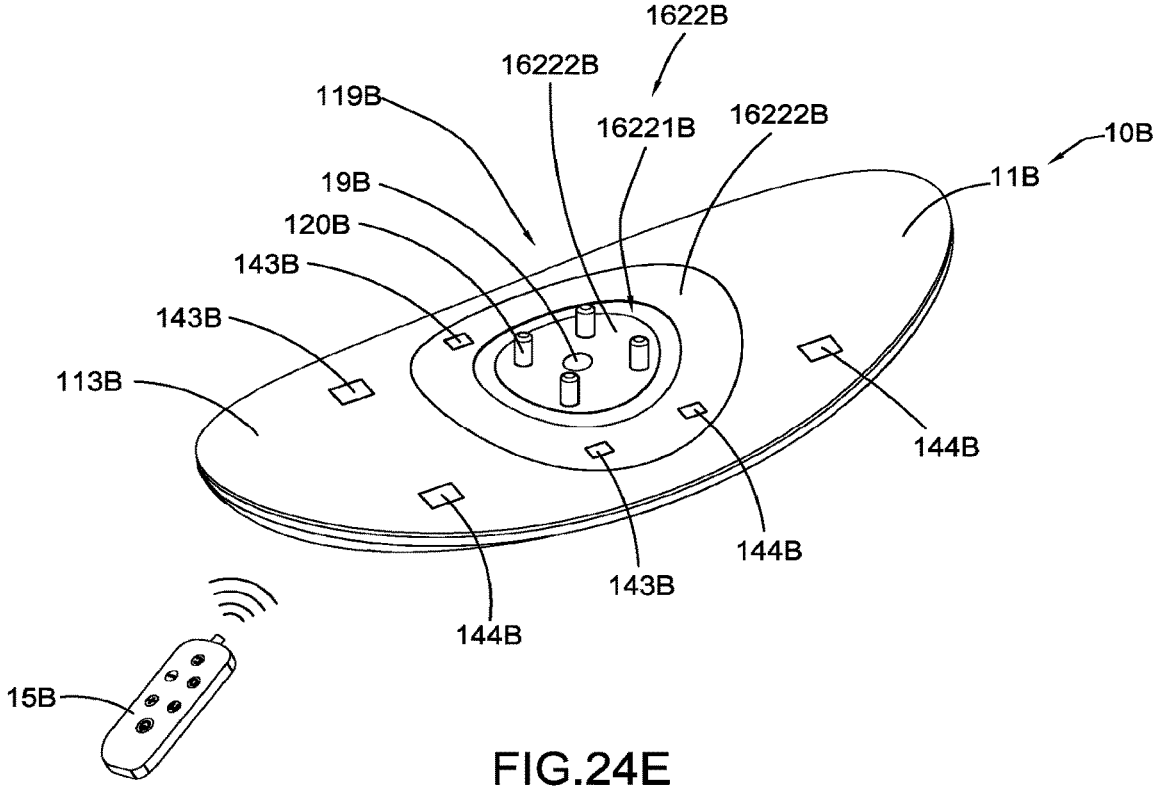
FIGS. 24E and 24F are sectional views of the health-regain device according to the preferred embodiment of the present invention, illustrating two states of an alternative mode.

FIG. 24E shows another alternative mode embodiment of the health-regain device 10B, wherein the health-regain device 10B further comprises at least one supporting portion 120B, wherein each of the supporting portion 120B are disposed on the health-regain environmental former 16B, wherein when the sub-driving device 123B drives the health-regain environmental former 16B to reciprocate, the health-regain environmental former 16B drives each of the supporting portion 120B to be reciprocated in synchronism for doing massage to health-regain body of the user by each of the support portions. Preferably, each of the supporting portions 120B is respectively disposed on the sub-nonopaque device 16222B of the health-regain environmental former 16B. Preferably, when the user uses the health-regain device 10B, the skin of the user's health-regain body can be in direct contact with each of the support parts 120B, so that the supporting end of each of the support parts 120B can against the user's health-regain body.

It is worth mentioning that the number of the supporting portion 120B is not limited in the present invention of the health-regain device 10B. For example, in FIG. 24E showed the health-regain device 10B, the support portions 120B is implemented as four support portions 120B, wherein each of the support portions 120B is disposed to be spaced from each other. However, one skilled in the art understands that, in other possible examples of the health-regain device 10B of the present invention, number of the supporting portions 120B may be implemented as, but not limited to, three, five, six, seven or eight.

Figure 24F:
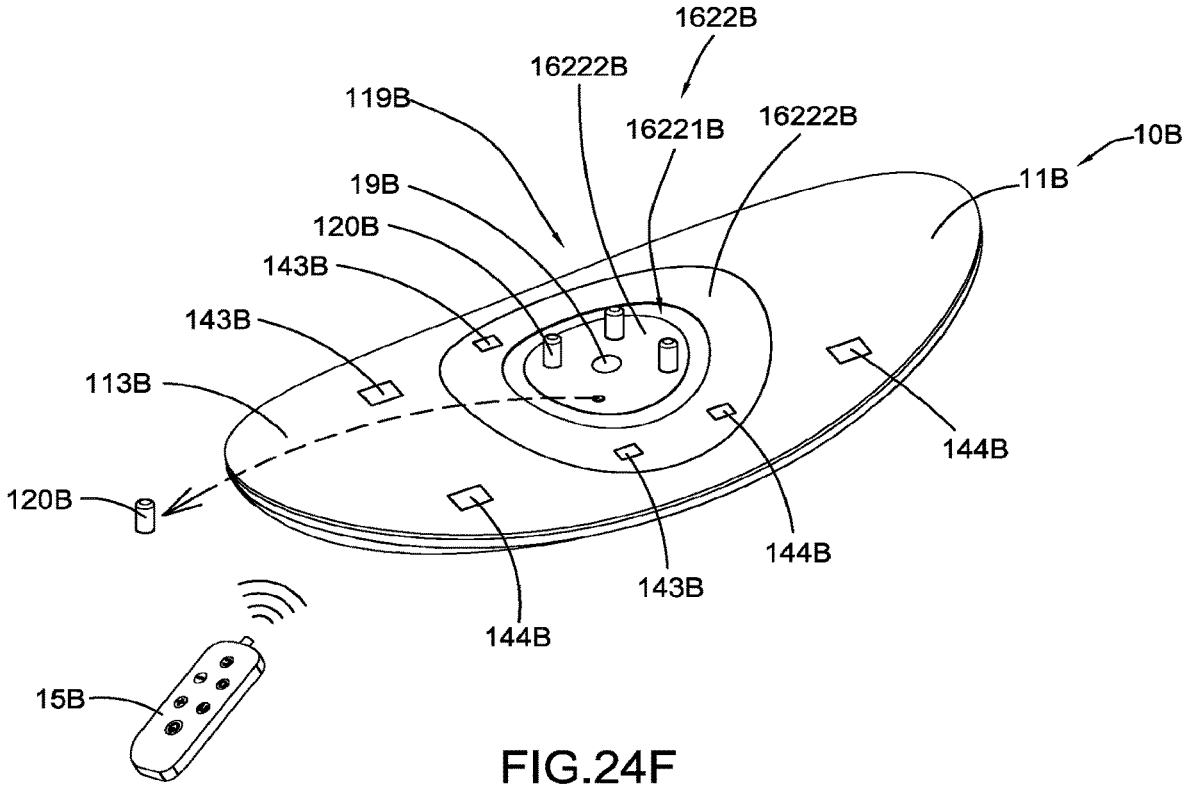

Furthermore, the type of the supporting portion 120B in the present invention of the health-regain device 10B is not limited. For example, the support portion 120B can be, but is not limited to the magnetic element for doing magnetic health-regain to health-regain body of the user; the IR emitter component for doing infrared health-regain to health-regain body of the user. Furthermore, the manner of the supporting portion 120B provided in the health-regain environmental former 16B is not limited in the present invention of the health-regain device 10B. For example, the support portion 120B can extend integrally from the sub-nonopaque device 16222B in the health-regain environmental former 16B, or the supporting portion 120B is detachably mounted on the sub-nonopaque device 16222B of the health-regain environmental former 16B. Referring to FIG. 24F, in this way, the user may change different type of supporting portion 120B. For example, when the user does not need to use the supporting portion 120B, the supporting portion 120B may be detached from the sub-nonopaque device 16222B of the health-regain environmental former 16B. When the user's health-regain area needs to be magnetized, the supporting portion 120B implemented as a magnetic element may be mounted on the sub-nonopaque device 16222B of the health-regain environmental former 16B. When the user's health-regain portion needs to be infracted, the infrared emitting element of the supporting portion 120B of the health-regain environmental formers 16B are mounted on the sub-nonopaque device 16222B. In addition, the user may also mount different types of the supporting portions 120B on the sub-nonopaque device 16222B of the health-regain environmental former 16B. Of course, one skilled in the art understands that, in other examples of the health-regain device 10B, the user can also select the number of the supporting portions 120B installed in the sub-nonopaque device 16222B of the health-regain environmental former 16B.

FIG. 25 shows a health-regain device according to another preferred embodiment of the present invention. The health-regain device according to the present invention further comprises a driving portion 12C and a health-regain environmental former 11C which is a health portion that the driving portion 12C drives the health-regain environmental former 11C to reciprocate. When the user is using the health-regain device of the present invention, it is preferable to be used in a lying position. That is, the user is lying flatly to use the neck of the user to contact the health-regain environmental former 11C. And the health-regain environmental former 11C is driven to reciprocate by the driving portion 12C so that the cervical spine of the user is pushed so that the cervical spine is relaxed. In this way, the user's cervical spine gets the health-regain.

Further, the health-regain environmental former 11C further provides health-regain environment 119C. That is, the health-regain environmental former 11C further creates health-regain environment 119C to facilitate the user's integrity of the neck. The bending health-regain means that the user's neck is subjected to a rhythmic force to cause a change in the rhythm of the inner of the user's bending. As shown in FIGS. 26 to 29, specifically, the driving portion 12C drives the health-regain environmental former 11C to lift to apply the force to the neck of the user so that the user's neck is raised to increase the user's cervical bending. After the driving force generated by the driving portion 12C reaches a predetermined value, the driving portion 12C reduces the value of the provided driving force. The health-regain environmental former 11C is moved towards the driving portion 12C to reduce the cervical bending of the user. Preferably, the user's cervical bending is restored to a physiological bending in compliance with the human cervical spine. The driving force generated by the driving portion 12 is continuously adjusted so that the driving portion 12C is rhythmic to provide a driving force so that the health-regain environmental former 11C rhythmically applies the force to the user's neck to rhythm to change the bending of the user's cervical spine. That is, the driving portion 12C changes the driving force rhythmically so as to cause a change in the rhythm of the cervical spine of the user for making the cervical spine of the user healthy. In this way, the neck muscles of the user and the cervical spine of the user are relaxed to facilitate the bowling of the user's neck.

It is worth to mention that the driving portion 12C can change the driving force according to the predetermined time interval. In details, the driving portion 12C drives the health-regain environmental former 11C to apply the force to the user's neck to the health-regain environmental former 11C. Specifically, the driving portion 12C drives the health-regain environmental former 11C to lift so that the health-regain environmental former 11C provides the force on the neck of the user for increasing the bending of the user's cervical spine. After the predetermined time interval, the driving portion 12C reduces the driving force so that the health-regain environmental former 11C is lowered, and the bending of the user's neck is reduced. After the predetermined time interval, the driving portion 12C drives the health-regain environmental former 11C to lift so that the health portion provides the force on the neck of the user for increasing the bending height of the user's cervical spine. In this way, the driving portion 12C continues to adjust the driving force to increase or decrease for doing the bending health-regain to the neck of the user. In other words, the driving portion 12C can rhythmically drive the health-regain environmental former 11C by controlling the time interval, as shown in FIGS. 26 to 29.

Figure 32:
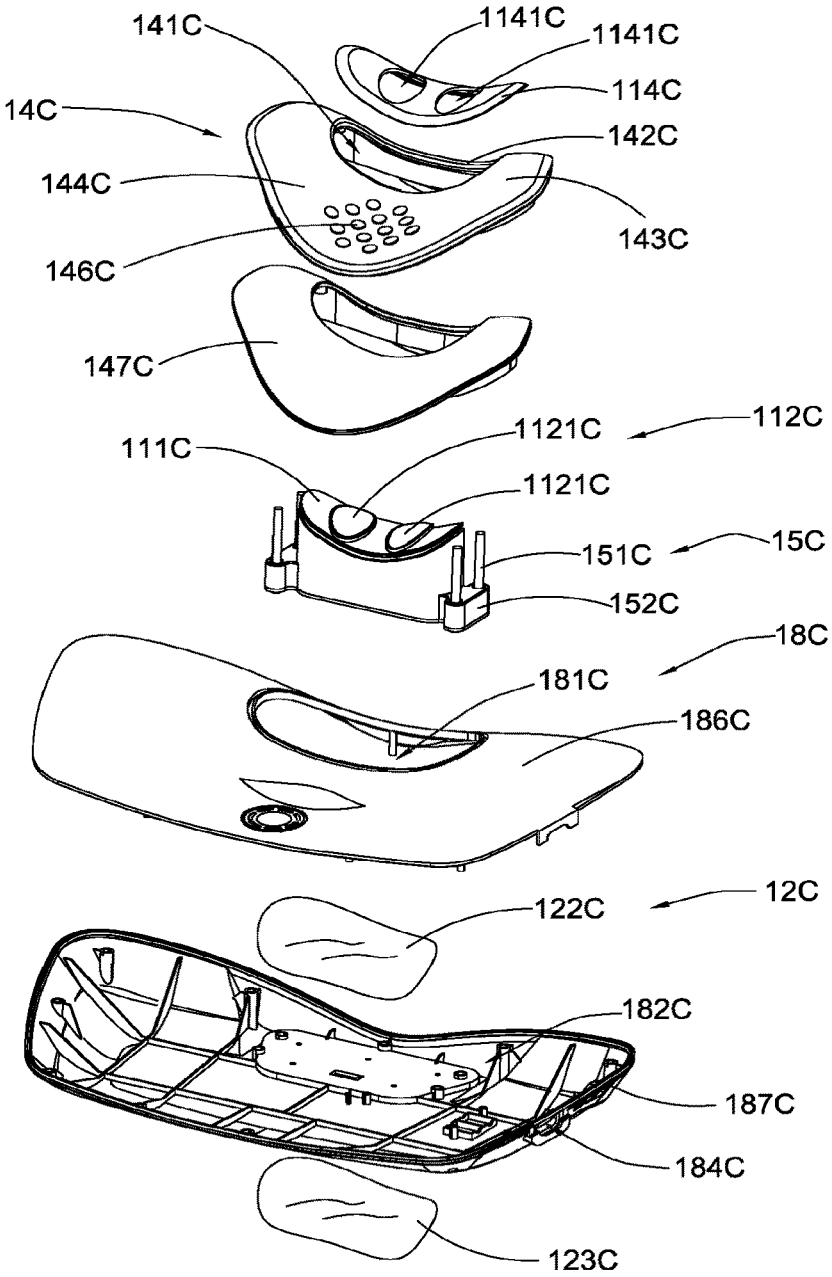
FIG. 32 is an explosive view of the health-regain device according to the above preferred embodiment of the present invention.
Figure 33:
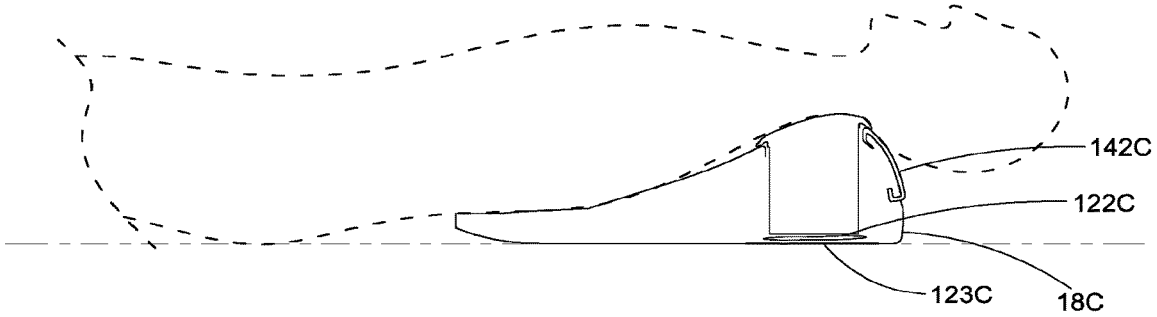
FIG. 33 to FIG. 36 are illustrated applications of the health-regain device according to the above preferred embodiment of the present invention.
Figure 34:
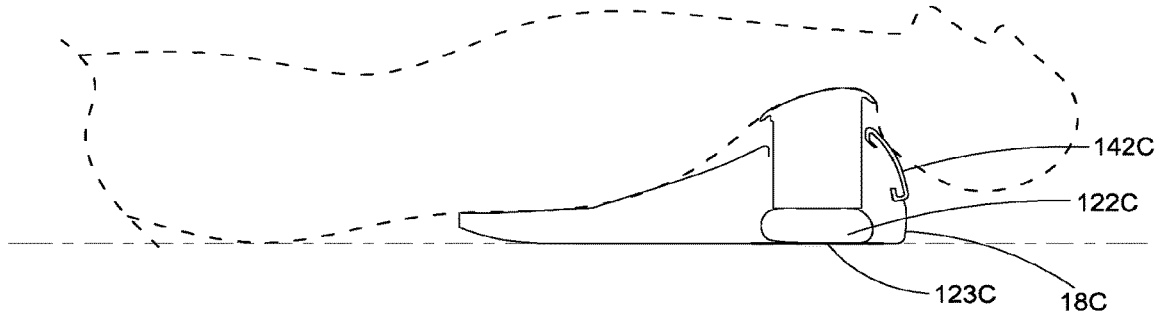
Figure 35:
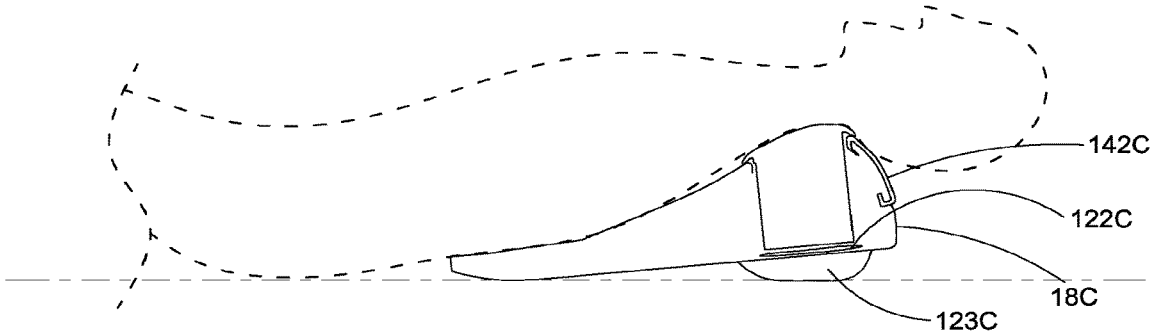
Figure 36:
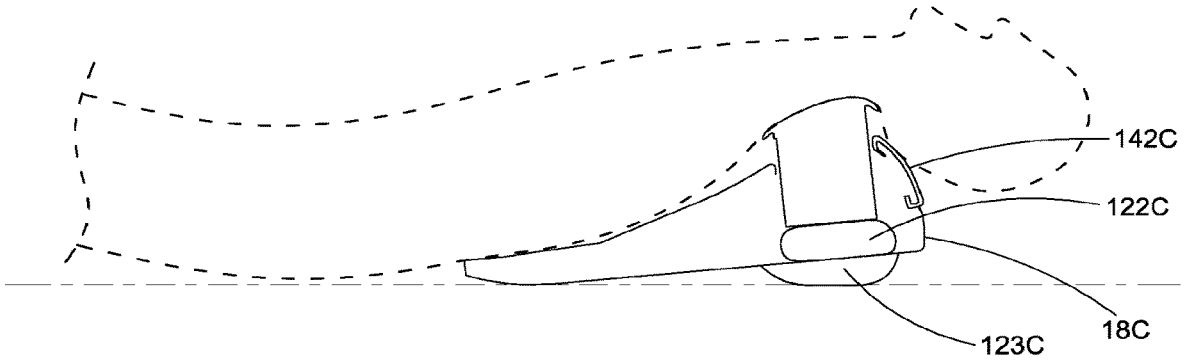
Figure 37:
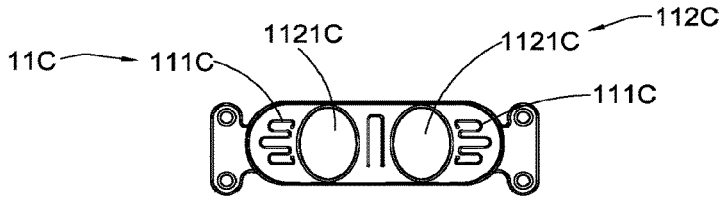
FIG. 37 is a perspective view of the center housing of the health-regain device according to the above preferred embodiment of the present invention.

As shown in FIG. 32, in the preferred embodiment of the present invention, the driving portion 12C further comprises an air adjusting device 121C and a gasbag 122C communicating with the air adjusting device 121C. The air adjusting device 121C inflates air to the gasbag 122C so that the gasbag is inflated to provide a driving force to drive the health-regain environmental former 11C to lift. The health-regain environmental former 11C is applied by the driving force provided by the driving portion 12C to apply the force to the cervical spine of the user so that the bending of the user becomes increased. The air adjusting device 121C deflates the gas to the gasbag 122C so that the gasbag 122C contracts to reduce the driving force. The health-regain environmental former 11C is reduced by the driving force provided by the driving portion 12C so that the health-regain environment former 11C reduces the force applied to the user's cervical spine. The bending of the user's neck is reduced. In the preferred embodiment of the present invention, the gasbag 122C is disposed below the health-regain environmental former 11C.

Figure 40:
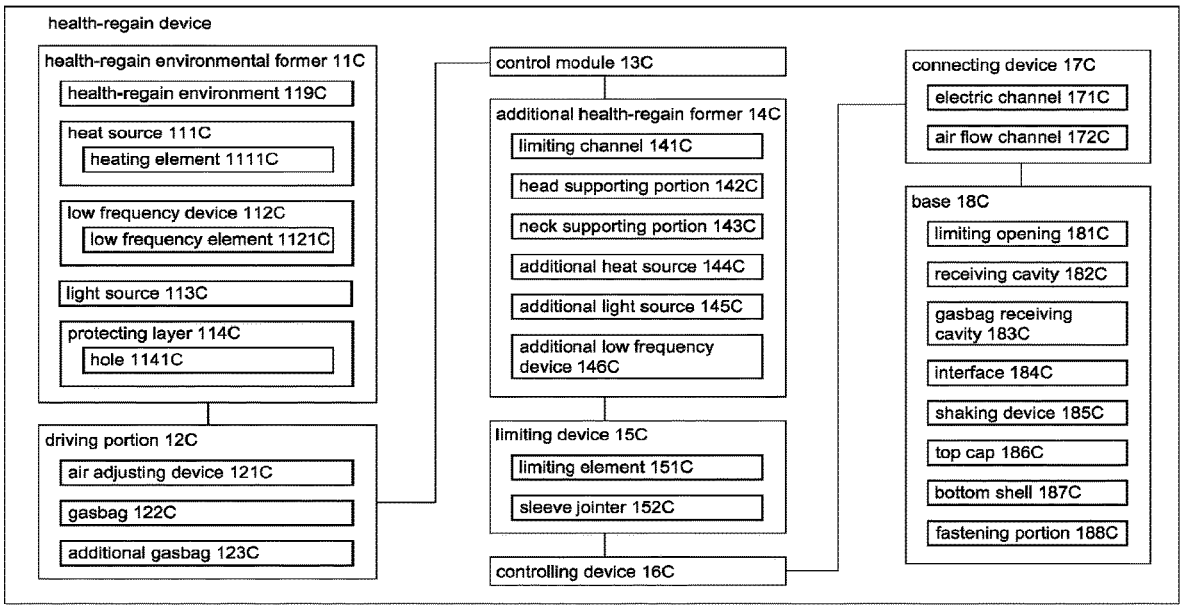
FIG. 40 is a block diagram of the health-regain device according to the above preferred embodiment of the present invention.

As shown in FIG. 40, the health-regain device according to the present invention further comprises a control module 13C, which is communicatively connected to the driving portion 12C. The control module 13C controls the driving portion 12C to adjust the driving force provided by the driving portion 12C. That is, the control module 13C controls the driving portion 12C to increase, decrease or maintain the driving force of the driving portion 12C. In details, the control module 13C is communicatively connected with the air adjusting device 121C. The control module 13C controls the air adjusting device 121C to supply the gas to the gasbag 122C. Further, the control module 13C controls the speed of the gasbag to increase the driving force by controlling the amount of the gas supplied to the gasbag 122C by the air adjusting device 121C. In this way, the formation of a driving rhythm. The control module 13C controls the air adjusting device 121C to extract the gas in the gasbag 122C. Further, the control module 13C controls the gasbag to reduce the speed of the driving force by the amount of the gas extracted from the gasbag 122C by the air adjusting device 121C. It is worth to mention that the control module 13C controls the adjustment of the driving force by reducing the driving force by controlling the air adjusting device 121C to form a rhythm of changing the driving force. By controlling the rhythm of the switching drive force, the health-regain environmental former 11C provides a rhythmic force to the cervical spine. It is worth to mention that the control module 13C maintains the amount of the gas in the gasbag 122C by the air adjusting device 121C so that the gasbag 122C maintains the provided driving force. In other words, the control module 13C provides a rhythm of the driving force by controlling the amount of the gas of the gasbag 122C for causing the health-regain environmental former 11C to exert the force on the user's cervical spine. Specifically, the control module 13C controls the amount of gas supplied to the gasbag by the air adjusting device 12C which maintains the amount of gas in the gasbag and the air adjusting device 12C reduces the amount of gas in the gasbag for changing to produce a rhythm of the driving force. Further, the control module 13C drives the air adjusting device 121C to switch the time interval between the inflation and the deflation to form a rhythmic driving.

The health-regain environmental former 11C further comprises a heat source 111C. The heat source 111C is provided at the top of the health-regain environmental former 11C. The heat source 111C is communicatively connected with the control module 13C. The control module 13C controls the heat source 111C to provide heat. That is, by the heat source 111C, the health-regain environmental former 11C forms a thermal environment. It is worth to mention that the user's body is relaxed when the user in a lying position. In other words, the relaxation of the user's neck muscles is conducive to bending health-regain. Further, before the bending health-regain, the control module 13C controls the heat source 111C to provide heat to form a thermal environment. In the thermal environment, with the ambient temperature heater, the user's neck feels comfortable. Further, in the thermal environment, the user's muscle temperature lifts for shortening the user's neck muscles from a quiescent state to a time to enter the bending health-regain. In this way, the user's neck muscles can enter the bending health-regain more quickly. Further, in the process of bending health-regain, maintaining a predetermined temperature is conducive to improving the bending efficiency of health. The heat source 111C may be implemented as a heat source device, a heating wire, or the other alike device. It is worth to mention that the health-regain environmental former 11C is driven by the driving portion 12C so that the heat source 111C provided to the top of the health-regain environmental former 11C is fitted to the neck of the user so that the effect of thermal health-regain-regain of the user's neck is improved.

The health-regain environmental former 11C further comprises at least one low frequency device 112C. The low frequency device 112C is provided at the top of the health-regain environmental former. The low-frequency device 112C is communicatively connected with the control module 13C. The control module 13C controls the low frequency device 12C to provide a low frequency environment. After the neck of the user is supported by the health-regain environmental former 11C, the low frequency device 112C is in contact with the neck of the user to perform low frequency pulse on the user for facilitating the user to perform low frequency health-regain. It is worth to mention that the control module 13C controls the low frequency device 112C to provide a low frequency. Preferably, the health-regain environmental former 11C comprises two the low frequency devices 112C. The low frequency devices 112C are provided at the top of the health-regain environmental former 11C respectively. Preferably, the low frequency device 112C is symmetrically arranged on the center line of the health-regain environmental former 11C. When the control module 13C controls the rhythm of the driving force by the driving portion 12C, the control module 13C can simultaneously control the frequency provided by the low frequency device 112C. The control module 13C controls the driving portion 12C to provide the rhythm of the driving force, and the control module 13C can control the heat source 111C. It is worth to mention that the heat source 111C may be provided between the low frequency device 112C and the top of the health-regain environmental former 11C. It is worth to mention that when the health-regain environmental former 11C is driven by the driving portion 12, the health-regain environmental former 11C provides the force on the neck of the user for using the low frequency device 112C on the user's neck. In details, the gasbag 122C drives the health-regain environmental former 11C so that the low frequency device 112C is attached to the user's neck. Furthermore, the low frequency device 112C may provide heat. That is, the low frequency device 112C cooperates with the heat source 111C. The low frequency device 112C can not only provide a low frequency environment but also provide the thermal environment through the low frequency device. Further, by the control of the control module 13C, the low frequency device 112C cooperates with the heat source to form the thermal environment. Specifically, the control module 13C controls the heat source 111C to provide heat to form the thermal environment. The control module 13C controls the low frequency device 112C to form a point heat source. The control module 13C controls the low frequency device 112C to simultaneously form the low frequency environment and the thermal environment so that the user's neck is under the low frequency health-regain while also performing thermal health-regain-regain. The control module 13C controls the heat source 111C and the low frequency device 112C to operate in cooperation respectively. After the heat source 111C is turned on, the control of the low-frequency device 112C by the control module 13C provides heat to increase the heat of the area corresponding to the low-frequency device 112C. Also, the heating rhythm of the heat source 111C and the low-frequency device 112C can be controlled by the control module 13C.

The health-regain environmental former 11C further includes a light source 113C. The light source 113C is communicatively connected with the control module 13C. The control module 13C controls the light source 113C to provide light to form a luminous environment for providing a light health-regain. In the luminous environment, the user's neck skin is irradiated to carry out light health-regain to the user's neck skin. The control module 13C controls the light intensity of the light provided by the light source 113C. Further, the control module 13C controls the light source 113C to operate in cooperation with the driving portion 12C, the heat source 111C, and/or the low frequency device 112C respectively. The control module 13C further controls the light emission rhythm of the light source 113C.

With the control of the control module 13C carried out in the health-regain environment, and the cervical spine of the user is agitated by the force, and the neck muscles of the user are under the thermal health-regain-regain and low-frequency health-regain, and at the same time. The user's skin is with light health-regain. In this way, it is time for the user to separate doing the bending health-regain, health-regain, low-frequency care, and light health-regain is reduced with the bending efficiency improved. By this control module 13, it is possible to form the thermal environment, the low-frequency environment, the luminous environment separately to do the bending health-regain.

Figure 42:
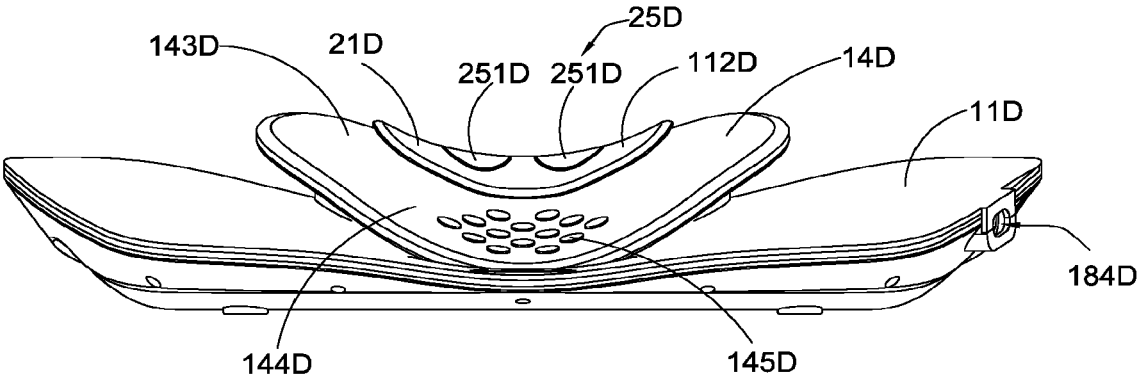
FIG. 42 to FIG. 45 are illustrating the work states of the health-regain device according to the above preferred embodiment of the present invention.
Figure 43:
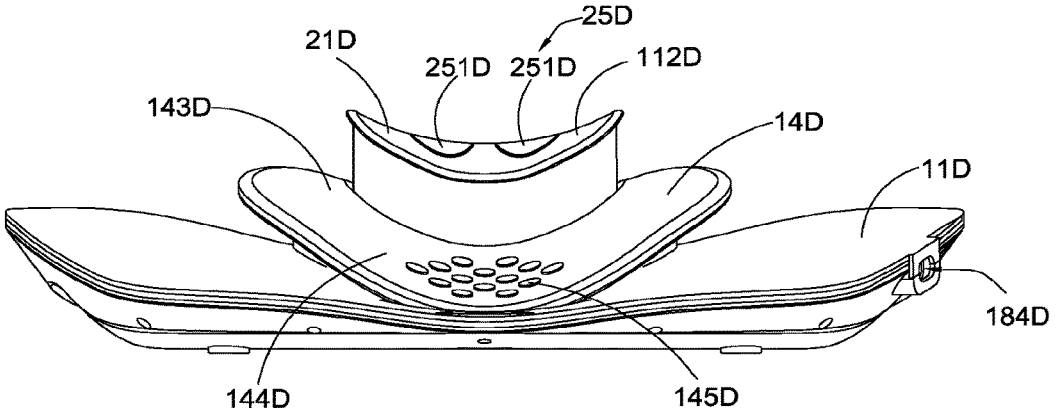
Figure 44:
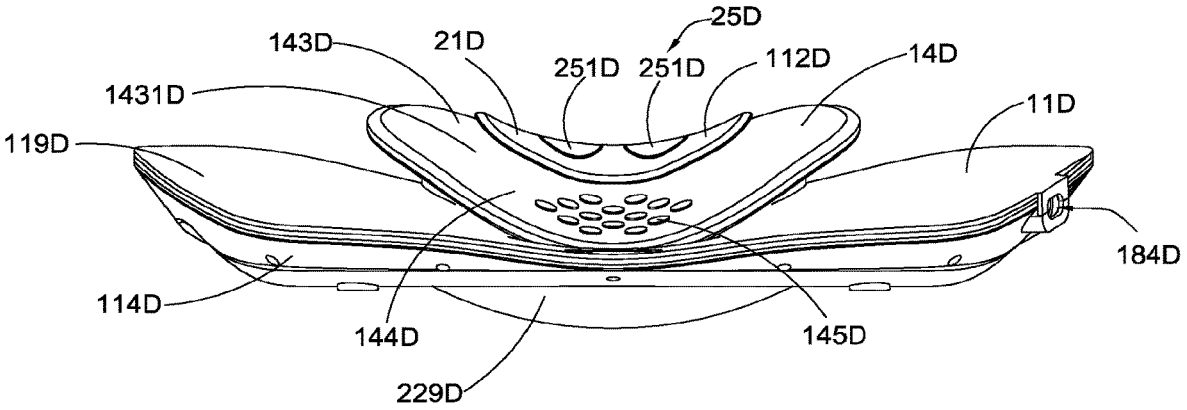
Figure 45:
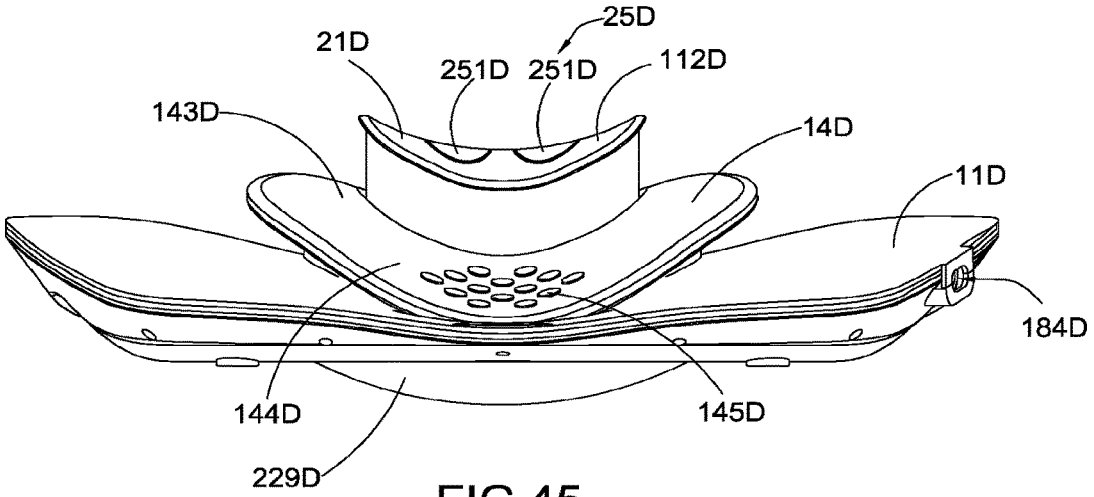
Figure 46:
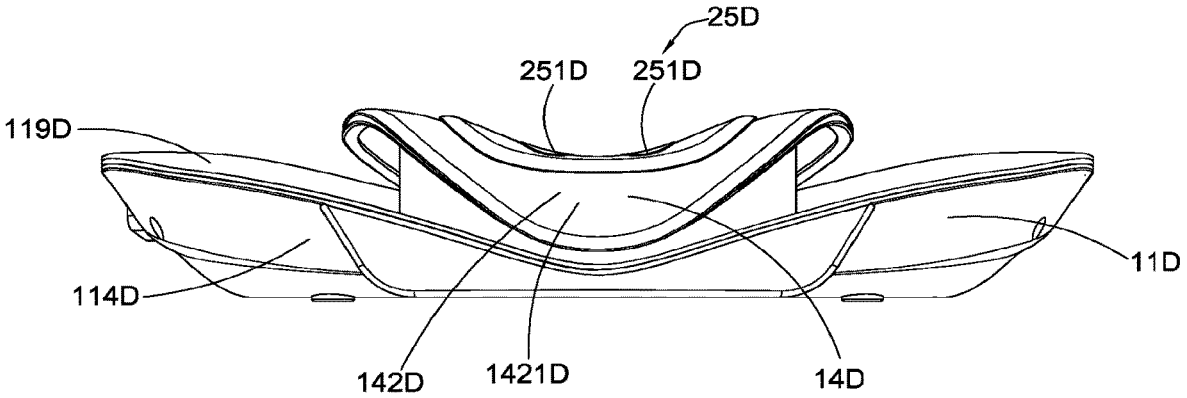
FIG. 46 is a back view of the health-regain device according to the above preferred embodiment of the present invention.

As shown in FIG. 32, the health-regain environmental former 11C further has a limiting portion 115C. The limiting portion 115C is provided at the top of the health-regain environmental former 11C. Preferably, the limiting portion 115C matches the physiological bending of the human neck. The neck of the user is adapted to be placed in the limiting portion 115C. As shown in FIG. 25, the middle portion of the stopper portion 115C is lower than the both end portions of the stopper portion 115C. Preferably, both ends of the limiting portion 115C are at the same level. The user's cervical spine is fixed to the stopper portion 115C when the user's cervical spine is adapted to be placed in the stopper portion 115C so that the user's cervical spine is reciprocated in a rhythm. The heat source 111C is provided on the surface of the limiting portion 115C. The driving portion 12C drives the health-regain environmental former 11C to move the limiting portion 115C toward the cervical spine of the user so that the heat source provided on the surface of the limiting portion 115C is fitted to the neck of the user. Specifically, the gasbag 122C drives the limiting portion 115C of the health-regain environmental former 11C in close contact with the neck of the user, so that the heat source 111C is fitted to the neck of the user. The low-frequency device 112C is provided in the limiting portion 115C. After the neck of the user is placed in the limiting portion 115C, the low-frequency device 112C is in contact with the neck of the user. Furthermore, the driving portion 12 drives the health-regain environmental former 11C so that the low-frequency device 112C is fitted with the user's neck. As shown in FIG. 42, further, the low-frequency device 112C includes at least two low-frequency elements 1121C, and two low-frequency elements 112C are provided in the middle of the limiting portion 115C respectively. It is preferable that the two low-frequency elements 1211C are provided on both sides of the center line of the limiting portion 115C respectively. Preferably, the two low-frequency elements 1211C are symmetrically arranged based on the central axis of the limiting portion 115C. Preferably, the heat source 111C is arranged to surround the low frequency device 112C. In a preferred embodiment of the present invention, the health-regain environmental former 11C is provided with two heat sources 111C. The heat source 111C is provided on one side of the low-frequency element 1121C. The two heat sources 111C are arranged symmetrically. Preferably, the heat source 111C may be implemented as a heat source device and a heating wire.

The control module 13C controls the heat source 111C and the low frequency device 112C respectively. It is worth to mention that the control module 13C may control the low frequency device 112C to provide low frequency health-regain and/or thermal health-regain-regain. Specifically, the control module 13C controls the low frequency element 1121C to provide thermal energy respectively, so that the low frequency element 1121C is functional as a point heat source. The control module 13C controls the heat source 111C and the low frequency device 112C cooperatedly so that the heat generated by the low frequency device 112C is complementary to each other. The light source 113C may be provided on the surface of the limiting portion 115C so that the neck of the user is exposed to the light source. The control module 13C controls the irradiation rhythm of the light source 113C. In the embodiment, the heat source 111C is disposed around the light source 113C.

As shown in FIG. 32, the health-regain device of the present invention further comprises an additional health-regain environmental former 14C. The additional health-regain environmental former 14C further has a limiting channel 141C. The health-regain environmental former 14C is embedded in the limiting channel 141C so that the additional health-regain environmental former 141C surrounds the health-regain environmental former 14C. The health-regain environmental former 14C reciprocates at the limiting channel 141C. Specifically, the air adjusting device 121C inflates the gasbag 122C to expand the gasbag 122C. The gasbag 122C is inflated to drive the health-regain environmental former 14C to lift in the limiting channel 141C. The air adjusting device 121C evacuates the gasbag to cause the gasbag 122C to contract for lowering the health-regain environmental former 14C at the limiting channel 141C. It is worth to mention that the health-regain environmental former 14C is moved in the limiting channel 141C, which restricts the movement of the health-regain environmental former 14C in the horizontal direction to maintain the health-regain environmental former 14C in the vertical direction of movement. In another alternative preferred embodiment, the additional health-regain environmental former 14C further comprises an additional supporting frame 147C. The additional heat source 144C, the additional light source 145C, and the additional low frequency device 146C are provided at the top of the additional supporting frame 147C. That is, the additional light source 146C, the additional low frequency device 145C and the additional heat source 144C form an additional environmental forming layer 148C. To cover the top of the additional supporting frame 147C. That is, the limiting channel 141C further includes a first limiting channel 1411C and a second limiting channel 1412C. The first limiting channel 1411C is provided in the additional environmental forming layer 148C. The second limiting channel 1412C is provided in the additional bracket 147C. The first limiting channel 1411C aligns the second limiting channel 1412C to form the limiting channel 141C.

As shown in FIG. 32, the health-regain device further includes a limiting device 15C. The limiter 15C is used to limit the movement of the health-regain environmental former 14C in the vertical direction at the limiting channel 141C. The limiting device 15C further comprises at least two limiting elements 151C and at least two sleeve jointer 152C. The limiting elements 151C is fixedly provided. The sleeve jointer 152C is correspondingly fitted to the limiting elements 151C. The sleeve jointer 152C is slidedly fitted to the limiting elements 151C so that the sleeve jointer 152C moves along the limiting elements 151C. The sleeve jointer 152C is fixedly connected to the health-regain environmental former 11C. Preferably, the side of the sleeve jointer 152C is fixedly connected to the side of the health-regain environmental former 11C so that the health-regain environmental former 11C can move along the limiting elements 151C. It is worth to mention that the limiting elements 151C restricts the movement of the health-regain environmental former 11C from moving at the limiting channel 141C. Preferably, the two limiting elements 151C are provided on the periphery of the gasbag 122C and are located on opposite sides of the diagonal of the airbag. In another preferred embodiment of the present invention, four of the limiting elements 151C are provided. The four limiting elements 151C are respectively provided at the periphery of the gasbag 122C so that the health-regain environmental former 11C is stably moved along the limiting elements 151C in the limiting channel 141C. Further, the limiting device 15C limits the health-regain environmental former 14C so that the health-regain environmental former 11C aligns the limiting channel 141C.

The additional health-regain environmental former 14C cooperates with the limiting device 15C. The health-regain environmental former 14C is driven to send through the limiting channel 141C. In one preferred embodiment, the surface of the health-regain environmental former 11C is slightly higher than the surface of the additional health-regain environmental former 14C when the health-regain environmental former 11C is not driven. The additional health-regain environmental former 14C further comprises a head supporting portion 142C. When the user is using the health-regain device, the head supporting portion 142C supports the user's head. As shown in FIGS. 43 to 46, preferably, the head supporting portion 142C supports the posterior portion of the head of the user. The additional health-regain environmental former 14C further comprises a neck supporting portion 143C. When the user is using the health-regain device, the neck supporting portion 143C is provided to support the user's neck. One side of the head supporting portion 142C and one side of the neck supporting portion 143C surround the limiting channel 141C. That is, the movable channel is provided at the joint portion between the head supporting portion 142C and the neck supporting portion 143C. Preferably, the limiting channel 141C is provided on the side of the additional health-regain environmental former 14C close to the user's head. That is, the health-regain environmental former 11C is limited to the side close to the user's head. When the user is using the health-regain device of the present invention, the user's neck is supported by the health-regain environmental former 11C and the additional health-regain environmental former at the same time. Specifically, the head supporting portion 143C of the additional health-regain environmental former 14C supports the user's head. The health-regain environmental former 11C supports the user's neck. The neck supporting portion 142C of the additional health-regain environmental former 14C assists the health-regain environmental former 11C to support the user's neck. When the health-regain environmental former 11C is driven by the driving portion 12C to be lifted, the health-regain environmental former 11C is driven in the limiting channel 141C to lift the user's neck. The user's neck is lifted and the user's head gradually leaves the support of the head supporting portion 143C, and the gravity of the user's brain is all applied to the neck. The user's cervical spine is stretched using the gravitational force received by the user's brain so that the gap between adjacent two cervical spines is increased. The driving portion 12C reduces the driving force, and the health-regain environmental former 11C descends, and the neck portion of the user decreases as the health-regain environmental former 11C descends. The health-regain environmental former 11C is lowered in the limiting channel 141C, and the rear head of the user is in contact with the head supporting portion 143C. When the health-regain environmental former 11C returns to the initial position, the user's head is supported by the head supporting portion 143C to reduce the effect of the user's head on the force of the user's neck, which facilitates the recovery of the user's cervical spine from the physiological curve of the user's cervical spine.

The control module 13C controls the driving portion 12C to drive the rhythm of the health-regain environmental former 11C so that the driving portion 12C rhythmically drives the health-regain environmental former 11C so that the health-regain environmental former 11C performs rhythmic reciprocating motion. That is, the user's neck is raised rhythmically by the health-regain environmental former 11C to stretch the cervical spine of the user with the gravity of the user's head so that the gap between the adjacent two cervical spines is increased. The user's neck is rhythmically lowered as the health-regain environment 11 forming device 11C is such that the user's head is supported by the head supporting portion 143C to reduce the user's head to the effect of the force exerted by the neck for the user to restore the physiological curve of the cervical spine. In such a manner, the neck of the user is subjected to a rhythmic reciprocating motion by the health-regain environmental former 11C for facilitating the relaxation of the user's neck and facilitating the recovery of the user's cervical spine physiological curve. Further, the health-regain environmental former 11C also provides health to the user's neck muscles. Specifically, when the driving portion 12C drives the health-regain environmental former 11C to lift, the user's neck is lifted, and the user's neck muscles are stretched. When the health-regain environmental former 11C is lowered, the user's neck gradually relaxes as the health-regain environmental former 11C descends. The driving section 12C controls the drive section 12C to drive the driving rhythm of the health-regain environmental former 11C, and the user's neck muscles are switched between stretching and relaxation for obtaining health. It is worthwhile that the control module 13C affects the temperature near the health-regain environmental former 11C by controlling the heat generated by the heat source 111C to form a health-regain environment. In particular, where the temperature is low, the control module 13C controls the heat source 111C to provide heat to form the health-regain environment to provide the effect of performing neck health. Specifically, in the case where the temperature is low, the temperature of the user's neck is low. The control module 13C controls the heat generated by the heat source 111C to heat the user's neck feel comfortable. First of all, the psychological willingness to use the health-regain device of the invention for health. When the user's neck is in contact with the surface of the health-regain environmental former 11C, the heat source 111C provided in the health-regain environmental former 11C makes the user's neck feel further comfortable. Moreover, the user's neck can cause the user's neck muscles to relax by contacting the heat source 111C, and the user's neck muscles are relaxed. To avoid strain due to the user's neck muscle temperature is low, it may cause stiffness. Further, the light source 113C provided in the health-regain environmental former 11C may further provide an effect of providing illumination to the user's neck skin to provide phototherapy or cosmetic. The low frequency device 112C provided in the health-regain environmental former 11C may further provide low frequency and/or heat. The control module 13C controls the heat source 111C and the low frequency device 112C respectively, which can form the health-regain environment to provide thermal health-regain, light health-regain and low frequency health-regain. Further, the health-regain environmental former 11C provides the health-regain environment in accordance with the needs of the user during the neck bending and health of the user. In this health-regain environment can provide thermal health-regain, light health-regain and low frequency health-regain. In this health-regain environment, the user's neck, neck muscles and neck skin are taken care of. Further, the health-regain environmental former 11C further includes a shaking device 185C which is communicatively connected with the control module 13C. The control module 13C controls the vibration rhythm of the shaking device 185C to provide a massage. That is, the health-regain environmental former 11C provides the health-regain environment for further providing massage.

It is worth to mention that the additional health-regain environmental former 14C cooperates with the health-regain environmental former 11C. In particular, the additional health-regain environmental former 14C further comprises an additional heat source 144C disposed on the surface of the additional health-regain environmental former 14C. The additional heat source 144C is communicatively connected with the control module 13C. The control module 13C controls the additional heat source 144C to work together. The additional health-regain environmental former 14C further comprises at least an additional light source 145C which is provided on the surface of the additional health-regain environmental former 14C. The additional light source 145C is communicatively connected with the control module 13C. The control module 13C controls the additional light source 145C to work together. The additional health-regain environmental former 14C further includes an additional low frequency device 146C which is provided on the surface of the additional health-regain environmental former 14C. The additional low-frequency device 147C is communicatively connected with the control module 13C. The control module 13C controls the additional low frequency device 147C to work together. The heat source 111C and the additional heat source 144C are controlled by the control module 13C to provide heat. That is, the control module 13C cooperates to control the heat source 111C and the additional heat source 144C to form the health-regain environment. Further, the control module 13C cooperates with the additional heat source 144C by controlling the heat source 111C to expand the range of the health-regain environment. That is, through the additional health-regain environmental former 14C, the health-regain environment is expanded to cover the user's head and the user's neck and the user's trunk. The control module 13C controls the additional light source 145C and the additional low frequency device 146C respectively, to work together to provide illuminous health-regain and low frequency health-regain in the health-regain environment.

The head supporting portion 143C has a head supporting surface 1431C which is in contact with the rear head of the user's head to provide a means for sharing the gravity of the head support of the user. Preferably, the head supporting surface 1431C is an inclined surface. One end of the head supporting surface 1431 close to the health-regain environmental former 11C is higher than one end of the head supporting surface 1431C away from the health-regain environmental former 11C. Preferably, the inclination of the head supporting surface 1431C matches the physiological curvature between the posterior part of the head and the neck. The neck supporting portion 142C has a neck supporting surface 1421C extending from the health-regain environmental former 11C in a direction away from the health-regain environmental former 11C. The neck supporting surface 1421C is a slope. One end of the neck supporting surface 1421C close to the health-regain environmental former 11C is higher than the neck supporting surface 1421C away from one end of the health-regain environmental former 11C. In such a manner, the entire neck of the user is supported by the neck supporting surface 1421C. Preferably, the inclination of the neck supporting surface 1421C matches the inclination of the neck towards the neck and the trunk joint so that the neck supporting surface 1421C is fitted to the neck of the user.

The health-regain device of the present invention further comprises a controlling device 16C and a connecting device 17C. The controlling device 16C is connected to the connecting device 17C. The connecting device 17C comprises at least one electrical channel (electrical connection) 171C and at least one air flow channel 172C. Through this electrical channel 171C, the connecting device 17C electrically is connected with the heat source 111C, the additional heat source 144C, the low frequency device 112C, the light source 113C, the additional light source 146C, and the additional low frequency device 145C respectively. The controlling device 16C is communicatively connected with the control module 13C. The controlling device 16C controls the supply of the heat source 111C, the additional heat source 144C, the low frequency device 112C, the light source 113C, the additional light source 146C, and the additional low frequency device 145C respectively through the control module 13C. The controlling device 16C inflates the gas or deflates gas to the gasbag 122C through the air flow channel 172C. Preferably, the air adjusting device 121C is provided in the controlling device 16C. The air adjusting device 121C inflates the gas to the gasbag 122C through the air flow channel 172C so that the gasbag 122C drives the health-regain environmental former 11C. The air adjusting device 121C draws gas through the air flow channel 172C to reduce the driving force provided by the gasbag 122C. The air adjusting device 121C is provided in the controlling device 16C to reduce the noise generated by the air adjusting device 121C so that the health-regain environment maintains a relatively quiet use environment.

The health-regain device of the present invention further comprises a base 18C which supports the additional health-regain environmental former 14C. The base 18C further has a limiting opening 181C. The limiting opening 181C is aligned with the limiting channel 141C of the additional health-regain device 14C. The base 18C further has a receiving cavity 182C. The receiving cavity 182C communicates with the limiting channel 141C through the limiting opening 181C. The health-regain environmental former 14C is placed in the receiving chamber 182C. Specifically, a part of the health-regain environmental former 14C is inserted into the receiving cavity 182C through the limiting opening 181C. The other part of the health-regain environmental former 14C is placed in the active channel 14C of the additional health-regain environmental former 14C. Preferably, the top surface of the health-regain environmental former 14C is higher than the top surface of the additional health-regain environmental former 14C. The gasbag 122C is provided between the health-regain environmental former 11C and the bottom surface of the base 18C. The gasbag 122C is aligned with the bottom of the health-regain environmental former 11C. The limiting device 15C is fixed to the bottom of the base 18C. Specifically, each of the limiting members 151C is fixed to the bottom of the base 18C respectively. Each of the limiting elements 151C is provided around the health-regain environmental former 11C. The limiting elements 151C corresponds to the sleeve jointer 152C. In a preferred embodiment, the sleeve jointer 152C is provided at the bottom of the health-regain environmental former 11C. The control module 13C controls the air adjusting device 121C to supply the gas to the gasbag 122C. The gasbag 122C is expanded to generate a driving force. This driving force drives the health-regain environmental former 11C to lift. During the lift of the health-regain environmental former 11C, the sleeve jointer 152C moves along the limiting elements 151C so that the health-regain environmental former 11C is limited to moving at the limiting channel 141C.

Figure 38:
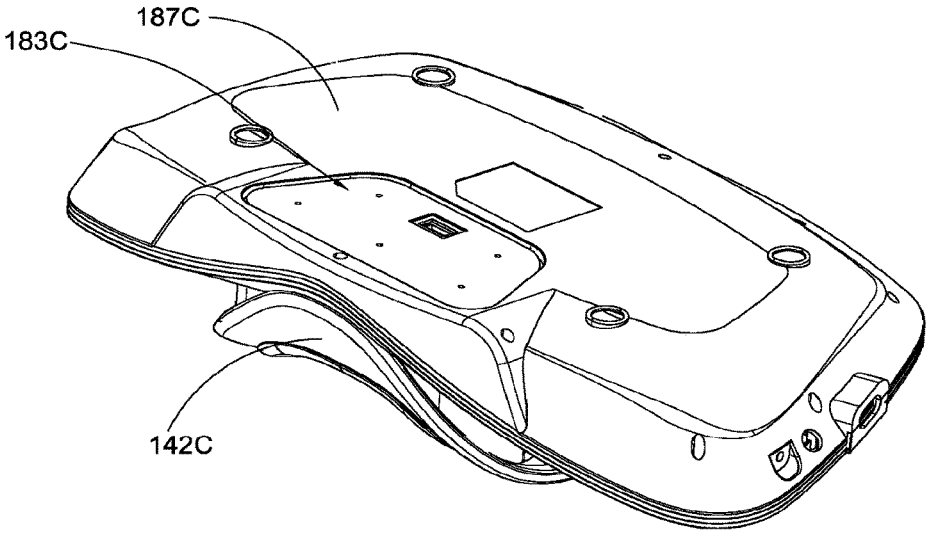
FIG. 38 is a perspective view of the health-regain device according to the above preferred embodiment of the present invention.

As shown in FIG. 38, the bottom of the base 18C further has a gasbag receiving chamber 183C. The driving portion 12C further comprises an additional gasbag 123C provided in the gasbag receiving cavity 183C. The additional gasbag 123C communicates with the air adjusting device 121C. The air adjusting device 121C inflates the gas to the additional gasbag 123C to inflate the height of the base by the additional gasbag 123C, so that the health-regain device is adapted to carry out the integrity of the neck. It is worth to mention that the control module 13C forms the rhythm of the user's neck health-regain by controlling the gas inflation and rhythm of the gasbag 122C and the additional gasbag 123C respectively, to form the rhythm of doing the health-regain by the health-regain environmental former 11C. Specifically, the control module 13C controls the air adjusting device 121C to simultaneously inflate the gasbag 122C and the additional gasbag 123C. The control module 13C controls the air adjusting device 121C to deflate the gasbag 122C and the additional gasbag 123C at the same time. The control module 13C controls the air adjusting device 121C to inflate the gasbag 122C and deflates the additional gasbag 123C. The control module 13C controls the air adjusting device 121C to inflate the additional gasbag 123C by deflating the gasbag 122C. In the above described manner, the control module 13C adjusts the gasbag 122C and the additional gasbag 123C by the air adjusting device 121C to form an adjustment rhythm. Further, the control module 13C controls the inflation speed and the deflation speed of the gasbag 122C, and the inflation rate and the deflation speed of the additional gasbag 123C to form the adjustment rhythm. In the above-mentioned manner, the rhythm of the bending health-regain to the user's neck is provided by the health-regain environmental former 11C.

Figure 39:
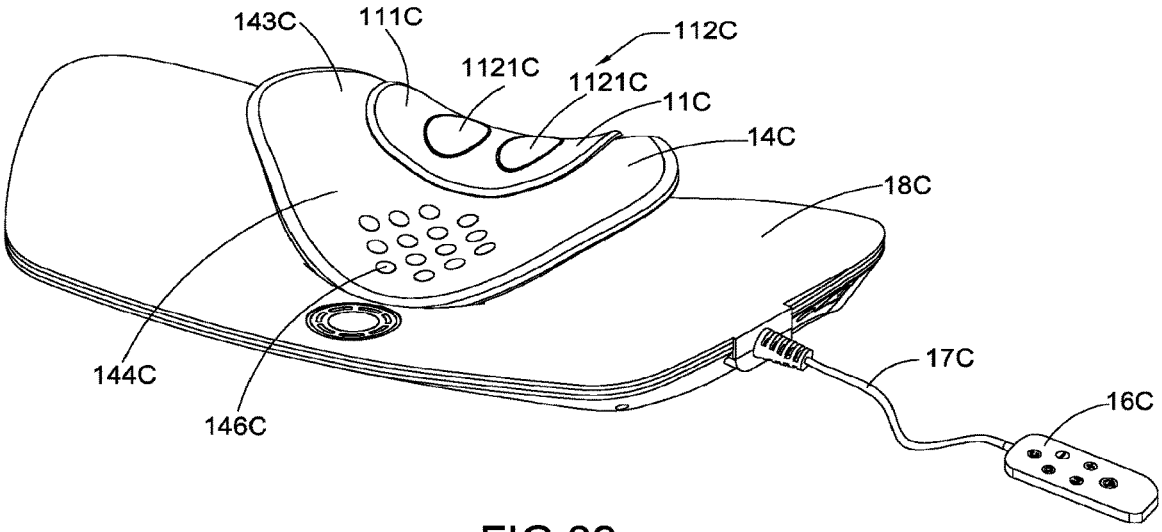
FIG. 39 is a perspective view of the health-regain device according to the above preferred embodiment of the present invention.

As shown in FIG. 39, the base 18C further comprises an interface 184C. The interface 184C is provided at the base 184C. Preferably, the interface 184C is provided on one side of the base 18C. The interface 184C is connected to the connecting device 17C. That is, the controlling device 16C accesses the interface 184C through the connecting device 17C. The interface 184C provides an electrical connection and an air connection. The electrical channel 171C and the air flow channel 172C of the connecting device 17C are connected to the interface 184C respectively. The interface 184C is electrically connected with the heat source 111C, the additional heat source 144C, the low frequency device 112C, the light source 113C, the additional light source 146C, and the additional low frequency device 145C respectively. In the preferred embodiment of the present invention, the interface 184 is operable to connect the two air flow channels 172C so that the two air flow channels 172C are in communication with the gasbag 122C and the additional gasbag 123C respectively. That is, after the connecting device 17C is connected to the controlling device 16C and the interface 184C, the controlling device 16C is operable to control the gasbag 122C to inflate or deflate, and to control the additional gasbag 123C to inflate or deflate. In other words, the controlling device 16C is capable of controlling the health-regain device of the present invention through the connector. It is worth to mention that electrical power is provided through the interface 184C. In another alternative embodiment, the battery is placed into the receiving cavity 182C to supply electrical energy. The interface 184C may be provided elsewhere in the base 18C.

The base 18C further has a curved surface, which is a bevel. The surface is close to the end of the health-regain environmental former 11C at a higher end than the end of the health-regain environmental former. Preferably, the base 18C is centrally symmetrical. Specifically, the base 18C has a symmetry axis with the central axis, and the two sides of the center axis are symmetrical. The middle of the base 18C is lower than the both ends of the base. It is worth to mention that the base 18C, the additional health-regain environmental former 14C and the central axis of the health-regain environmental former 11C coincide. Preferably, the additional health-regain environmental former 14C is axially symmetrical. The central axis of the additional health-regain environmental former 14C is an axis of symmetry. The health-regain environmental former 14C is axially symmetrical. The central axis of the additional health-regain environmental former 14C is an axis of symmetry. Preferably, when the user is using the health-regain device of the present invention, the base 18C may contact to the used shoulder. The health-regain device can also be used for the user's waist.

Figure 41:
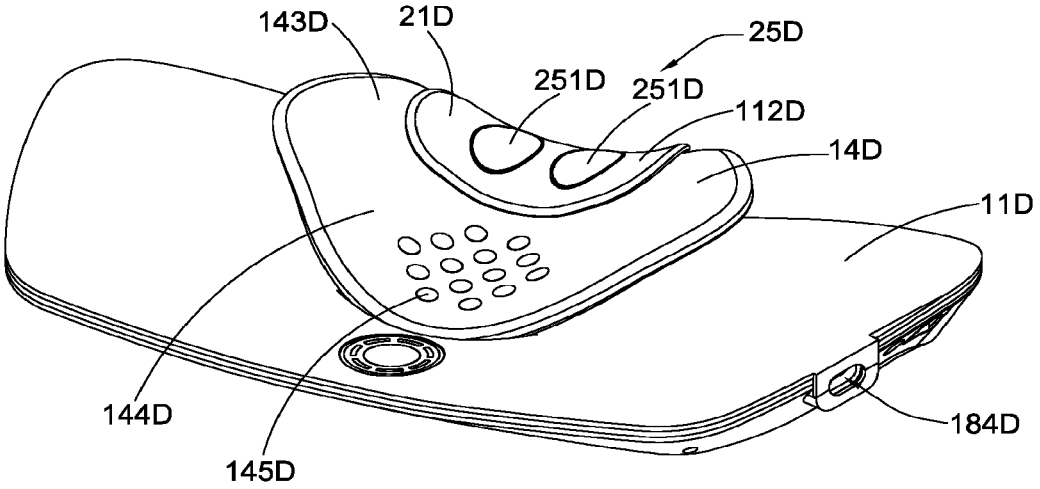
FIG. 41 is a perspective view of the health-regain device according to the above preferred embodiment of the present invention.
Figure 53:
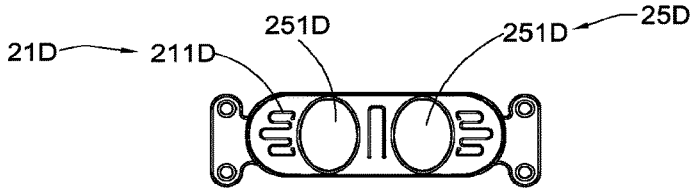
FIG. 53 is a perspective view of the center housing of the health-regain device according to the above preferred embodiment of the present invention.

FIG. 41 is a health-regain device according to another preferred embodiment of the present invention. The preferred embodiment is preferably used to the cervical spine of the user. The health-regain device comprises a center housing body 112D and a second adjusting device 229D, and the second adjusting device 229D is provided at the bottom of the center housing body 112D, and the second adjusting device 229D for driving the center housing body 112D provides reciprocation to provide health-regain to the user's cervical spine. The health-regain device of the invention further comprises a heat source 21D, which the heat source 21D is provided in the center housing body 112D. Preferably, the heat source 21D is disposed on the top of the center housing body 112D. When the second adjusting device is driving the center housing 229D lifting, the heat source 21D is lifted with the center housing body 112D, so that the heat source 21D gets fit the user's skin. Preferably, the heat source 21D is driven to be better conforming to the user's skin. The health-regain device of the invention further comprises a low-frequency device 25D. The low frequency device 25D is disposed on the surface of the center housing body 112D. The second adjusting device 229D is driven by the second adjusting device 229D. The low-frequency device 25D is further fit to the skin of the user. The low-frequency device 25D further comprises at least two low frequency elements 251D. The two low frequency elements 251D are placed on the top surface of the center housing body 112D. Preferably, the two low frequency elements 251D are axisymmetric. Specifically, the two low frequency elements 251D have a central axis as an axis of symmetry. Furthermore, the lighting device 23D may also be disposed on the top of the center housing body 112D. The lighting device 23D provides light. In an embodiment, the lighting device 23D is disposed at the low frequency elements 251D. As in FIG. 48 and FIG. 53, the heat source 21D further comprises at least one heating element 211D and a protective layer 27D. The protective layer 27D covers the heating element 21 ID to prevent the user from directly contacting the heating element 221D to protect the user. Furthermore, the protective layer 27D can conduct heat. That is, the heat generated by the heating element 21 ID can propagate through the protective layer to expand the range affected by the heat. The heating element 21 ID is disposed at one side of the low frequency element 251D. Preferably, the heating element 21 ID is disposed outside the low frequency element 251D. In the preferred embodiment, the heat source 21D comprises the two heating elements 211D. The two heating elements 211D are disposed in an axisymmetric manner.

Figure 48:
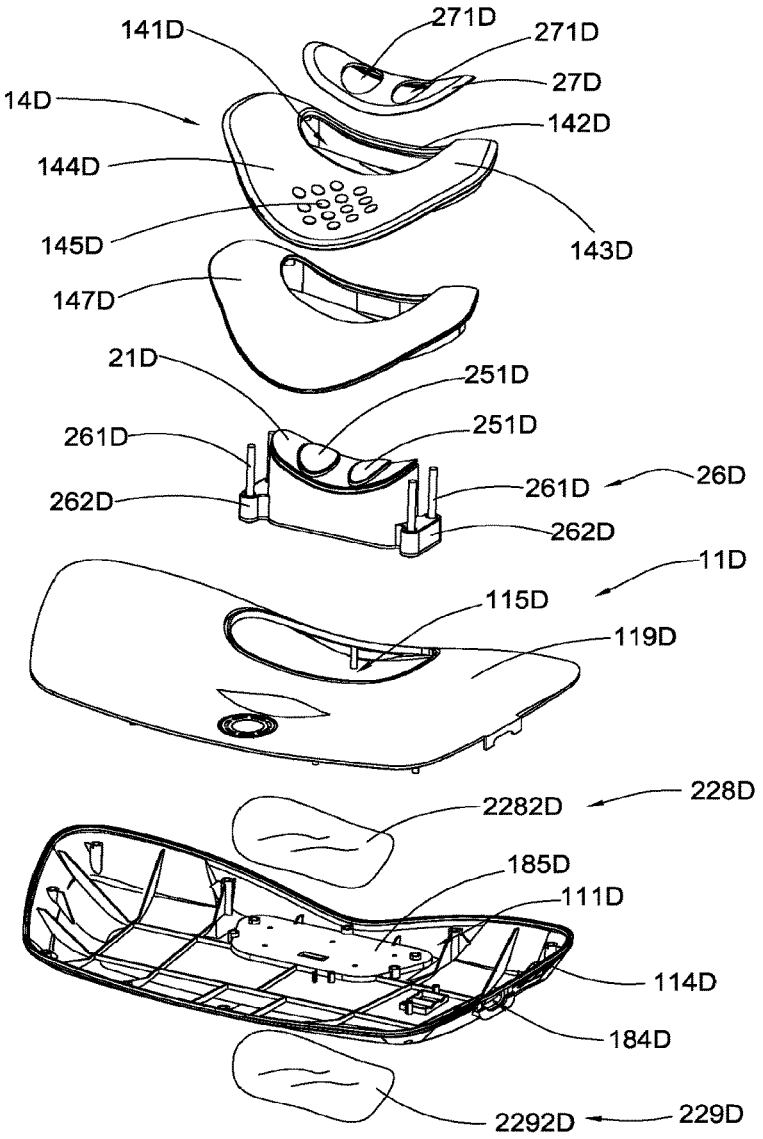
FIG. 48 is an explosive view of the health-regain device according to the above preferred embodiment of the present invention.

As shown in FIG. 48, the health-regain device of the present invention further comprises a limiting device 26D. The limiting device 26D is used to define the moving direction of the center housing body 112D. By the limiting device 26D limits the center housing body 112D along the movement by the limiting device 26D during lifting. The center housing body 112D is prevented from moving horizontally during lifting to affect health-regain benefits. The limiting device 26D further comprises at least two limiting portions 261D and at least two sleeve jointer 262D. The sleeve jointers 262D are disposed inside the limiting portions 261D. The edge of the sleeve jointers 262D are connected to one side of the center housing body 112D. The second adjusting device 229D drives the center housing body 112D to reciprocate. As the center housing body 112D is in reciprocation, the sleeve jointers 262D move along the limiting elements 261D to reciprocate. The limiting device 26D further comprises at least two limiting elements 261D which are provided at the periphery of the center housing body 112D. That is, each of the limiting elements 261D is around the periphery of the center housing body 112D. Preferably, the two limiting elements 261D are disposed on the diagonal lines of the center housing body 112D.

Figure 49:
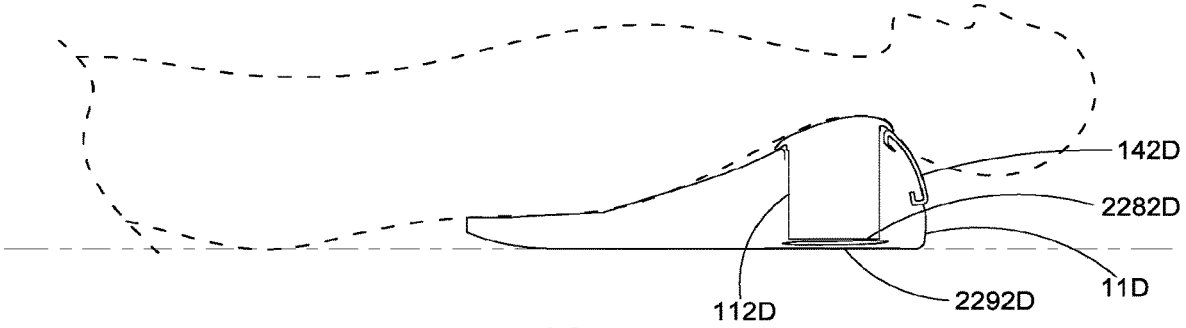
FIG. 49 to FIG. 52 are illustrated applications of the health-regain device according to the above preferred embodiment of the present invention.
Figure 50:
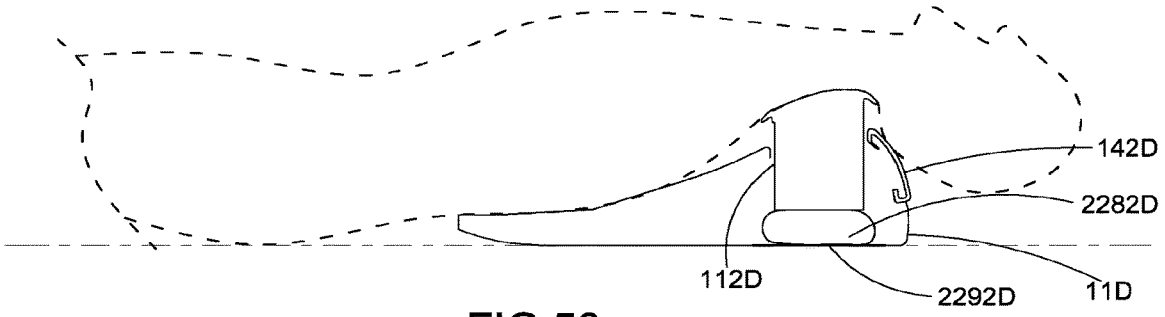
Figure 51:
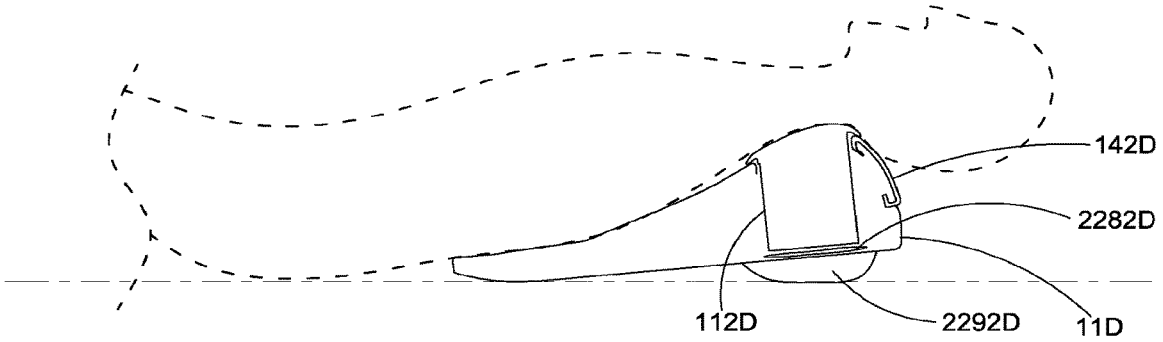
Figure 52:
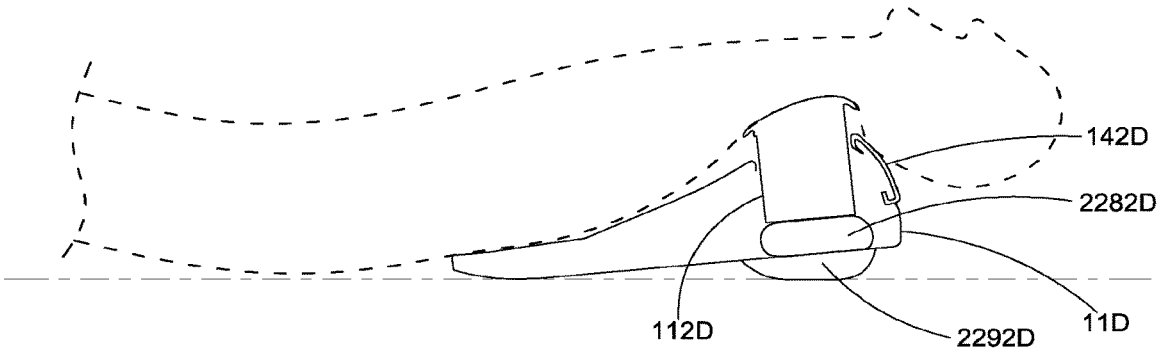

The health-regain device of the invention further comprises a first housing 11D, the center housing 12D is set in the first housing 11D. The first housing 11D further has a receiving cavity 111D and a limiting opening 115D. The receiving cavity 111D is communicated with the outside of the first housing 11D through the limiting opening 115D. The center housing 11D is placed in the receiving cavity 111D through the limiting opening 115D. The second adjusting device 229D is placed in the receiving cavity 111D. It is worth mentioning that the center housing 11D is not limited to the positions, but preferably the second adjusting device 229D is aligned to the center housing 11D. The limiting device 26D is placed in the receiving cavity 111D. The limiting device 26D is fixed to the inner bottom of the first housing 11D. That is, each of the limiting elements 112D is placed in the receiving chamber 111D. Each of the limiting elements 112D is fixed to the inner bottom of the first housing 11D. During reciprocation of the center housing body 112D, the center housing body 112D is limited by the limiting device 26D, to have vertical movement in the limiting opening 115D. That is, the limiting device 26D limit movement of the center housing body 112D in the horizontal direction. As shown in FIG. 49, in a preferred embodiment of the present invention, the limiting opening 115D is disposed at a side of the first housing 11D in order to make the health-regain device more suitable for the user's neck. The center housing body 112D is also placed in one side of the first housing 11D such that the center housing body 112D is adapted to bow to the neck of the user. And the first housing 11D provides support for the entire neck. In order to adapt to the human body's physiological curve of the neck, in the first housing 11D, the side where the limiting opening 115D is disposed is higher than the side away from the limiting opening 115D. Furthermore, the side where the limiting opening 115D is disposed gradually decreases toward the side far away from the limiting opening 115D. That is, the top surface of the first housing 11D is a bevel to fit the physiological curve of the neck of the human body. As shown in FIG. 48, preferably, the limiting port is disposed in the middle of the first housing 11D. The first housing 11D further comprises a fastening portion 185D. The fastening portion 185D is disposed in the bottom portion of the first housing 11D. The limiting device 26D is fixed to the fastening portion 185D. The center housing body 112D is aligned with the fastening portion 185D.

Figure 54:
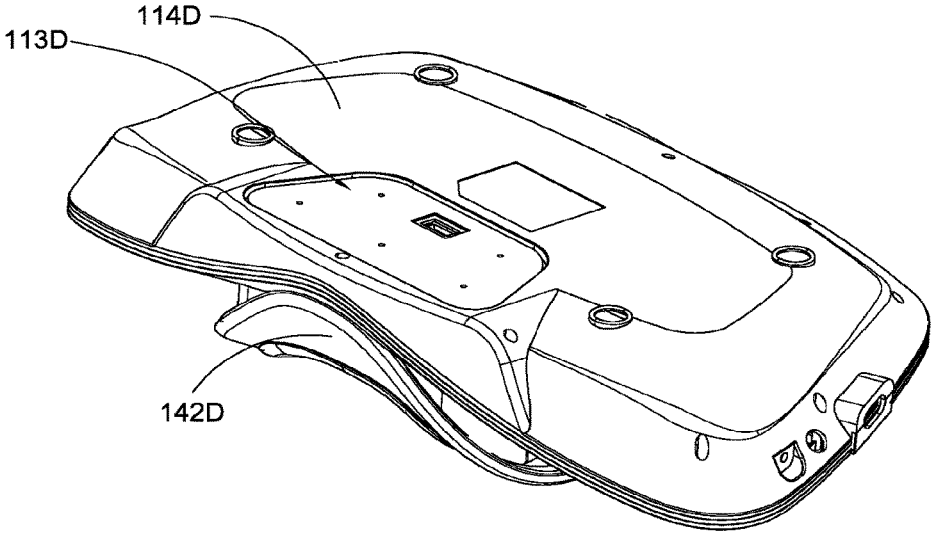
FIG. 54 is a perspective view of the health-regain device according to the above preferred embodiment of the present invention.

As shown in FIG. 54, the outer bottom of the first housing 11D further has an adjusting device receiving cavity 113D. The health-regain device of the invention further comprises a first adjusting device 228D. The first adjusting device 228D is fixed to the adjusting device receiving cavity 113D. The first adjusting device 228D drives the first housing 228D to reciprocate. It is worth mentioning that the adjusting device receiving cavity 113D aligned with the fastening portion 185D. Preferably, the other side of the fastening portion 185D serves as the bottom of the adjusting device receiving cavity 113D. In such manner, the second adjusting device 229D aligned with the first adjusting device 228D. In this way, the first adjusting device 228D changes a driving force, generated by first adjusting device 228D, can be transmitted more quickly to the second adjusting device 229D, such that the second adjusting device 229D has a faster response. That is, the first adjusting device 228D and the second adjusting device 229D cooperate to provide more driving rhythm.

Figure 47:
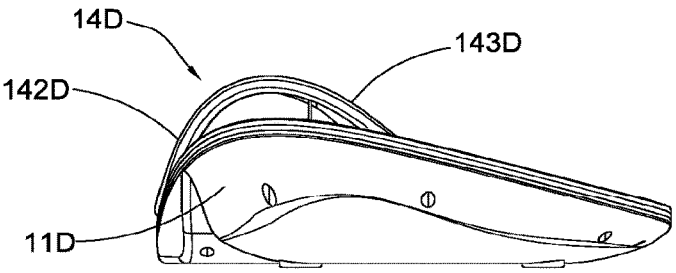
FIG. 47 is a side view of the health-regain device according to the above preferred embodiment of the present invention.

As shown in FIG. 48, the health-regain device further comprises an additional housing 14D. The additional housing 14D is fixed to the top of the first housing 11D. The additional housing 14D further has a limiting channel 141D. The limiting channel 141D is aligned with the limiting opening 115D. Preferably, the center housing body 112D in the initial state, the top surface of the center housing body 112D is higher than the surface of the additional housing 14D. In FIGS. 47 and 48, the additional housing 14D further comprises a head supporting portion 142D and a supporting a neck portion 143D. The head supporting portion 142D and the neck supporting portion 143D are surrounding the limiting channel 141D. That is, the head supporting portion 142D is connected to the neck supporting portion 143D to form the limiting channel 141D. The neck supporting portion 143D having a neck supporting surface 1431D. The neck supporting portion 143D is gradually reduced from near one end of the limiting channel 141D to away from the end of the limiting channel 141D, which is adapted to support the user's neck. That is, the neck supporting portion 143D further having a neck supporting surface 1431D, wherein the neck supporting surface 1431D is a bevel. An end of the head supporting portion 142D closed to the limiting channel 141D is lowered toward an end far away from the limiting channel 141D to be suitable for supporting the head of the user. It is worth mentioning that, the user's head contacts the head supporting portion 142D, and the head supporting portion 142D is balanced the weight of the head to support the user. As shown in FIG. 49 to FIG. 52, as the second adjusting device 229D for driving the center housing body 112D lifting, the center housing body 112D pushes the user's neck to lift. When the user's head away from the head supporting portion 142D, by the head of the gravity of the user is directly applied to the user's neck. And the center housing body 112D serves as a fulcrum. In the way, the user's cervical vertebra is stretched to increase the space between adjacent two cervical spines. During dropping center housing body 112D, the user's neck is dropped with the center housing body 112D. The user's head is contact with the head supporting portion 142D, and the head supporting portion 142D is balancing the weight of the user's head. In such manner, the user's cervical spine is relaxed for facilitating the user's cervical spine to return to the physiological curve. The center housing body 112D is reciprocated in the limiting channel 141D. That is, the center housing body 112D is surrounded by the neck supporting portion 143D and the head supporting portion 142D such that the center housing body 112D becomes center of the neck supporting portion 143D and the head supporting portion 142D. That is, the center housing body 112D does not limit the position of the center housing body 112D. Furthermore, the center housing body 112D is disposed at a side of the first housing 11D. Preferably, the center housing body 112D is disposed on a side of the first housing 11D close to the head, so that the head supporting portion 142D provides support to the user's head more effectively.

The additional housing 14D further comprises at least one additional heat source 144D. The additional heat source 144D is provided on the surface of the additional housing 14D. More specifically, the additional heat source 144D is disposed on the head supporting portion 142D and the neck supporting portion 143D. The additional heat source 144D can work cooperatedly with the heat source. The additional housing 14D further comprises at least one additional light source 145D. The additional light source 145D is provided on the surface of the additional housing 14D. More specifically, the additional light source 145D is disposed on the surface of the head supporting portion 142D and/or the surface of the neck supporting portion 143D. The additional housing 14D further comprises at least one additional low-frequency device146D, and the additional low frequency device 146D is disposed on the surface of the additional housing 14D. Specifically, the additional low frequency device 146D is disposed on the surface of the neck supporting portion 143D and/or the surface of the head supporting portion 142D. In another preferred alternative embodiment, the additional housing 14D further comprises an additional supporting frame 147D. The additional heat source 144D, the additional light source 145D and the additional low frequency device 146D are disposed on top of the additional supporting frame 147D. That is, the additional light source 145D, the additional low-frequency device 146D and the additional heat source 144D form an additional environmental forming layer 148D to cover the top of the additional supporting frame 147D. That is, the limiting channel 141D further comprises a first limiting channel 141 ID and a second limiting channel 1412D. The first limiting channel 141 ID is provided in the additional environmental forming layer 148D. The second limiting channel 1412D is provided to the additional supporting frame 147D. The first limiting channel 141 ID is aligned with the second limiting channel 1412D to form the limiting channel 141D.

Figure 56:
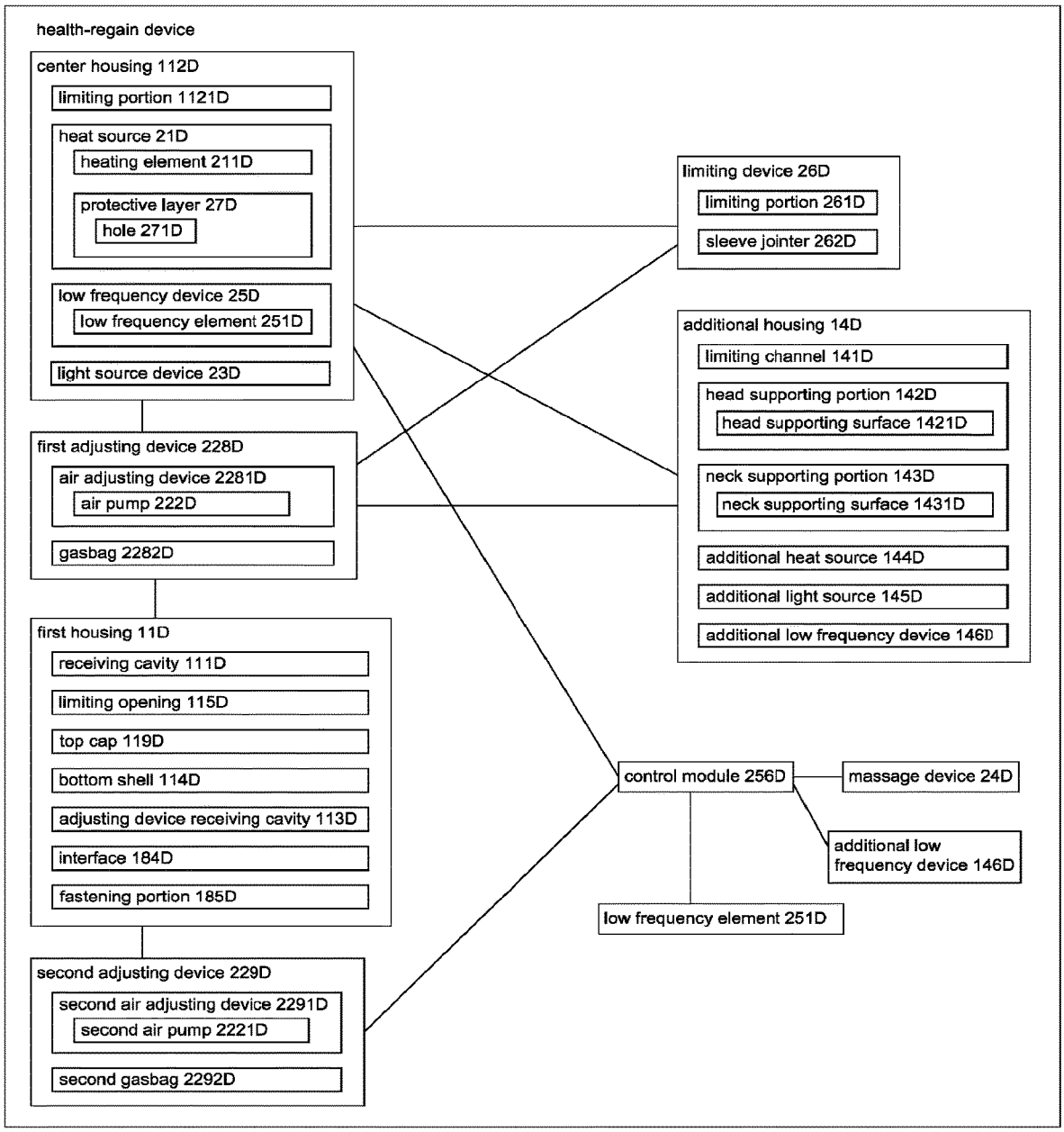
FIG. 56 is a block diagram of the health-regain device according to the above preferred embodiment of the present invention.
Figure 57A:
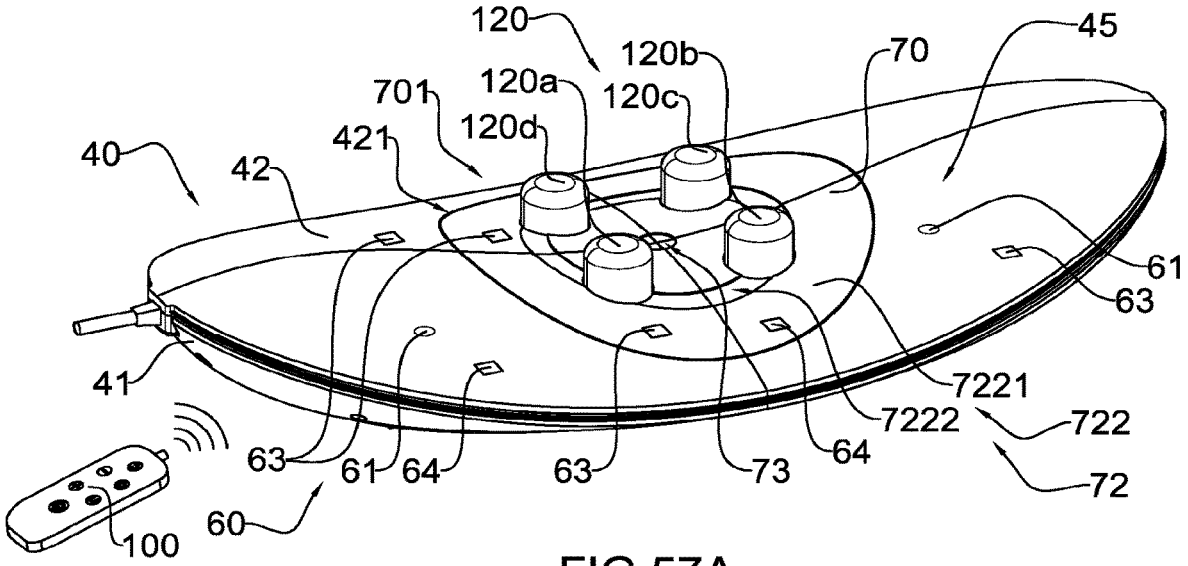
FIG. 57A is a perspective view of a health-regain device according to the above preferred embodiment of the present invention.
Figure 57B:
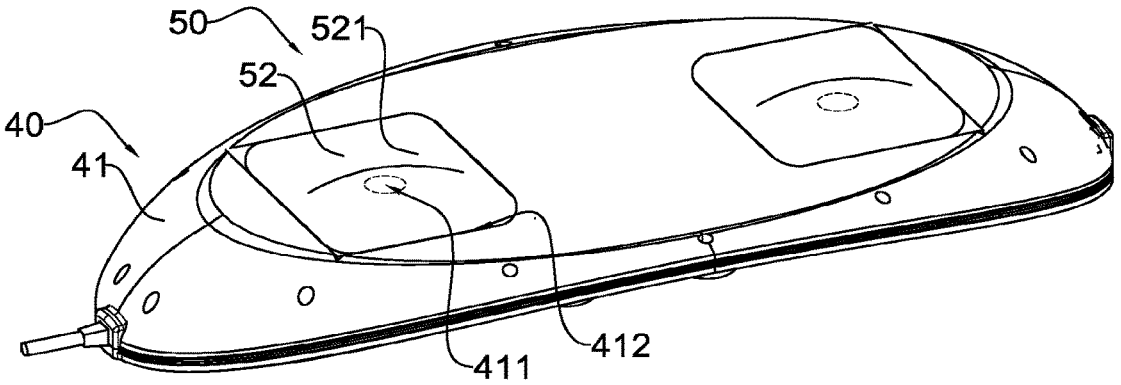
FIG. 57B is a perspective view from another angle of the health-regain device according to the preferred embodiment of the present invention.

As shown in FIG. 56, the present invention health-regain device further comprises at least one control module 256D, respectively, the control module 256D is communicatively connected to the first adjusting device 228D, the second adjusting device 229D, the heat source 21D, the low frequency device 25D, the lighting device 23D, the additional heat source 144D, the additional light source 145D, the additional low frequency device 146D. The control module 256D controls the first adjusting device 228D, the second adjusting device 229D, the heat source 21D, the low-frequency device 25D, the lighting device 23D, the additional heat source 144D, the additional light source 145D and the additional low frequency means 146D to work cooperatedly.

As shown in FIG. 42 to FIG. 45, the control module 256D controls the second adjusting device 229D drives the center housing body 112D to reciprocate. Furthermore, the control module 256D controls the second adjusting device 282D to drive the center housing body 112D rhythmically reciprocated, so that the user's cervical spine is doing bending health. Specifically, when the user uses the health-regain device, the health-regain body of the user is lying on the device. The user's neck contacts with the center housing body 112D. That is, the center housing body 112D is supporting the user's neck 112D. The center housing body 112D having a limiting portion 1121D. The limiting portion 1121D is provided on the top of the center housing body 112D on the top. The both ends of limiting portion 1121D is higher than the central of limiting portions 1121D, which is adapted to limit the user's neck. Preferably, the limiting portion 1121D matches neck curve of the center housing body 112D. The neck supporting portion 143D assists the center housing body 112D for supporting the user's neck. The neck supporting surface 1431D is a curved surface, which is adapted to fit the user's neck. The head supporting portion 142D assists supporting the head of the user. The head supporting surface 1421D is a curved surface to form a head portion defining a limiting position of the head. The control module 256D controls the second adjusting module 228D to drive the center housing body 112D lifting. In the center housing body 112D, as lifting, the bending of the cervical spine of the user gradually increased. In other words, the gap between two adjacent cervical increases. The control module 256D controls the second adjusting module 228D to reduce the driving force to cause the center housing body 112D dropping. The center housing body 112D is dropped so that the user's cervical spine bending is decreased. In other words, the gap between two adjacent cervical vertebrae gradually reduced. The control module 256D controls the second adjusting device 229D change the drive force which provides to form a rhythmic drive of the center housing body 112D, by changing the rhythm of the center housing body 112D applied to the user's neck to change the bending of the cervical spine of the user. In such a way to relax the user's cervical spine benefits physiological cervical curve.

The control module 256D controls the first adjusting device 228D drives the first housing. 11D reciprocate. Furthermore, the control module 256D controls the first adjusting device 228D drives the first housing. 11D driven to drive the rhythm of the center housing body 112D reciprocate. Specifically, the first adjusting device 228 drives the first housing 11D lifting to increase the user's cervical spine bowing. The second adjusting device drives the first housing 11D dropped so that the bending of the cervical spine of the user decreases. The control module 256D drives the first housing 11D to reciprocate rhythmically by controlling the first adjusting device 228D, so that the neck of the use of the relaxed, and the user gets returned to physiological cervical curve.

It is worth mentioning that the control module 256D controls the first adjusting device 228D and the second adjusting device 229D working cooperatedly. That is, the control module 256D respectively controls the first adjusting device 228D and the second adjusting device 229D driving rhythmically to form the rhythm of the health-regain device of the invention to adjust the cervical spine bowing. Specifically, the control module 256D controls the second adjusting device 229D lifting to adjust the initial position of the first housing 11D. The control module 256D controls the second adjusting device 229D rhythmically driving the center housing body 112D to reciprocate. The control module 256D provides another controlling mode. The control module 256D controls the first adjusting device 228D to drive the first housing 11D lifting. Meanwhile, the control module 256D controls the second adjusting device 229D drives the center housing body 112D lifting. The control module 256D provide another controlling mode. The control module 256D controls the first adjusting device 228D reduces the driving force for the first housing 11D dropping. Meanwhile, the control module 256D controls the second adjusting device 229D drives the center housing body 112D lifting, which forms a rhythm. The control module 256D provides another controlling mode. The control module 256D controls the first adjusting device 228D driving the first housing 11D lifting. Meanwhile, the control module 256D controls the second adjusting device 229D to reduce the driving force to cause the center housing body 112D lowered, in such a manner as to form another rhythm. The control module 256D controls provide another controlling mode. The control module 256D controls the first adjusting device 228D reduces the driving force to drop the first housing 11D. Meanwhile, the control module 256D controls the second adjusting device 230D to reduce the driving force to cause the center housing body 112D dropping. In the manner of forming another rhythm, the control module 256D controls the first adjusting device 228D rhythm by increasing or decreasing the driving force of the driving force to adjust the rhythm of adjusting the first housing 11D by driving the driving force. The control module 256D controls the second adjusting device 229D rhythm increasing or decreasing the driving force of the rhythm, and the rhythm forms by adjusting the driving force of adjusting the center housing body 112D. Furthermore, the control module 256D control cooperatedly the rhythm of the drive force of the first adjusting device 228D and the second adjusting device 229D to provide a reciprocating rhythm of the center housing body 112D.

In one embodiment of the invention, the first adjusting device 228D further comprises an air adjusting device 2281D and a gasbag 2282D. The air adjusting device 2281D is communicated with the gasbag 2282D. The air adjusting device 2281D inflates to the airbag 2282D so that the airbag 2282D is expanded for providing a driving force. The air adjusting device 2281D evacuates to the airbag 2282D so that the gasbag 2282D get reduced for reducing the driving force. The air adjusting device 1121D is communicatively connected with the control module 256D. The gasbag 2282D provides a driving force to drive the first housing 11D to reciprocate. The control module 256D controls the air adjusting device 2281D. Preferably, the air adjusting device 2281D may be implemented as a pump 222D. The control module 256D communicatively connected with the pump 222D, to control the pump 222D of the gasbag 2282D inflated or evacuated. The second adjusting device 229D further comprises a second air adjusting device 2291D and a second gasbag 2292D. The second air adjusting device 2291D is communicated with the second gasbag 2292D. The second air adjusting device 2291D inflates to the second gasbag 2292D so that the second gasbag is inflated for generating a driving force for driving the center housing body 112D lifting. The second air adjusting device 2291D evacuates the second gasbag 2292D gas, so that the second gasbag 2292D decreases the center housing body 112D as the second gasbag 2292D decreasing. Preferably, the second air adjusting device 2291D may be implemented as a second pump 2221D. The control module 256D communicatively connected with the second pump 2221D. The second pump 2221D is communicated with the second gasbag 2292D. The second pump 2221D inflates or evacuates the second gasbag 2292D. The control module 256D is communicatively connected with the second pump 2221D. It is worth mentioning that the second gasbag 2292D may be communicated to the air adjusting device 2281D. That is, the control module 256D controls the air adjusting means 2281D to be capable of adjusting air he gasbag 2282D and the second gasbag 2292D.

It is worth mentioning that the control module 256D by the control of the heat source 21D, the lighting device 23D, and/or the low-frequency device 25D forms a health-regain environment. Specifically, the control module 256D by controlling the heat source 21D adjusts temperature in the center housing body 112D, to form a thermal environment by the heat source 21D. That is, the health-regain environment includes the thermal environment. The control module 256D adjusts temperature of the heat source 21D, so that the surface temperature of the center housing body 112D changes, which is suitable for bending health-regain. In the cervical spine bending health-regain. For example, after the user lying on the health-regain device, the user's neck contacts with the center housing body 112D. That is, the user's neck is supported by the center housing body 112D. The control module 256D controls the heat source 21D to adjust the temperature. The heat source 21D the temperature of the neck of the user is increased, so that the user's neck reciprocates. The temperature of the neck of the user is increased, so that the neck muscles of the user relaxes. Especially in the case of cold weather, furthermore, before the user using the health-regain device, the control module 256D controls the heat source 21D adjust the temperature. Furthermore, the heat source 21D effects temperature of the center housing body 112D near environment temperature. When the user enters the neck health-regain environment, health-regain environment that makes the user feel comfortable. Furthermore, the health-regain temperature makes the temperature of the user neck increased, so that the neck muscles of the user is adapted to the bending of health to prevent injury of the user's neck muscles. It is worth mentioning that the control module 256D further controls the additional heat source 144D, by controlling the heat source to the additional 144D to assist the formation of health-regain environment. The additional heat source 144D can increase the range of the health-regain environment. Furthermore, the additional heat source 114D accelerates rate of the elevated temperature of the environment health-regain. That is, the control module 256D controls the heat source 21D, and the additional heat source 114D for adjusting the temperature to form the health-regain environment.

The control module 256D further controls the lighting device 23D to provide illumination for forming a luminous environment. That is, the health-regain device further comprising a lighting device 23D. Specifically, the user's neck is placed on the center housing body 112D after the lighting device 23D to provide illumination of the neck skin of the user for providing the light in a luminous environment. Furthermore, the control module 256D controls the additional light source 145D provide illumination. By the additional light source 145D, the health-regain environment in which the illumination rate is increased. That is, the irradiation range of the user's neck skin is increased, which leads more neck skin being illuminated.

The control module 256D controls the low-frequency device 25D generates a low frequency electrical stimulus to the wearer's skin irritation. That is, the health-regain environment further provides a low-frequency environment. Furthermore, the control module 256D controls the second adjusting device 229D drives the center housing body 112D lifting, so that the low-frequency device 25D contacts to the neck skin of the user. The low-frequency device 25D gets more fitting to the user's skin, and the low-frequency device 25D gives the user's health-regain body better low frequency. The control module 256D controls the additional low frequency device 146D. The additional low frequency device 146D assists the low-frequency device 25D provide low-frequency health-regain. The control module 256D controls the first adjusting device 228D drives the first housing 11D lifting. The additional housing 14D also lifts as the first housing 1 ID lifting so that the additional low frequency device 146D fit well to the user's neck.

The health-regain device of the invention further comprises a massage device 24D, and the massage device 24D is provided on the first housing 11D. Preferably, the massage device 24D is provided in the receiving cavity 111D. The massage device 24D is communicatively connected with the control module 256D. The control module 256D controls the massage device 24D. Preferably, the massage device 24D is embodied as a vibration motor. The massage device 24D provide a massage environment.

As shown in FIG. 56, the health-regain of the present invention further comprises a detecting module 257D. The detecting module 257D is communicatively connected with the center housing body 112D. The detecting module 257D is communicatively connected with the control module 256D. The detecting module 257D detects to the user's neck is placed on the center housing body 112D, the detecting module 257D generates a message. The detecting module 257D transmits the activation information to the control module 256D. The control module 256D controls the heat source 21D to adjust the temperature of the health-regain environment. The control module 256D controls the low-frequency device 25D to provide the low-frequency health-regain environment. The control module 256D controls the lighting device 23D to provide illumination in the health-regain environment. Furthermore, the control module 256D controls the massage device 24D to provide the massage health-regain environment.

The detecting module 257D is respectively connected with the heat source 21D, the low-frequency device 25D, the lighting device 23D and the massage device 24D. The detecting module 257D detects the heat source 21D, the low-frequency device 25D and the lighting device 23D respectively the thermal data, the low frequency data and the optical data. The control module 256D adjusted the heating device 21D by the heat source data. The control module 256D adjusted the low frequency which is controlled by the low-frequency data. The control module 256D adjusted the lighting device 23D through the optical data.

The detecting module 257D is further communicatively connected respectively to the additional heat source 144D, the additional lighting source 145D, the additional low frequency device 146D. The detecting module 257D respectively monitors the additional heat source 144D, the additional low frequency device 146D and the additional lighting source 145D, for the additional thermal data, the additional low frequency data and the additional optical data. The control module 256D adjusts the additional heat source 144D with the additional data. The control module 256D adjusts the additional low frequency adjusting device 146D according to the additional low-frequency data. The control module 256D controls the additional lighting source 145D in accordance with the additional data.

Figure 55:
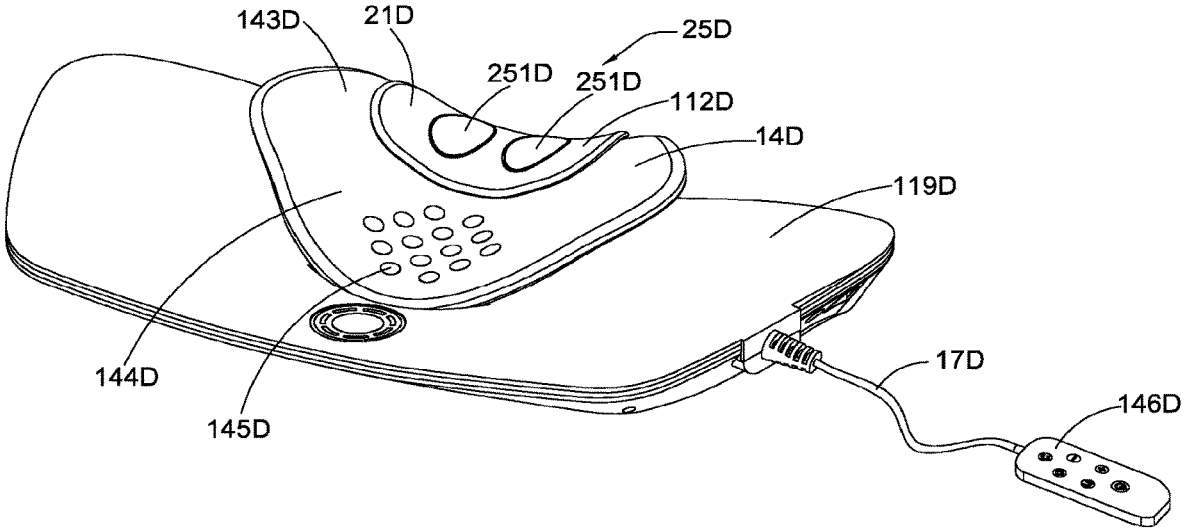
FIG. 55 is a perspective view of the health-regain device according to the above preferred embodiment of the present invention.

As shown in FIG. 55, the health-regain device further comprises a controlling device 16D, and a connector 17D. The controlling device 16D is connected with the connector 17D. The connector 17D comprises at least one electrical connector 171D and at least one air flow channel 172D. The electrical connector 171D is electrically connected with the heat source 21D, the low-frequency device 25D, the lighting device 23D, the additional heat source 144D, the additional low frequency device 145D. The controlling device 16D is communicatively connected with the control module 13D. The controlling device 16D supplies power respectively to the heat source 21D, the low-frequency device 25D, the lighting device 23D, the additional heat source 144D and the additional low frequency device 145D with the control module 13D. The air flow channel 172D is communicated with the second gasbag 2292D. The control module 13D is communicatively connected with the second air adjusting device 2292D. The controlling device 16D communicates to the air flow channel 172D. The controlling device 16D controls the second gasbag 2292D through the air flow channel 172D to inflate and deflate gas. Like controlling the second air adjusting device 2282D evacuated gas to the second gasbag 2292D. Preferably, the second air adjusting device 2292D is provided in the controlling device 16D. The second air adjusting device 2282D inflates to the second gasbag 2292D through the air flow channel 172C for the second gasbag 2292D driving the center housing body 112D. The second air adjusting device 2292D extracts the second gasbag 2292D through the air flow channel 172D air to reduce provided driving force.

The second air adjusting device 2292D is provided on the controlling device 16D, and it can reduce noise generated by air adjusting device 121D, so that the health-regain environment has a relatively quiet environment. The connecting member 17D further comprises another air flow channel 172D. The air flow channel 172D is communicated with the gasbag 2282D. The other air flow channel 172D is communicated with the air adjusting device 2281D. The controlling device 16D controls the air adjusting device 2281D by the other air flow channel 172D adjusting gas volume of the gasbag 2282D. Specifically, the controlling device 16D controls the air adjusting device 2281D by the other air flow channel 172D to the gasbag 2282D supplying air to the gasbag 2282D for providing the driving force for the first housing 1 ID lifting. The controlling device 16D controls the air adjusting device 2281D extracted from the gasbag 2282D through the other air flow channel 172D to reduce driving force provided by the gasbag 2282D such that the first housing 1 ID dropped.

The first housing 11D further comprises an interface 184D, which is disposed on the first housing 184D. Preferably, the interface 184D is disposed on the side of the first housing 184D. The interface 184D is used to connect the connector 17D. That is, the controlling device 16D via the connector 17D accesses with interface 184D. The interface 184D to provide electrical connection and air connection. Specifically, the electrical connector 171D and the air flow channel 172 of the connector 17D are respectively connected to the interface 184D. The interface 184D is respectively electrically connected with the heat source 21D, the low-frequency device 25D, the lighting device 23D, the additional heat source 144D and the additional low frequency device 145D. In a preferred embodiment of the present invention, the interface 184D is connected both of the air flow channel 172D, such that the two air passages 172D is communicated with the gasbag 22822D and the second gasbag 2292D. That is, the connector 17D connected respectively with the control means 16D and the interface 184D so the controlling device 16D is controlling the gasbag 2282D to be inflated or deflated, and the additional gasbag 2292D inflated or deflated. That is, the controlling device 16D is capable of controlling the health-regain device of the present invention through the connector 17D. In one embodiment, the electrical power is supplied through the interface to the power source 21D, the low-frequency device 23D, the lighting device 23D, the additional heat source 144D, the additional lighting source 145D, the additional low frequency device 146D and the additional massage device. It is worth mentioning that the first housing 11D and the receiving cavity 111D are designed to store the battery, so that the battery can provide power. That is, the health-regain device of the present invention can be supplied by electrical power. The device can also be used for user's waist.

Referring to FIG. 57A to FIG. 59 of the present invention, a health-regain device of another preferred embodiment is disclosed and set forth in the following description, wherein the health-regain device comprises a health portion 40 and a driving portion 50, wherein the driving portion 50 is provided in the health portion 40, wherein the driving portion 50 can drive the health portion 40 to reciprocate for a user to provide health-regain. For example, the driving portion 50 can be by driving the health portion 40 provided bending health-regain to reciprocate the position of the user's waist or neck and the like.

Preferably, the driving portion 50 can be intermittently driving the health portion 40 to be reciprocated, so that the driving portion by 50 rhythmically drives the health portion 40. More preferably, the driving portion 50 is provided in the side of the health portion 40. For example, the driving portion 50 is provided in the health portion 40 lower place, so that when the position of the user's waist or the like abuts against above the neck health portion 40, the driving portion 50 can be below the health portion 40 to drive the health portion 40 reciprocated rhythmically to the user waist or neck of health. Specifically, when a user is in use of the health-regain device, the user may lie on health-regain device 40 with abuts against a portion of the health-regain 40 above, or may be back against the health portion 40 of the health-regain device upward to be against the health portion 40.

It is worth mentioning that, when the user uses the health-regain device, the body portion of the user contacts with the health portion 40 of the health-regain device is defined by a user's health-regain body, such as the body position of the user's waist, or neck, etc. It is also worth mentioning that the bending health-regain of in the present invention is referred to means intermittently adjusting force acting to relax the two adjacent vertebrae. Preferably, the bending health-regain is applied for the lumbar spine, which the adjacent lumbar spine is under rhythmical adjusting force for the lumbar getting relaxation. The bending health-regain is also used in cervical spine, which the cervical spine is under rhythmically adjusting force on the two adjacent cervical for relaxation. Of course, one skilled in the art will understand that the health-regain device may be for other parts of the body of the user to for health-regaining, which the health-regain device in the present invention is not limited in the position.

In the following description, the health-regain device is for the waist of a user to do health-regain. For example, which is illustrated the present invention, the user may lie on the health portion 40 of the health-regain device for using, and the health portion 40 of the health-regain device is supporting the waist of the user. And under normal situations, the driving portion 50 of the health-regain device is contacted with the bed. Nevertheless, one skilled in the art will understand that when a user in sitting posture is using the health-regain device, the driving portion 50 of the health-regain device may be in contact with the backrest or the seat of the sofa. The driving portion 50 intermittently drives the health portion 40, so that the adjusting force provided by the health portion 40 is intermittently provided on the user's waist. Specifically, the driving portion 50 drives the health portion 40 for acting force applied to the waist of a user. For example, the driving portion 50 drives the health portion 40 for acting supporting force applied to the user's waist. With the driving portion 40 gradually increasing the drive force to apply a force to the user's waist, and the health portion 40 is driven to apply a force to the waist of the user and the force is increased gradually. When the driving force of the driving portion 50 is greater than the gravitational force by the waist of a user, the waist of a use can be lifted, so that the bending of the lumbar spine of the user increases. The driving force generated by the driving portion 50 can be adjusted, so that the driving portion 50 supply a driving force smaller than the gravity of the user's waist, the user's waist is dropped, so the bending of the lumbar waist of a user is reducing. By the driving portion 50 intermittently increasing the driving force and decreasing the driving force, the health portion 40 can be lifting and dropped intermittently, and the bending of the lumbar spine of the user can be intermittently increased and decreased, so that the waist of a user is under the bending health-regain.

It is worth mentioning that the driving portion 50 intermittently drives the health portion 40 means that the driving portion 50 changes to increase and decrease the driving force intermittently. In other words, by the driving portion 50 to adjust the driving force intermittently, the driving portion 50 can drive the health portion 40 reciprocating. Specifically, the driving portion 50, after completing the process of increasing the driving force, changes to reduce the driving force; accordingly, the driving portion 50, after completing the process of reducing the driving force, changes to increase the driving force.

It is also worth mentioning that, between the process increasing the driving force and reducing the driving force, the driving portion 50 further provides a process to maintain the driving force. That is, when the value of the increased drive force reaches a preset value, the driving portion 50 is maintained to provide the driving force to the health portion 40 supporting the waist of the user and maintain the waist of a preset period of time for keeping the bending of lumbar. Accordingly, after a preset period of time, the driving portion 50 reduces the driving force, and the health portion 40 height decreases, so that the bending of the lumbar spine of the user is reduced. Furthermore, the period of providing a driving force maintained by the driving portion 50 can be set, and the maximum value of driving force provided by the driving portion 50 can be set It is also worth mentioning that, in the process of increasing user's lumbar spine bending, two adjacent lumbar intervals are gradually increased, which is the user's lumbar get stretched. In other words, the role of the intermittent changes lumbar spine in force of enabling the user to gradually adapt to increased lumbar spine of two adjacent lumbar interval, it helps restore the user's lumbar physiological bending degrees. Similarly, the bending health-regain also applies to the cervical spine.

It is also worth mentioning that, as the driving portion 50 intermittently adjusts force, the driving portion 50 further controls the period, so that the intervals period forms rhythm. Furthermore, the driving portion 50 drives the conversion speed of the driving force controlling to form the rhythm. That is, the driving portion 50 controls to increase the driving force is converted to driving force to reduce the driving force to form the rhythm. Further, the driving portion 50 drives the driving force adjusting the speed to form the rhythm. Specifically, the driving portion 50 controls the speed of increasing and/or decreasing the driving force to form the rhythm. One skilled in the art will understand that by controlling the rhythm of the driving portion 50, the health portion 40 for reciprocation rhythm can also be easily controlled, and thus, the user's lumbar spine bending rhythm of the health-regain can also be easily controlled.

Specifically, referring to FIGS. 57A to 59, the driving portion 50 further comprises at least one fluid adjusting device 51 and at least one resilient covering 52, wherein each of the resilient cover 52 are disposed on bottom of the health portion 40, and each of edges of the resilient cover 52 is respectively sealingly connected with the bottom of the health portion 40, and the health portion 40 covers each of the elastic base 52 to form a fluid receiving cavity 521 therebetween, for containing a fluid, and the fluid adjusting device 51 is communicated with each of the fluid receiving cavity 521 to adjust fluid volume housed in the each of the fluid receiving cavity 521. For example, in the present invention, the example of the health-regain device, the fluid adjusting device 51 is embodied as an air adjusting device, each of the fluid receiving cavity 521 formed respectively between the bottom of the health portion 40 and each of the resilient covering material 52 is an air receiving portion, so that the fluid adjusting device 51 can adjust air volume accommodated in each of the fluid receiving cavity 521.

In the present invention, the example of the health-regain device, as an example the number of the resilient covering 52 is implemented as two, as following for easily set forth the content and features of the health-regain device. One skilled in the art will understand that, in the present invention, another possible example of the health-regain device, the number of the resilient covering 52 may also be implemented as one or three or more. Specifically, the resilient covers 52 are two, and two of the resilient coverings 52 are respectively provided spacedly at the bottom of the health portion 40. Preferably, the two resilient covering 52 are symmetrically disposed at the bottom of the health portion 40.

It is worth mentioning that, in the present invention, another example of the health-regain device, the resilient covering 52 has the fluid receiving cavity 521, and the fluid adjusting device 51 communicates with the fluid receiving cavity 521 of the elastic cover 52. That is, the fluid receiving cavity 521 may be formed between the elastic cover 52 and the health-regain device 40, which may be formed inside the resilient covering 52. In other words, the fluid receiving cavity 521 formed on the elastic cover 52 is an embodiment of the inside of the elastic cover 52 which is a gasbag. Preferably, the resilient covering 52 of the outer wall may be provided with a resilient protective layer for protecting the elastic cover 52, so that when the health-regain device is used, the elastic protective layer is in contact with the outside, and further by avoiding the flexible covering 52 directly contacting with the outside to avoid the resilient covering 52 from being damaged.

The health portion 40 of the health-regain device further comprises a receiving shell 41 and a top cap 42 and has a receiving cavity 43, wherein the top cap 42 is disposed in the receiving shell 41, to form the receiving cavity 43 between the top cap 42 and the housing shell 41. That is, the receiving cavity 43 is formed in the health portion 40. Preferably, each of the fluid receiving cavity 521 and the receiving cavity 43 are respectively formed on both sides the health portion 40 of the housing shell 41, and the fluid adjusting device 51 is provided in the receiving cavity 43 formed between the receiving shell 41 and the top cap 42, and the fluid adjusting device 51 is communicated with the receiving cavity 521 formed between the housing shell 41 and each of the resilient covering 52 for controlling by adjusting device 51 to adjust fluid volume in each of the fluid receiving cavity 521. That is, the edges of each of the resilient covering 52 is sealingly respectively connected with the housing shell 41 of the health regain portion 40 which each of the fluid containing section 521 is formed between each of the resilient covering 52 and the receiving shell 41.

The health portion 40 of the housing shell 41 has at least one through hole 411, wherein each of the through holes 411 is respectively communicated with the receiving cavity 43 and the fluid receiving cavity 521, so as to allow the fluid adjusting device 51 held in the receiving cavity 43 is communicated with the fluid receiving cavity 521 the through hole 411 in. Preferably, the receiving shell 41 has two symmetrical the through hole, and each of the through holes 411 respectively is communicated with the receiving cavity 43 and each of the fluid receiving cavity 521, for allowing the fluid adjusting device 51 held in the receiving cavity 43 is communicated with each of the receiving cavity 521 by the through holes 411, so that the fluid adjusting device 51 adjusts fluid volume housed in each of the fluid receiving cavity 521.

In particular, the fluid adjusting device 51 can add fluid to each of the fluid receiving cavity 521 such that each receiving cavity 521 is filled with fluid. Respectively, the fluid adjusting device 51 is capable of receiving fluid from each of the portion 521 to extract fluid, for discharging fluid from each of the fluid receiving cavity 521, for adjusting fluid volume of each of the fluid receiving cavity 521, for adjusting the driving force provided by the driving portion 50 to the health portion 40. For example, in the present invention, an example of the health-regain device, the fluid adjusting device 51 adjusts the air volume of each of the fluid receiving cavity 521 to adjust volume air of each of the fluid receiving cavity 521 to adjust air pressure of each of the fluid receiving cavity 521, so as to adjust the driving force provided by the driving portion 50 to health-regain the portion 40. Preferably, the fluid adjusting device 51 can simultaneously adjust fluid volume of each of the fluid receiving cavity 521 so that the driving portion 50 enables each of the end portions the health portion 40 to reciprocate in synchronism.

Furthermore, the health portion 40 comprises at least a box 44, and the receiving shell 41 has at least one interconnecting hole 412, and the box 44 received in the receiving cavity 43 to be provided in the receiving shell 41, and the box 44 is corresponding to the receiving shell 41 of the interconnecting hole 412, wherein the resilient covering 52 is provided in the box 44. Preferably, in FIGS. 57A to 59, the number of the interconnecting hole 412 of the receiving shell 41 is two, and the two communication holes 412 are symmetrically disposed in the receiving shell 41 at both ends respectively. And the number of the box 44 is two, and two of the boxes 44 are symmetrically disposed in the receiving shell 41 at both ends, and each of the box 44 respectively is corresponding to each of the interconnecting hole 412.

Furthermore, each of the box 44 respectively comprises a box body 441 and a box covering 412, wherein each the box body 441 of the box 44 is arranged symmetrically to two end portions of the receiving shell 41, and the bottom of each the box body 441 is each of the interconnecting hole 412 of corresponding to the housing 41, and each of the resilient covering 52 are each disposed at the bottom of the box body 441 in the box 44 and of the box body 441 having a box cavity 4411, wherein the box covering 412 is disposed in the box body 441, and for closing the cartridge cavity 441 of the box body 4411. Furthermore, the box covering 412 is bonded to the inner wall of the top cap 42.

The receiving shell 41 of the health portion 40 having a connecting slot 413 at the bottom, and the resilient covering 52 is sealingly connected with the connecting slot 413. Preferably, the edge of the resilient covering 52 is sealingly connected with the connecting slot 413 to form the fluid receiving cavity 521. The through-hole 411 formed in the box body 441 of the box 44 and the receiving shell 41 in is communicated with the connecting slot 413 and the cartridge cavity 4411 by the through hole 411, and the fluid adjusting device 51 is provided in the cartridge cavity 4411 of the box body 441. Preferably, as the FIGS. 57A to 59 of the example of the health-regain device shown, the number of the fluid adjusting device 51 may also be implemented as two, so that each of the fluid adjusting device 51 are used to adjust fluid volume of each of the fluid receiving cavity 521.

When the user uses the health-regain device, a user is in sitting or lying position. If the user uses lying position, such as lying on bed, the health-regain device is placed beneath the waist of the user, so that the health-regain device supports of the user's waist. Of course, the health-regain device may also be placed beneath the user's neck. Preferably, when the health-regain device is placed beneath the waist of a user, the health-regain device is a level, which is the health portion 40 of the health-regain device in contact with the user's waist, and the driving portion 50 of the health-regain device contact with the bed. More specifically, each of the resilient covering 52 of the driving portion 50 of the health-regain device is in contact with the bed.

The fluid adjusting device 51 fills with fluid to each of the fluid receiving cavity 521, like the fluid adjusting device 51 fills with gas to each one of the fluid receiving cavity 521, and air volume of each of the fluid receiving cavity 521 is increasing. The pressure in each of the fluid receiving cavity 521 is gradually increased. The gas is respectively applied pressure to the health portion 40 and each of the resilient covering 52. However, the fluid hinders each of the receiving cavity 52 extending toward the direction of the bed. At the time, the health-regain device only allows the fluid receiving cavity 52 extending to direction of the health portion 40. At the time, air pressure of each of the fluid receiving cavity 52 is used as the driving force. When the force applied by each of the fluid receiving cavity 52 to the health-regain 40 of accommodating air is greater than the force is applied by the user's waist to the health portion 40, the health portion 40 moves away from the bed, in which case the health portion 40 is pushed away from the initial position. If the health portion 40 in contact with the user's waist, the health portion 40 is applied force to the waist of the user so that the user is subjected to a force in the lumbar spine. When a user subjected to the force of the lumbar vertebrae, lumbar spine moves away from the bed body with the health portion 40, whereby the bending of the lumbar spine of the user increases, for increasing the gap between two lumbar vertebrae. Furthermore, lower back muscles get passively exercised.

The fluid adjusting device 51 is provided with a pneumatic predetermined value, if after the amount of air of the fluid supplied by adjusting device 51 to each of the fluid receiving cavity 521 reaches a preset value inflated, the fluid adjusting device 51 stops supplying the fluid to each of the receiving cavity 521 gas. At the time, the health portion 40 stops moving. The force applied to the health portion 40 by each of the fluid receiving cavity 521 contained in the air a for supporting the health portion 40 stays at the current position where the health portion 40 supporting the user's waist, so that users of the lumbar spine is maintained at the current level of the bending and then the user's waist muscles stretched, that is, the user's waist muscles have been exercised.

The fluid adjusting device 51 further adjusts air volume of each of the fluid receiving cavity 521 by reducing the air volume of each of the fluid receiving cavity 521 to adjust the driving force provided each of the fluid receiving cavity 521. Each of air volume of the fluid receiving cavity 521 is reduced, and the health portion 40 reduces the force applied to the health portion 40 to reduce the driving force provided to the waist of a user. When a force is applied to the user's waist by the health portion 40 is less than gravity of the user's waist, the health portion 40 moves to the direction of the bed body, to reduce the bending of the lumbar spine of the user, and the user gap of two lumbar spine is reduced. It is worth mentioning that the fluid adjusting device 51 further controls regulation of each of the fluid receiving cavity 521 inflating speed and/or the pumping speed. Specifically, the fluid adjusting device 51 further controls each of the fluid receiving cavity 521 and the speed of the inflation/or pumping speed, by controlling each of the fluid receiving cavity 521 inflated and the velocity/formation or pumping speed to from the rhythm of the driving force. Furthermore, the fluid adjusting device 51 further controls each of the fluid receiving cavity 521 the conversion speed of converting inflated to extracted and/or the conversion speed of converting extracted to inflated, to control the driving portion rhythm. Furthermore, the fluid adjusting device 51 controls the amount of air in each of the fluid receiving cavity 521 to maintain the provided driving force.

It is worth mentioning that the fluid adjusting device 51 is further provided with a fluid supplement predetermined value. For example, the fluid adjusting device 51 is provided an air supplement predetermined value. When air volume of each of the fluid receiving cavity 521 reaches the supplement predetermined value, the fluid adjusting device 51 supply gas to each of the fluid receiving cavity 521. The health portion 40 stops moving toward the bed. When the applied force of each of the fluid receiving cavity 521 to the health portion 40 is greater than force is applied by the user's waist to the health portion 40, the health portion 40 moves away from the bed using, lumbar degrees is increased because of supporting by the health portion 40, so that the gap between two lumbar spine increased, and two adjacent lumbar spine get relax. When the air volume in each of the fluid receiving cavity 521 reaches a preset value, the fluid adjusting device 51 controls the air flows out of each of the fluid receiving cavity 521, and force on the health portion 40 and on the user's waist get reduced, and the bending of lumbar is lower, for reducing the gap of two lumbar spines of the user, the fluid adjusting device 51 is repeated controlling the air volume of each of the fluid adjusting receiving cavity 521, the health portion 40 is reciprocated to adjust the force applied by the user's lumbar spine, so that the gap of two lumbar spines of user is constantly changing. In such a way, changing the gap two lumbar spine, lumbar spine gets exercised, and lumbar spine is adapted to add two lumbar spine gaps. Furthermore, the waist of the user's muscles has been exercised. It is worth mentioning that, by adjusting manner of the force on user's waist, to avoid the user's waist in one state for a long time. If prolonged force is applied to the user's lumbar spine, the user two lumbar spine is maintained in a larger gap, which may cause damage to the lumbar spine can also cause lumbar muscle damage.

The driving portion 50 of the health-regain device further comprises a control module 53, wherein the control module 53 may be communicatively connected with the fluid adjusting device 52, so that the fluid adjusting device 52 is controllably connected with the control module 53. The control module 53 is capable of controlling the fluid adjusting device 51 to adjust fluid volume of each of the fluid receiving cavity 521. For example, the control module 53 to control the fluid adjusting device 51 intermittently supply fluid to the fluid receiving cavity 521 to control the fluid adjusting device 51. The control module 53 controls the fluid adjusting device 51 suppling the fluid to each of the fluid receiving cavity 521, and the control module 53 controls the fluid adjusting device 51 by controlling fluid of each of the fluid receiving cavity 521 therein. By controlling fluid volume of each of the fluid receiving cavity 521, the control module 53 can the force on the health-regain 40 to control force applied to the user's waist of the health portion 40 in order to avoid the user's waist is maintained in a state for a long time. Furthermore, by controlling fluid volume of each of the fluid receiving cavity 521, the control module 53 is capable of controlling height of the health portion 40. When the force on the health portion 40 decreases, the health portion 40 moves in the direction of the bed. When the force on the health portion 40 increases, the health portion 40 moves in the direction of the user's waist. In such a way, that health portion 40 applies the force to the waist, to change the user's lumbar spine bending.

Furthermore, the control module 53 is set with a training range, wherein the training range is, the preset time period, the force on the user's waist changes by a certain the range of variation with the control module 53 by controlling the fluid adjusting device 51, so that the bending of the lumbar spine of the user varies within a certain range. The user's waist is adapted to changes in the lumbar spine through exercise of the bending. At the same time, the user's waist muscles get exercised in the training range. That is, with the control module 53 controlling the fluid adjusting device 51, the health portion 40 is acting force intermittently to the user. Preferably, with the control module 53 by controlling the fluid adjusting device 51, the acting force of the health portion 40 is rhythmically applied to the user.

The health-regain device further comprises at least one detector 60, wherein the detector 60 is provided on the health portion 40, and the detector 60 is communicably connected with the control module 53.

The detector 60 further comprises at least one pressure sensor 61, wherein the pressure sensor 61 is provided on the health portion 40, and the pressure sensor 61 is communicatively connected with the control module 53. The pressure sensor 61 is for detecting the pressure applied to the user's waist by the health portion 40. The pressure sensor 61 can detect the pressure applied by the user to the health-regain device. Preferably, the pressure sensor 61 is provided on the receiving cavity 43 of the health portion 40.

The detector 60 further comprises at least one baroceptor 62, the baroceptor 62 is disposed in the receiving shell 42 or the resilient covering 52, and the baroceptor 62 is communicatively connected with the control module 53. Preferably, the pressure sensor 62 is disposed in the fluid receiving cavity 521. The baroceptor 62 is for detecting pressure of the fluid receiving cavity 521.

By the pressure sensor 61, the control module 53 is obtained the pressure applied user's waist to the health portion 40; by the baroceptor 62, the control module 53 is obtained the fluid pressure of the fluid receiving cavity 521. For example, the control module 53 is obtained the air pressure of the fluid receiving cavity 521 therein through the pressure sensor 62. The control module 53 controls the fluid adjusting device 51 adjusting fluid volume of each of the fluid receiving cavity 521 according to the pressure on the waist to the health portion 40 and the air pressure in the fluid receiving cavity 521, for adjusting the fluid receiving cavity 521 pressure provided.

The detector 60 further comprises at least one electromyographic sensor 63, the electromyographic sensor 63 is disposed in the health portion 40, and the electromyographic sensor 63 is communicatively connected with the control module 53+ Preferably, the electromyographic sensor 63 is disposed in surface of the health portion 40. For example, the electromyographic sensor 63 may be disposed in surface of the top cap 42 of the health portion 40. Preferably, the electromyographic sensor 63 and the resilient covering 52 are located health portion 40 on both sides. The electromyographic sensors 63 is for acquiring data related to the health-regain body of myoelectric the user. In the present invention, preferred examples of the health-regain device, the electromyographic sensor 63 acquires muscle EMG produced by the user's waist. In the present invention, the health-regain device, the skin of the user's waist is in contact with the electromyographic sensor 63, so the electromyographic sensor 63 can acquire user's EMG. It is worth mentioning that the acquisition of the EMG signal in the invention is not limited in the health-regain device. That is, the embodiment is obtained the myoelectric signal by contacting or non-contacting both belong to the present invention, and to the scope of protection of the health-regain device.

The electromyographic sensor 63 will transmit the acquired myoelectric signals to the control module 53, and the control module 53 analyzes the waist muscle EMG to obtain the user status. Furthermore, by analyzing the EMG, the control module 53 is obtained the lumbar state of the user. The control module 53 controls the fluid adjusting device 51 adjusting fluid volume of each of the fluid receiving cavity 521 according to lumbar state of the user, for controlling the health portion 40 to provide a force applied to the user's waist. In such a manner, the control module 53 through the adjusting device 51 adjust fluid volume of each of the fluid receiving cavity 521 according to the user's status and lumbar or waist of the user, for controlling the health portion 40 to provide a force applied to the user. In such a way, during use of the health-regain device, the user's waist and/or the state of the lumbar spine real-time sates are detected to obtain better using results.

The detector 60 further comprises at least one temperature sensor 64, wherein the temperature sensor 64 is disposed in surface of the health portion 40, and the temperature sensor 64 is communicatively connected with the control module 53. For example, the temperature sensor 64 may be disposed in the health portion 40 of surface of the top cap 42. If the skin of health-regain body of the user is in contact with the temperature sensor 64, or the user's health-regain body is at the site of the temperature sensor 64 detection range, the temperature sensor 64 can obtain the skin temperature of the health-regain body of the user.

Furthermore, the health-regain device further comprises at least an environment health-regain former 70, which is for forming a health-regain environment 701. Preferably, the health-regain environmental former 70 can be in the health portion 40 to form the health-regain environment in the middle of 701. For example, the health-regain environmental former 70 may be provided on center of the health portion 40, so that the health-regain environmental former 70 can form the health-regain environment 701 in the center of the health portion 40. For example, the health-regain environmental former 70 can provide a thermal environment with providing and controlling the thermal. That is, the health-regain environmental former 70 can control the temperature of the thermal environment by controlling thermal energy. The control module 53 is communicatively connected with the environmental health-regain former 70, to adjust temperature of the health-regain environment 701 by the control module 53 through the health-regain environmental former 70.

Specifically, the health-regain environmental former 70 further comprising at least one heat source device 71, for generating thermal energy, wherein the heat source device 71 is provided on the health portion 40, and the control module 53 is communicatively connected with the heat source device 71, so that the source device 71 can be controlled by the control module 53. That is, the control module 53 is capable of controlling the temperature of the heat source device 71 to generate heat for adjusting thermal environment. For example, before using the health-regain are device for bending health-regain, the control module 53 is capable of controlling the heat source device 71 generating heat. On the one hand, the temperature of the health-regain environment 701 can be varied to facilitate health. On the other hand, eliminate the health-regain body of the user uncomfortable feeling to the health portion 40 generated upon contact, in order to enhance the user experience. Furthermore, by adjusting the health-regain environment 701 temperature is conducive to shorten the preparation time of muscle activity to improve the efficiency of the health-regain of the user performs bending. Furthermore, during the process of health-regain of the bending, to maintain the health-regain environment 701 at a certain temperature, is beneficial to health-regain bending, such as promoting blood circulation on waist. Preferably, the heat source device 71 can be implemented as a heating device, such as but not limited to a heating wire or heating film.

The health-regain environmental former 70 further comprising at least one light source device 72, for generating light to form a luminous environment, wherein the lighting source means 72 is provided on the health portion 40, and the control module 53 is communicatively connected with the light source device 72, so that the light source device 72 can be controlled the control module 53+ It will be understood that the control module 53 controls the light intensity of the environment light in the operation state health-regain environment 701 by controlling the light source device 72. If the health-regain body of the user is located health-regain environment 701, the health-regain environment 701 of the luminous environment is around the skin portion of the user, to do luminous health-regain to the skin of the health-regain body of the user. That is, the light generated by the light source device 72 can be applied to the skin portion of the user's health-regain body, to do luminous health-regain to the skin of the health-regain body of the user.

Furthermore, the light source device 72 further comprises at least one light source 721 and at least one nonopaque device 722, wherein the nonopaque device 722 is covered each of the light source 721. For example, the nonopaque device 722 is provided in light radiation paths of each of the light source 721, and light generated by each of the light source 721 can be transmitted through the nonopaque device 722 to form the luminous environment. It is worth mentioning that the nonopaque device 722 is further provided with a color conversion layer having a high transmittance, in accordance with need to set the transparent means 722 acquires the desired color of light. For example, but not limited to absorption of blue light, green light transmitted through, allowing red light to pass through or the like. The nonopaque device 722 may further detail with light so that the light can be irradiated to reveal greater extent. For example, the nonopaque device 722 to provide a nonopaque process. Preferably, the heat source device 71 is provided on between the light source 721 and the nonopaque device 722. Specifically, heating film or the heating wire of the heat source device 71 is provided in each of the light source 721 and the nonopaque device 722 between. The nonopaque device722 is provided at the top of the health-regain environmental former 70. Health-regain body of the user contacts with the nonopaque device 722. The heating film or hot wire of the heat source device 71 is fixedly disposed below the nonopaque device 722. The light source 721 is respectively disposed beneath the heat of the heating wire or film of the heat source device 71. It is worth mentioning that, the heating film or hot wire of the heat source device 71 is arranged in a predetermined shape, such that the light generated by each of the light source 721 transmitted through the nonopaque device 722 to be shaped in a preset pattern. Furthermore, the control module 53 are respectively controls the heat source 71 and the light source 721, so that the light source 721 may be as auxiliary heat source of the thermal environment of the health-regain environment 701.

The health portion 40 further comprises a limiting portion 45, wherein along the longitudinal direction of the health-regain device, the height of the health portion 40 from the health portion 40 gradually decreases toward the middle to the ends of the health portion 40 in the middle to for the limiting portion 45. Preferably, the limiting portion 45 is formed at the top of the health-regain environmental former 70. If the user's waist is disposed to the limiting portion 45 of the health portion 40, the user's waist can be restricted of movement in the horizontal direction, in such a manner, as the user performs using the health-regain device for bending health-regain, it prevents horizontal movement of the user's waist, t so as to facilitate maintaining the waist of the user on the limiting portion 45 for doing health-regain. That is, when the user uses the health-regain device for bending health-regain on the waist, the limiting portion 45 is for maintained a relatively fixed position between the user's waist and health-regain device.

In the width direction of the health-regain device, the height of the health portion 40 decreases from both ends of the health portion 40 gradually toward the center to form a curved surface, such that after the health-regain body of the user (e.g. waist portion) contacts to the health portion 40, the surface profile is adapted to fit the health-regain body of the user. Preferably, the curved surface is adapted to fit the physiological curve health-regain body of a user. It is worth mentioning that, along the width direction of the health-regain device, the health-regain environmental former 70 gradually decreases from the top toward the middle, in such a way that, when the health-regain device is used, health-regain body of the user may be bonded to the surface. Preferably, the curve of the waist and/or of the neck of a user is fit to the curved surface of the health portion 40.

The health-regain environmental former 70 further comprises at least one magnetic element 73, for providing a magnetic health-regain environment so that the provide a magnetic health-regain by magnetic environment later, wherein the magnetic element 73 is disposed in the health portion 40, and the magnetic element 73 is communicatively coupled to the control module 53 to control the magnetic element 73 by the control module 53. That is, a user in use for the bending health-regain of the health-regain device can be doing magnetic health-regain by the magnetic health-regain environment. Preferably, the magnetic element 73 is disposed is central surface of the health-regain environmental former 70. In particular, the magnetic element 73 may be disposed in the central surface of the nonopaque device 722.

The health-regain device further comprises at least one massage device 80 to provide a massage environment, wherein the massage device 80 is provided in the health portion 40, and the massage device 80 is communicably connected with the control module 53 to control the massage device 80 by the control by module 53. Preferably, the massage device 80 is provided in the receiving cavity 43 of the health portion 40. For example, the massage device 80 is disposed inside the cartridge cavity 4411 of the box body 441. The massage device 80 provides vibration massage. For example, the control module 53 provides massage to the health-regain environment 701 formed by health-regain environmental former 70 by controlling the massage device 80. It is worth mentioning that, before the user uses the health-regain device for bending health-regain, the control module 53 is capable of controlling the massaging means 80 to massage the health-regain body of the user's, to shorten the time of health-regain body of the user to adapt before doing bending health-regain. Furthermore, during the health-regain body of the user is doing the bending health-regain, the massage device 80 can simultaneously provide massage to health-regain body of the user, so that during bending health-regain the health-regain environment 701 is with massage. It is worth mentioning that the types of massage device 80 in the present invention of the health-regain device is not limited, for example the health-regain device 80 can be implemented as, but not limited to the vibration motor.

The health-regain device further comprises at least one power supply device 90, wherein the power supply device 90 is provided on the health portion 40. Preferably, the power supply device 90 is provided on the receiving cavity 43 of the health portion 40. For example, the power supply device 90 is provided inside the box cavity 4411 of the box body 441. The fluid adjusting device 51 of the driving portion 50, the control module 53, the detector 60, the heat source device 71 of the health-regain environmental former 70, the light source device 72, the magnetic element 73 and the massage device 80 are connected with the power supply device 90. Preferably, the power supply device 90 to provide electrical power. For example, the power supply device 90 may be implemented as, but not limited to a battery or power source, so that the fluid adjusting device 51 of the driving portion 50, the control module 53, the detector 60, the heat source device 71, the light source device 72 and the magnetic element 73 of the health-regain environmental former 70 and the massaging means 80 respectively are connected with the power supply device 90.

The health-regain device further comprises at least one controller 100, wherein the controller 100 is communicably connected with the control module 53 of the driving portion 50, which a user can control the health-regain device through controller 100. The controller 100 is communicatively connected with the control module 53 in a wired or wireless manner. It is worth mentioning that the types of the control terminal 90 of the present invention of the health-regain device is not limited. For example, the controller 100 may be a dedicated remote control, or the controller 100 may be electronic products like a mobile phone, a tablet computer digital.

With further reference to FIGS. 57A to 59, in the present invention, the health-regain device, the edge of the receiving shell 41 of the health portion 40 and edge of the top cap 42 are connected with each other, to form the receiving cavity 43 between the receiving shell 41 and the top cap 42. Preferably, the edge of the receiving shell 41 and the edge of the top cap 42 is connected fitly. More preferably, the edge of the receiving housing 41 and the edge of the top cover 42 are detachably fitted. The massage device 80 and the fluid adjusting device 51, each of the resilient covering 52 and the control module 53 of the driving portion 50 are fixedly disposed in the box 44, and the massage device 80 and the fluid adjusting device 51 and the control module 53 of the driving portion 50 are received in the box cavity 4411 the box 44 of the health portion 40 with each of the resilient covering 52 provided on the outside of the health portion 40. For example, each of the resilient covering 52 are respectively located at the bottom of the receiving housing 41. The health-regain environmental former 70 is disposed in the receiving shell 41 of the health portion 40. Preferably, the health-regain environmental former 70 is disposed in the middle of receiving shell 41 of the health portion 40.

Specifically, the top cap 42 of the health portion 40 has a health-regain environmental forming hole 421 in the middle. Before edges of the top cap 42 with the edge of the receiving shell 41 being fitted to connected, the health-regain environmental former 70 is embedded in the health-regain environmental forming hole 421 of the top cap 42. In such a manner, a health-regain environment 701 formed by the health-regain environmental former 70 can be extended to surface of the top cap 42. Preferably, after the health-regain environmental former 70 is embedded in the health-regain environmental forming hole 421, after surface of the top cap 42 and the top surface of the environmental health-regain former 70 are located at a same curved surface.

The nonopaque device 722 further comprises at least two sub-nonopaque devices 7221 and has at least one interval slot 7222, wherein the interval slot 7222 is divided the nonopaque device 722 into each of the sub-nonopaque device 7221. That is, the two neighboring sub-nonopaque device 7221 having a groove between the interval slot 7222. At least one of the light source 721 is provided respectively below the sub-nonopaque device 7221, and the control module 53 may control the emitting rhythm of each of the light source 721 corresponding to sub-nonopaque device 7221 for showing preset information formed through each of the sub-nonopaque device 7221. It is worth mentioning that the preset information can be used to inform the user to use the health-regain device to do health-regain. It will be understood that the number of the sub-nonopaque device 7221 in the nonopaque device 722 is increased with the more information can be displayed by the nonopaque device 722. Thus, one skilled in the art will understand that, the health-regain device in the present invention, the number of the sub-nonopaque device 7221 and the interval slot 7222 of the nonopaque device 722 is not limited.

The pressure sensor 61 and the electromyographic sensor 63 of the detector 60 is provided on surface of the top cap 42 and/or the surface of the environment health-regain former 70. Preferably, the electromyographic sensor 63 is disposed in the interval slot 7222. When the user uses the health-regain device for health-regain, health-regain skin of the user is contacted to the electromyographic sensors 63 to obtain the user EMG of the health-regain body. The pressure sensor 61 is disposed in the interval slot 7222, as a user in use of the health-regain device, and the pressure sensor 61 is acquired pressure data and the pressure sensor 61 transmits the acquired pressure data to the control module 53.

Figure 58:
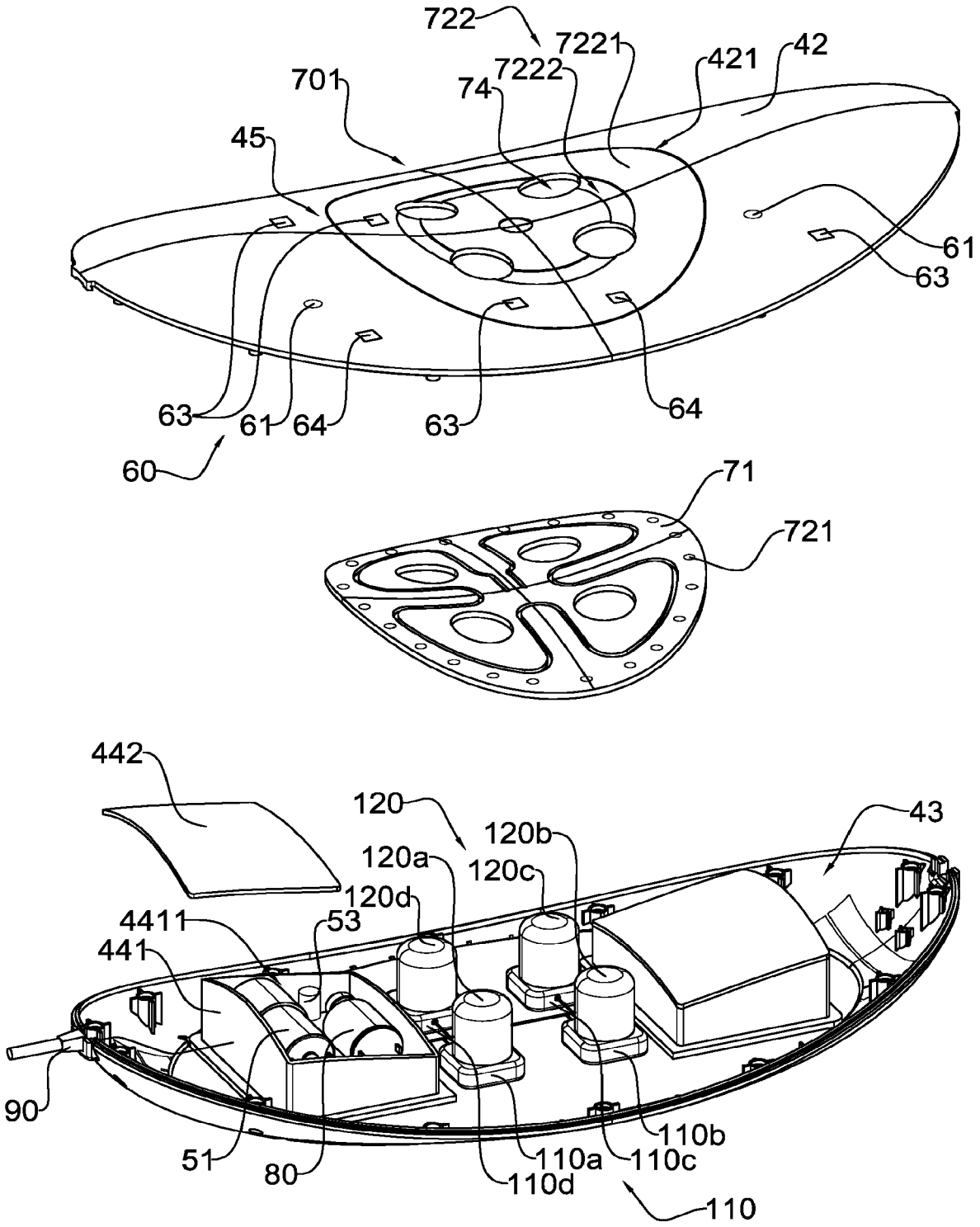
FIG. 58 is an explosive view of the health-regain device according to the above preferred embodiment of the present invention.
Figure 59:
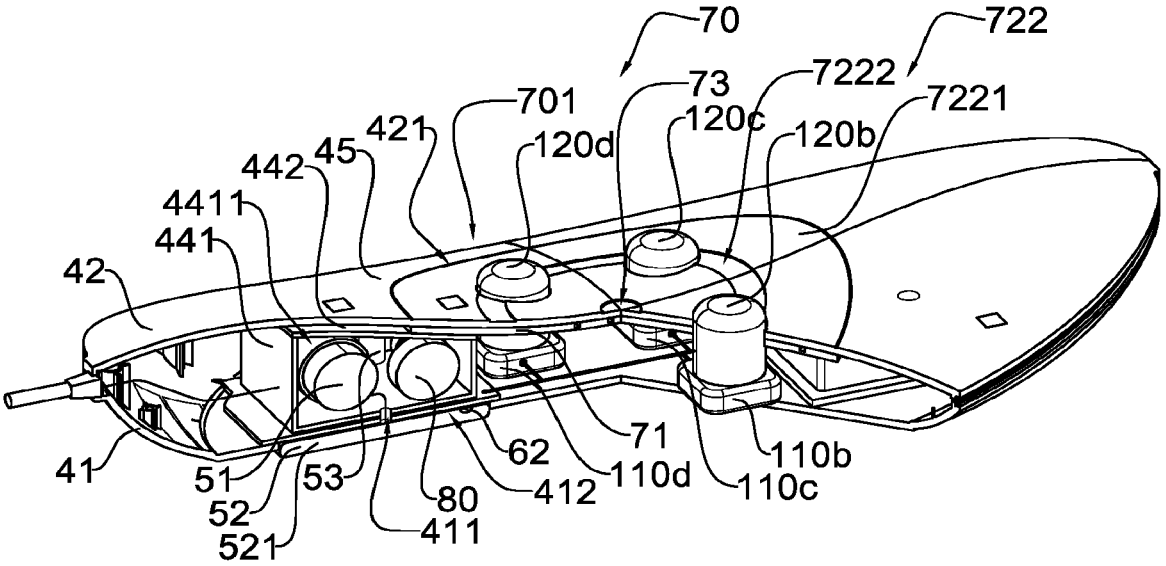
FIG. 59 is a sectional perspective view of the health-regain device according to the above preferred embodiment of the present invention, illustrating the mechanism inside the heath-regain device.

In the present invention, another example of the health-regain device in FIG. 58, the health-regain device further comprises at least one sub-driving device 110 and at least one supporting portion 120, wherein each of the sub-driving device 110 is provided on the receiving shell 41 of the health portion 40, and each of the supporting portion 120 is drivably disposed to each of the sub-driving device 110, wherein each of the sub-driving device 110 is for respectively driving each of the support portion 120. The health-regain environmental former 70 has at least one through hole 74, wherein the support end of each of the support portions 120 is extended from each of the through hole 74 of the health-regain environmental former 70 to the receiving cavity 43 of the health portion 40 to the outside the health portion 40, and the support end of each of the supporting portion 120 is held in the health-regain environment 701. That is, each of the sub-driving device 110 and the driven ends of the supporting portion 120 are held in the receiving cavity 43 of the health portion 40.

Preferably, the number of the sub-driving device 110, the number of the supporting portion 120 and the number of the through hole 74 of the health-regain environmental former 70 are four. However, one skilled in the art will understand that, in the present invention, another possible example of the health-regain device, the number of the sub-driving device 110, the number of the supporting portion 120 and the number of the through hole 74 of the health-regain environmental former 70 may also be fewer or more. Therefore, in the FIGS. 57A to 59 disclosed the health-regain device which comprises four sub-driving devices 110, and the four supporting portions 120 and the four through holes having 74. And is only an example only to exemplify, which is not to be considered as the present invention limiting the scope and content of the health-regain device.

Figure 61A:
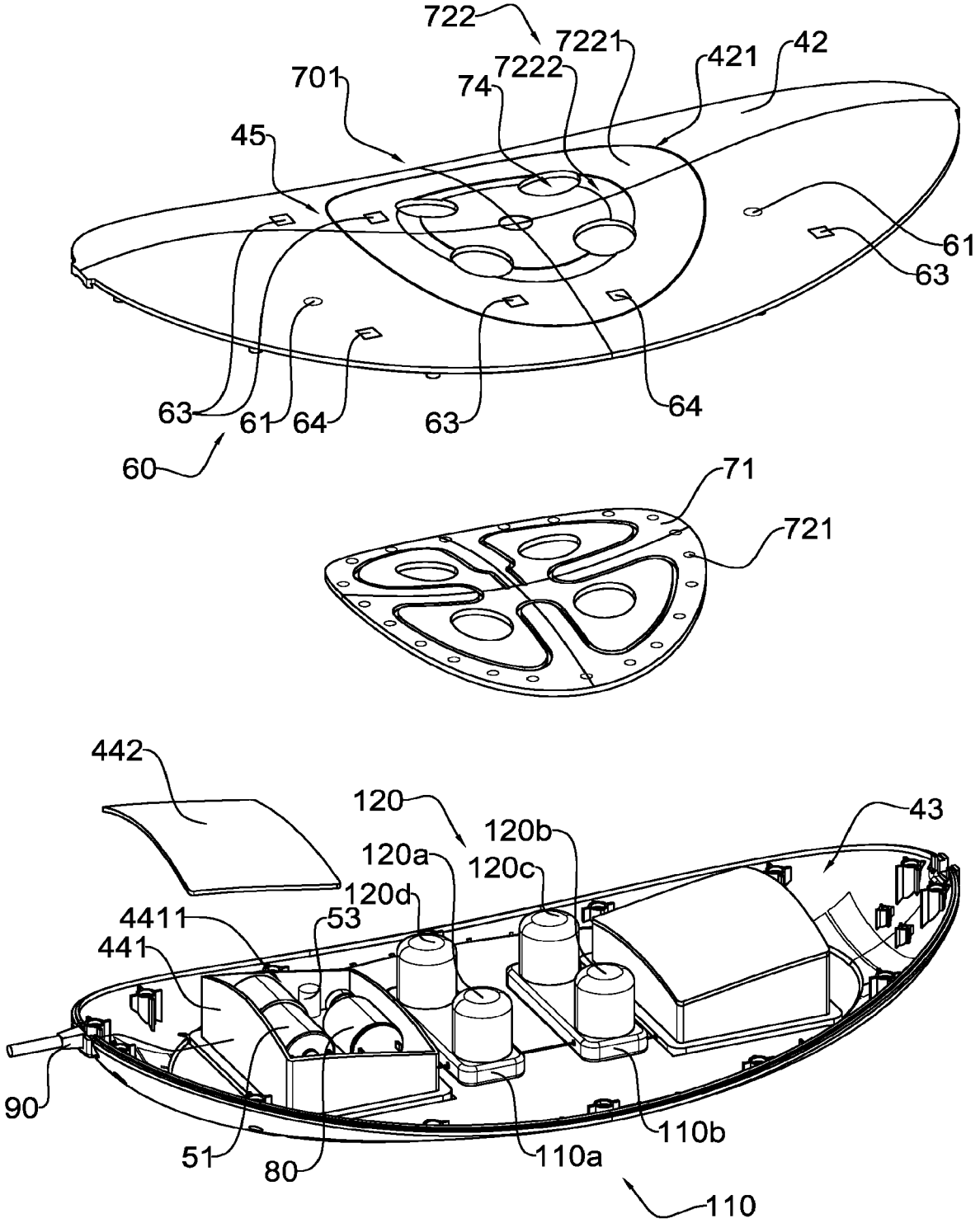
FIG. 61A is an explosive view of the health-regain device according to the above preferred embodiment of the present invention.
Figure 61B:
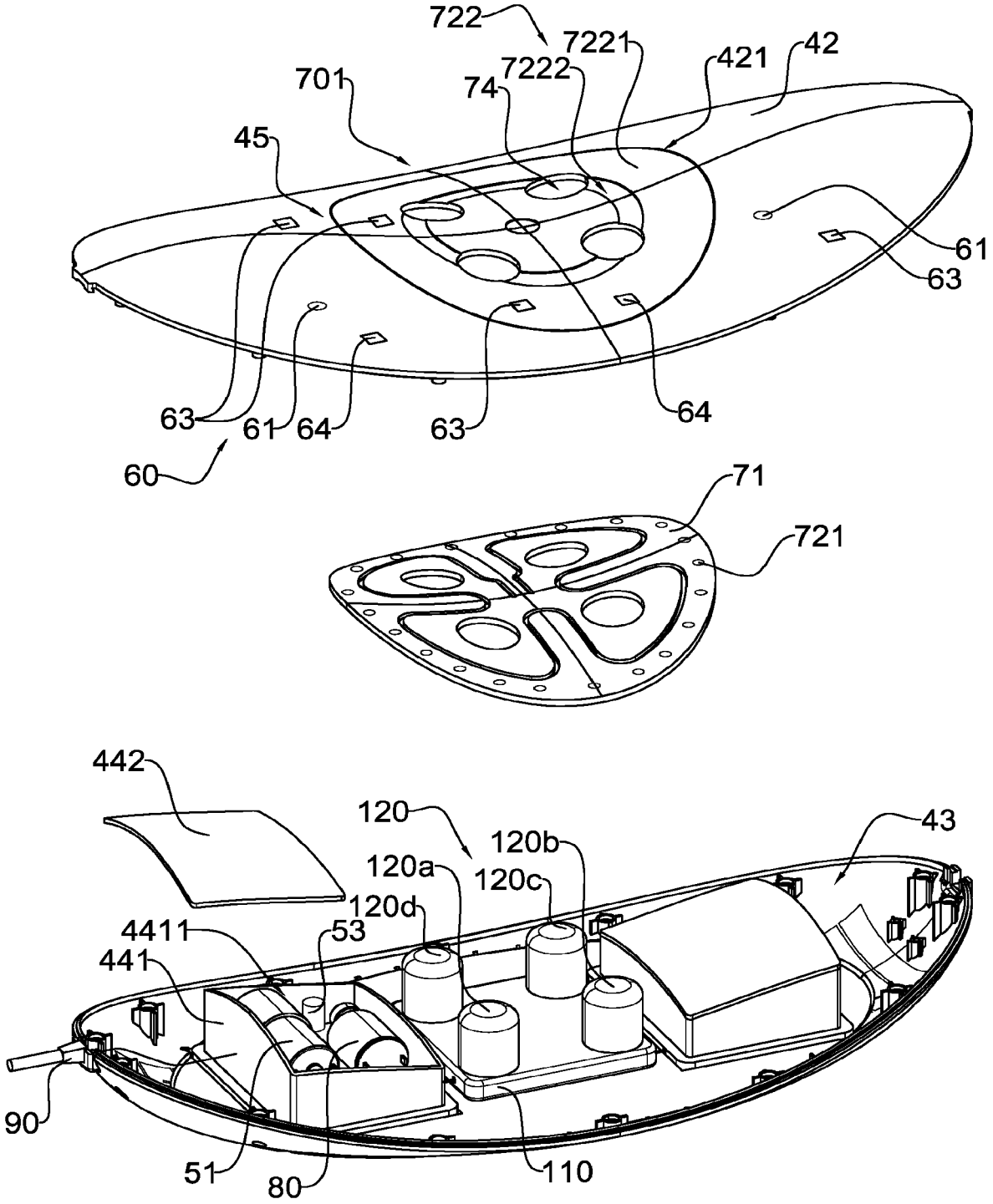
FIG. 61B is an explosive view of the health-regain device according to the above preferred embodiment of the present invention.

More preferably, each of the sub-driving device 110 are respectively provided spacedly in the receiving shell 31 of the health portion 40, such that each of the supporting portion 120 is arranged in a health-regain environment, which is formed spaced apart from each other health-regain environment 701 formed by the health-regain environmental former. Nevertheless, in the present invention, another possible example of the health-regain device, a sub-driving device 110 is used to drive two of the support portions 120, with reference to the FIG. 61A; or one of sub-driving device 110 is to drive all the supporting portion 120 as in the FIG. 61B.

In the present invention, the health-regain device, each of the sub-driving device 110 drives each of the support portions 120 in a predetermined manner. It is worth mentioning that, according to the present invention, the predetermined manner is related means that each of the sub-driving device 110 can be driving each of the supporting portion 120 in synchronization in the same manner as the amplitude of motion, or each of the sub-driving device 110 can be driving each of the supporting portion 120 in different ways amplitude movement, each of the sub-driving device 110 can be driving each of the supporting portion 120 not in synchronization.

In the following description, for convenience of disclosure and to illustrate the health-regain device in the present invention, the four sub-driving device 110 are respectively defined as a first sub-driving device 110*a*, a second sub-driving device 110*b*, a third sub-driving device 110*c* and a fourth sub-driving device 110*d*, and the four supporting portions 120 are respectively defined as a first supporting portion 120*a*, a second supporting portion 120*b*, a third supporting portion 120*c*, and a fourth supporting portion 120*d*. The first sub-driving device 110*a* is provided in the receiving shell 41 of the health portion 40, and the first supporting portion 120*a* of the supporting portion is extended from the receiving cavity 43 via the through hole 74 to the outside of the health portion 40. And the first sub-driving device 110*a* is for driving the first supporting portion 120*a*, so that the support end of the first supporting portion 120*a* is in the health-regain environment 701 moving. The second sub-driving device 110*b* is provided on the receiving shell 41 of the health portion 40, and the supporting end of the second supporting portion 120*b* is extended via the through hole 74 from the receiving cavity 43 to the outside of the health portion 40, and the second sub-driving device 110*b* is for driving the second supporting portion 120*b*, so that the supporting end of the second supporting portion 120*b* moves in the health-regain environment 701. The third sub-driving device 110*c* is provided on the receiving shell 41 of the health portion 40, and the supporting end of the third supporting portion 120*c* is extended via the through hole 74 from the receiving cavity 43 to the outside of the health portion 40, and the third sub-driving device 110*c* is for driving the third supporting portion 120*c*, so that the support end of the third supporting portion 120*c* moves in the health-regain environment 701. The fourth sub-driving device 110*d* is provided on the receiving shell 41 of the health portion 40, the supporting end of the fourth supporting portion 120*d* is extended via the through hole 74 from the receiving cavity 43 to outside of the health portion 40, and the fourth sub-driving device 110*d* is for driving the fourth supporting portion 120*d*, so that the supporting end of the fourth supporting portion 120*d* moves in the health-regain environment 701.

In the present invention of a preferred examples of the health-regain device, each of the sub-driving device 110 are pneumatically driven each of the supporting portion 120 to move. For example, the sub-driving device 110 is implemented as, but not limited to a fluid bag, such as a gasbag, wherein the sub-driving device 110 is connected with the fluid adjusting device 51 of the driving portion 50, and later with the fluid adjusting device 51 adjusting fluid volume of the sub-driving device 110 to drive the supporting portion 120. For example, an example of the health-regain device in the present invention, the fluid adjusting device 51 provides a gas to the sub-driving device 110, so that the sub-driving device 110 provides a driving force to the supporting portion 120 to drive the supporting portion 120 away from the direction of the bottom of the health portion 40. Accordingly, the fluid adjusting device 51 extracts air inside the sub-driving device 110, so that the driving force provided by the sub-driving device 110 to the supporting portion 120 is reduced, so that the supporting portion 120 can be moved in the direction of towards the bottom of the health portion 40. It is worth mentioning that the control module 53 is capable of controlling the fluid adjusting device 51 adjusting fluid volume of the sub-driving device 110.

FIGS. 60A to 60F show a process using health-regain device by the user.

Figure 60A:
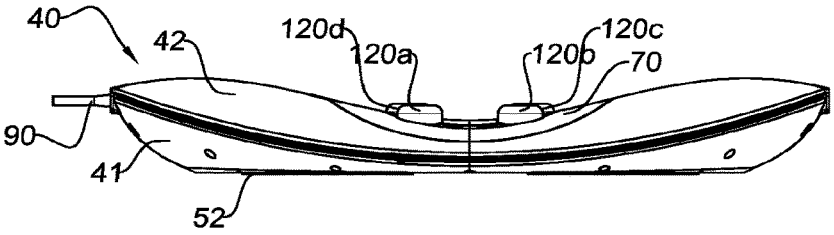
FIG. 60A is a front view of the health-regain device in a working state according to the above preferred embodiment of the present invention.

The stage as shown in FIG. 60A, the health-regain device is placed on bed by the user. At the time, each of the fluid receiving cavity 521 are not is charged with fluid which generates force driving the health portion 40 to away from the bed, while each of sub-driving device 110 has not been charged with fluid which generates force driving the supporting portion 120 to away from the bottom of the receiving shell 41 of the health portion 40. In the stage shown in FIG. 60A, the user can feel by the hand whether temperature in the health-regain environment 701 is appropriate, or by the temperature sensor 64 detecting temperature in the health-regain environment 701 and displayed data. For example, the user may touch the outer surface of the top cap 42 of the health portion 40 by hand to sense temperature in the health-regain environment 701 appropriate or not. If the temperature of the health-regain environment 701 is significantly lower than the skin temperature of the health-regain body of the user, the skin of health-regain body of the user contacted with the outer surface of the top cap 42 the health portion 40 will feel very unsuited. In the case, the heat source device 71 of the health-regain environment 70 heats the temperature up first, and health-regain body skin contacts with the outer surface of the top cap 42 of the health portion 40. In such a manner, the user can feel more comfortable in use the health-regain device doing bending heath-regain.

Figure 60B:
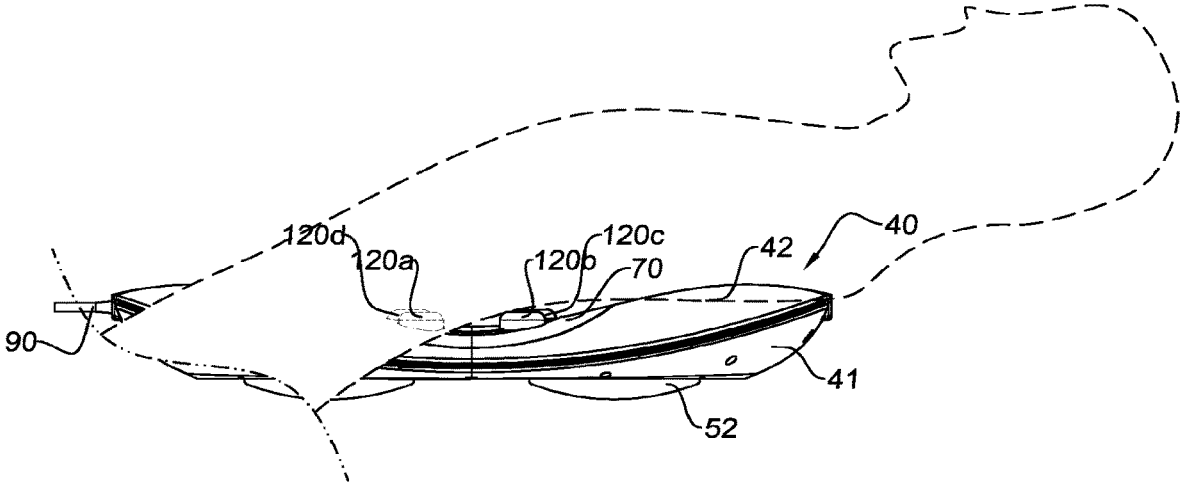
FIG. 60B is a front view of the health-regain device in another working state according to the above preferred embodiment of the present invention.

In the stage as shown in FIG. 60B, the skin portion of the user's health-regain body contacts the outer surface of the top cap 42 of the health portion 40. Normally, if the user uses the health-regain device on the bed, the health-regain device is placed in a horizontal manner below the waist of a user. In this case, the health portion 40 of the health-regain device is contacting with the user's the waist, and the driving portion 50 of the health-regain device is contacting with the bed. Before each of the fluid receiving cavity 521 is charged in the fluid generating the driving force to the health portion 40 away from the bed body, the massage device 80 of the health-regain device can work firstly to massage the user's waist and get relaxation, to avoid the health-regain device causing discomfort to the user's waist. Then, the control module 53 can be adjusted each of the fluid receiving cavity 521 to be filled fluid by the fluid adjusting device 51 which is a manner that the fluid receiving cavity 521 expands. Because the bed limits the driving portion 50 downwardly extension, the driving portion 50 can only extend upwards. When drive force generated by the fluid receiving cavity 521 of the driving portion 50 by charging in the fluid volume is greater than the force on the health portion 40, the driving portion 50 is driving the health portion 40 having motion in direction of away from the bed body, to increase the bending of the waist of the user.

Figure 60C:
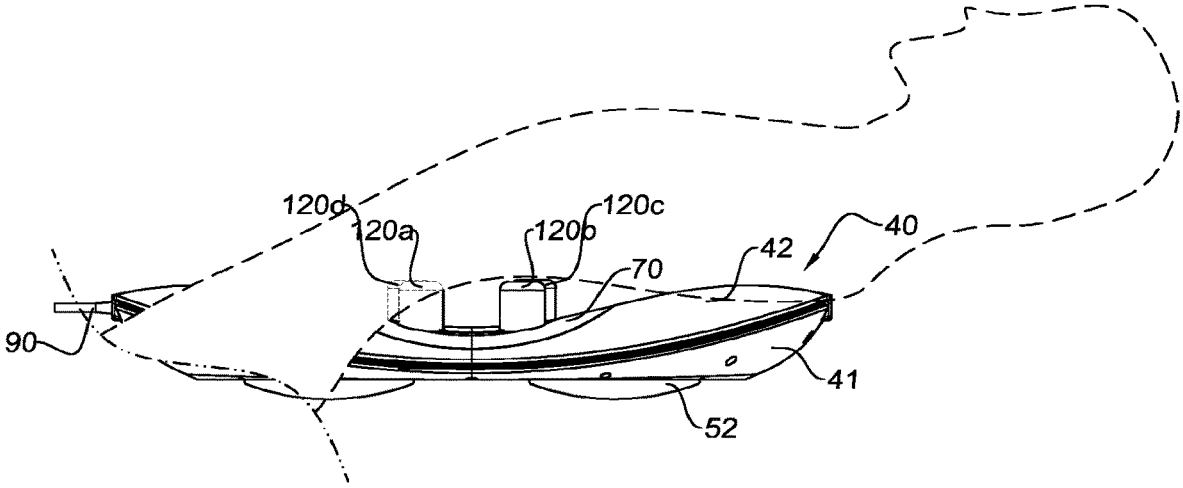
FIG. 60C is a front view of the health-regain device in another working state according to the above preferred embodiment of the present invention.

In the stage shown in FIG. 60C, the control module 53 can adjust each of the sub-driving device 110 filled in fluid by controlling the fluid device 51 in a manner that each of the sub-driving device 110 to drive each of the supporting portion 110 moving upwardly, to further provide support force to the user's waist, thus further increasing the bending of the user's waist portion. In stage shown in FIG. 60C, the first sub-driving device 110*a*, the second sub-driving device 110*b*, the third sub-driving device 110*c* and the fourth sub-driving device 110*d* is in synchronization with the driving of the first supporting portion 120*a*, the second supporting portion 120*b*, the third supporting portion 120*c* and the fourth supporting portion 120*d* away from the direction of the bottom of the receiving shell 11 of the health portion 40 for providing a supporting force on the user's waist.

Figure 60D:
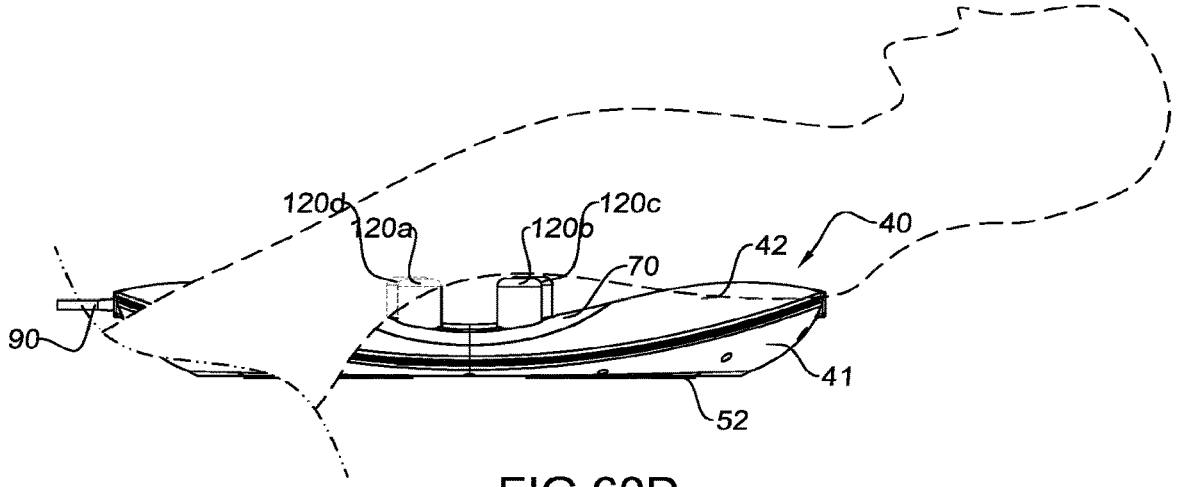
FIG. 60D is a front view of the health-regain device in another working state according to the above preferred embodiment of the present invention.

In the stage shown in FIG. 60D, the control module 53 can adjust to reduce the driving force the driving portion 50 generated for driving the health portion 40 in the manner of extracting fluid out of each of the fluid receiving cavity 521 by controlling the fluid device 51. When the driving force provided by the driving portion 50 for driving the health portion 40 is smaller than the force on the health portion 40, the health portion 40 moves in a direction toward the bed, in which case the user's waist bending decreases.

Figure 60E:
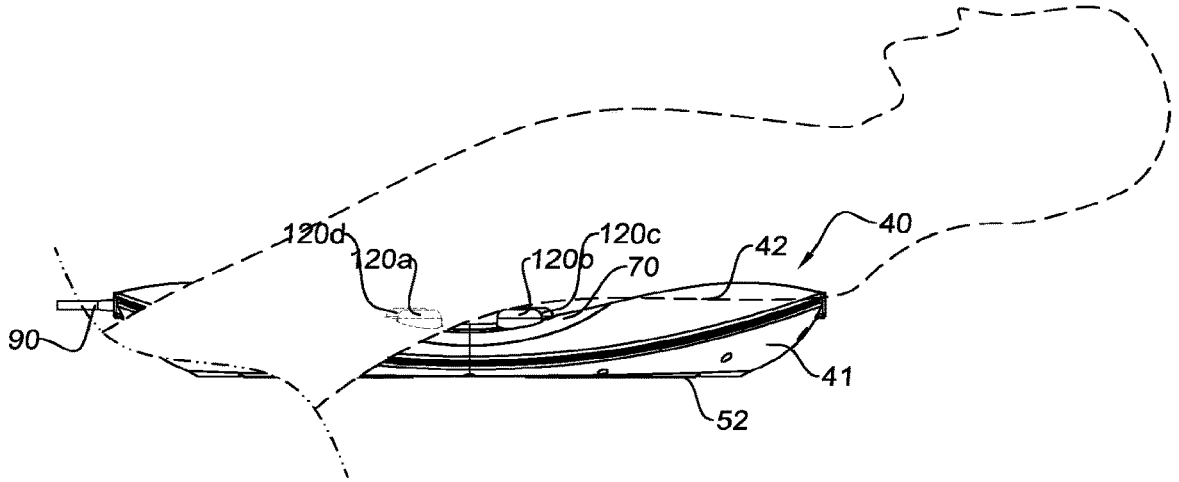
FIG. 60E is a front view of the health-regain device in another working state according to the above preferred embodiment of the present invention.

In the stage shown in FIG. 60E, the control module 53 can adjust to reduce the driving force generated by the sub-driving device 110 for driving each of the supporting portion 120 in the manner of extracting fluid out of each of the sub-driving device 110 by controlling the fluid device 51. When the driving force provided by the sub-driving device 110 for driving each the support portion 120 smaller than the pressure on each of the supporting portion 120, the supporting portion 120 moves to bottom of the receiving shell 41 of the health portion 40, at the time, the bending of the waist of the user is further reduced.

By repeating the stages shown in FIG. 60B to 60E, the bending of user's waist transitions between the states of greater degree and smaller degree by effect of the health-regain device, in order to achieve doing bending health-regain for the waist of a user. At the same time, the muscles of the waist of the user have been exercised.

Figure 60F:
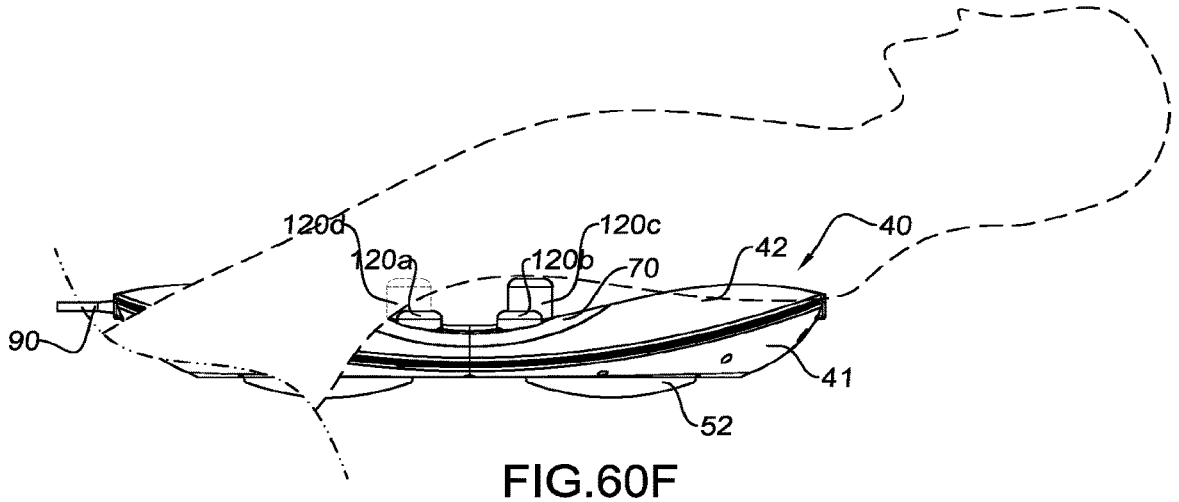
FIG. 60F is a front view of the health-regain device in another working state according to the above preferred embodiment of the present invention.

Furthermore, with reference to FIG. 60F, in other embodiments of the health-regain device, the supporting portion 120 may also have other modes to choose. For example, as shown in FIG. 60F, each of the supporting portion 120 may not in synchronized movement, in particular, the first sub-driving device 110*a* and the second sub-driving device 110*b* are not driven to the first supporting portion 120*a* and the second supporting portion 120*b*, and only the third sub-driving device 110*c* and the fourth sub-driving device 110*d* is driving the third supporting portion 120*c* and the fourth supporting portion 120*d*, so that only the fourth supporting portion 120*d* supports the lumbar of user. In such a way, each of the supporting portion 120 is intermittently for supporting the waist of the user to provide point support. It can also be known that the area of the waist of the user supporting force is reduced, which is useful for the health-regain on the partial position of the waist of the user.

Figure 62A:
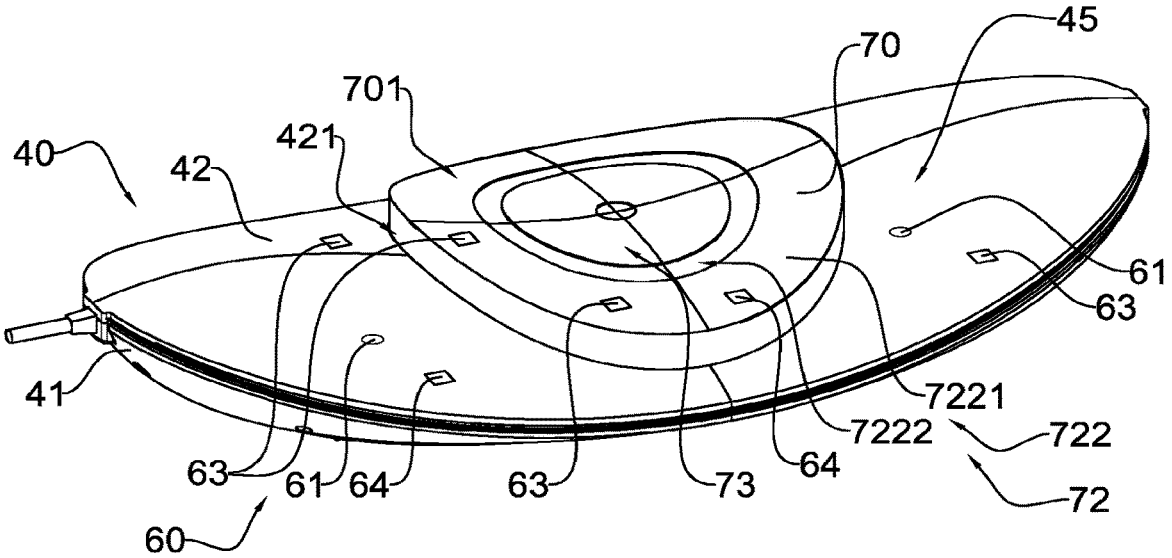
FIG. 62A is a perspective view from an angle of the health-regain device according to another preferred embodiment of the present invention.
Figure 62B:
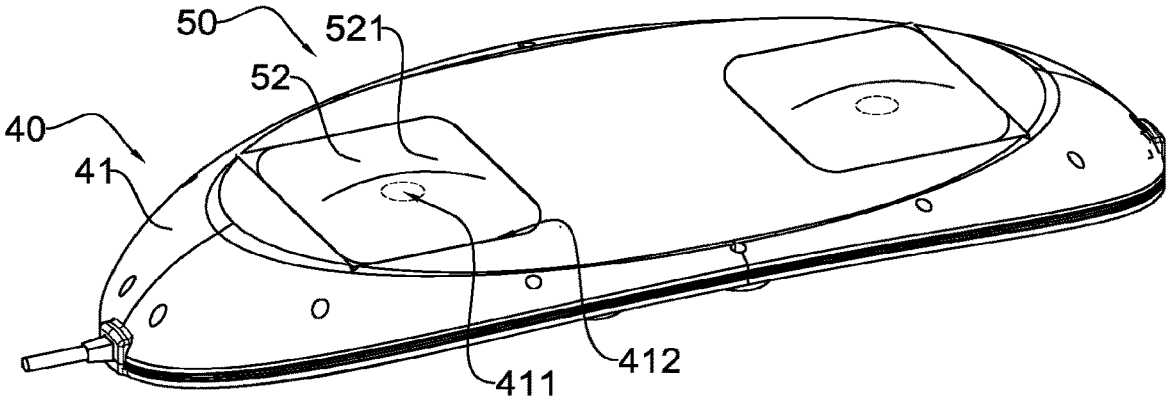
FIG. 62B is a perspective view from another angle of the health-regain device according to the above preferred embodiment of the present invention.

FIGS. 62A and 62B further illustrate an alternative mode embodiment of the health-regain device. With differently in the FIGS. 57A to 59, the health-regain device is shown in FIGS. 62A and 62B, the number of the sub-device driving portion 110, the supporting portion 120 and the through-hole 74 of the health-regain are implemented as one.

Figure 63A:
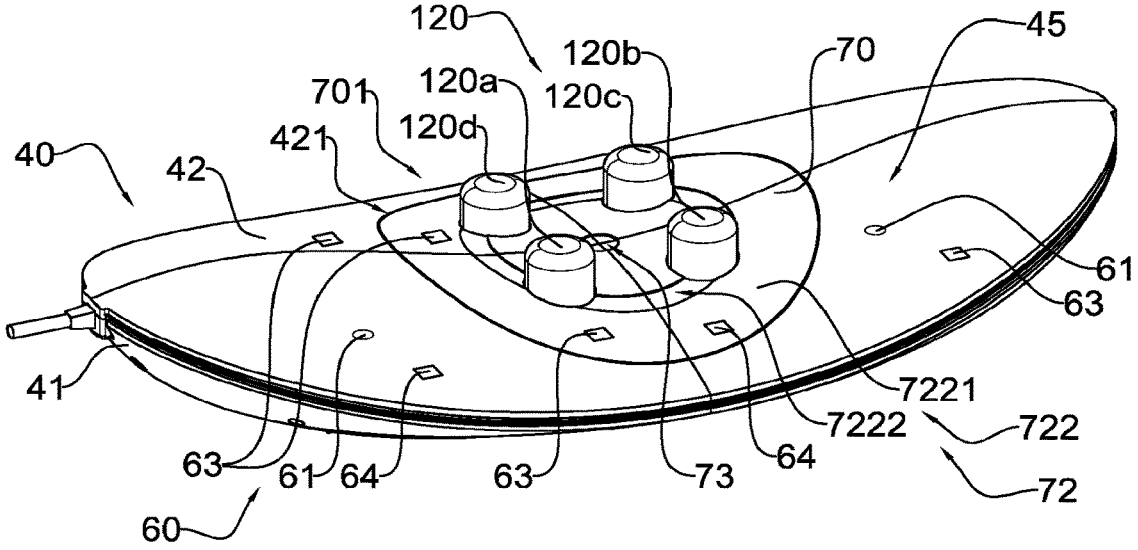
FIG. 63A is a perspective view from an angle of the health-regain device according to another preferred embodiment of the present invention.
Figure 63B:
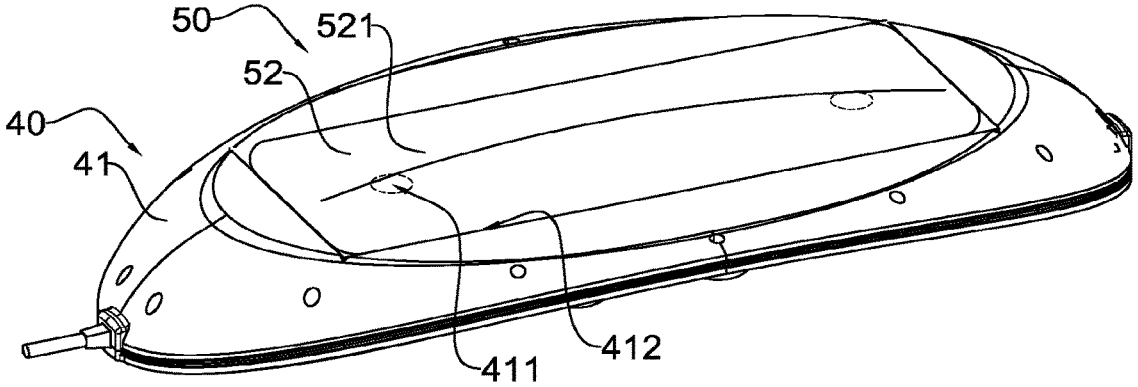
FIG. 63B is a perspective view from another angle of the health-regain device according to the above preferred embodiment of the present invention.
Figure 63C:
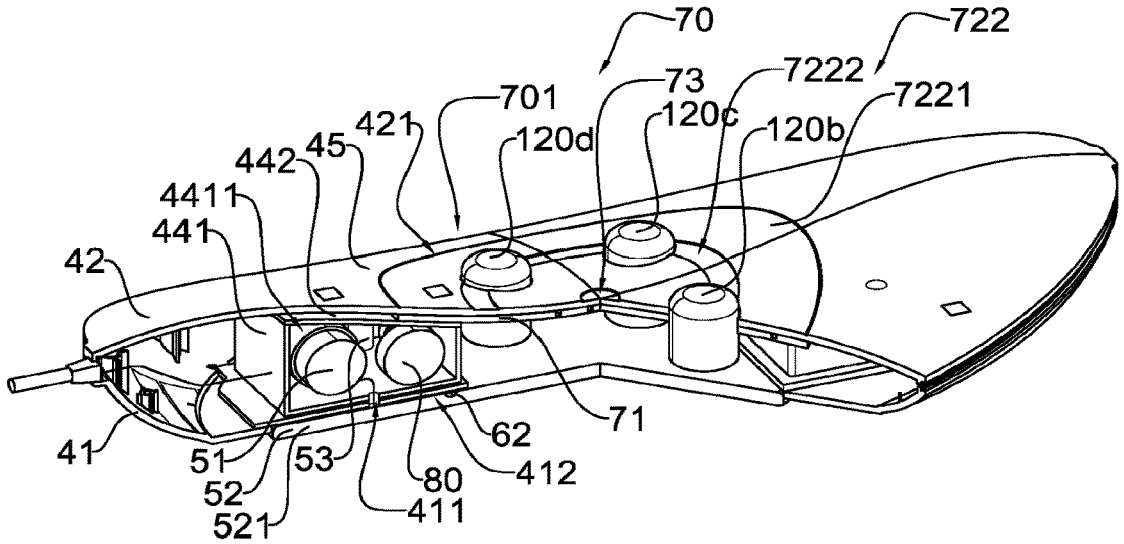
FIG. 63C is an explosive view of the health-regain device according to the above preferred embodiment of the present invention.

FIGS. 63A to 63C illustrate an alternative mode embodiment of the health-regain device. With difference of the health-regain device in FIGS. 57A to 59 shown, in the FIGS. 63A to 63C, the driving portion 50 of the health-regain device comprises one resilient covering 52, so that only one of the fluid receiving cavity 521 is formed at bottom portion of the health portion 40. Preferably, one part of the fluid receiving cavity 521 is formed extended from the connecting slot 413 at the bottom the receiving shell 41 of the health portion 40 to the receiving cavity 41 of the health portion 40. Furthermore, each of the driven end of the supporting portion 120 is provided on the fluid receiving cavity 521, and each of the supporting end of the supporting portion 120 3 is extended respectively through the through holes 74 from the receiving cavity 43 to the outside of the health portion 40. That is, the fluid receiving cavity 521 not only drives the health portion 40 to reciprocate, and the fluid receiving cavity 521 can drive each of the supporting portion 120 to reciprocate. Preferably, the fluid receiving cavity 521 can drive the health portion 40 and each of the supporting portion 120 in synchronization to reciprocate.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention 10 comprises all modifications encompassed within the spirit and scope of the following claims.

What is claimed is:

1. A health device, adapted for placing between a surface and a waist portion of a user lying on top of the surface, comprising:

a support module comprising a first housing having a receiving cavity therein, wherein said first housing comprises a first housing body and a second housing body, wherein said first housing body has a center opening and is configured to be shaped and sized for matching a shape of the waist portion of a user for supporting the waist portion of the using lying on top of said first housing of said health device, wherein said second housing body is supported at said center opening in an upwardly and downwardly movable manner with respect to said first housing body, wherein said second housing body is shaped and sized for matchingly supporting under the waist portion of the user; and an adjusting device comprising a gasbag arranged to be positioned below said first housing body of said first housing, and a pump received in said receiving cavity of said first housing and arranged to be connected with said gasbag and for acquiring power from a power source, wherein said pump is configured to inflate said gasbag which is expanded after being inflated to increase a size thereof and drive said first housing to move upwardly to lift a position of said first housing with respect to the surface for providing a stretch-care function to the waist portion of the user lying on said first housing that the waist portion of the user is pushed upwardly to increase a radian and a curved degree of the waist portion by said first housing at a lifted position thereof, and correspondingly, when said gasbag is deflated, an expansion of said gasbag reduces and said gasbag drives said first housing to move downwards to lower the position of said first housing for decreasing the radian and the curved degree of the waist portion of the user, thereby a reciprocate stretch effect to a spine at the waist portion of the user is achieved by upward and downward movements of said first housing by repeatedly inflating and deflating said gasbag by said pump, wherein said second housing body is configured with said gasbag such that when said gasbag is inflated by said pump to expand and increase the size thereof, said second housing body of said first housing is driven by said gasbag to move upwardly to lift a position of said second housing body of said first housing with respect to the surface for providing a stretch-care function to the waist portion of the user lying on said first housing that the waist portion of the user is pushed upwardly by said second housing body to increase a radian and a curved degree of the waist portion at the lifted position thereof, and correspondingly, when said gasbag is deflated, the expansion of said gasbag reduces and said gasbag drives said second housing body of said first housing to move downwards to lower the position of said second housing body for decreasing the radian and the curved degree of the waist portion of the user, thereby the reciprocate stretch effect to the spine at the waist portion of the user is achieved by upward and downward movements of the second housing body of said first housing by repeatedly inflating and deflating said gasbag by said pump.

2. The health device, as recited in claim 1, further comprising an adjust-control module received in said receiving cavity of said first housing, wherein said adjust-control module comprises a command module which comprises an inflation command module, wherein said inflation command module comprises a microcomputer chip and at least one magnetic valve arranged at said gasbag and connected with said microcomputer chip for allowing said inflation command module to control an inflation and deflation of said gasbag by said pump, wherein said adjusting device further comprises a pressure sensor connected with said microcomputer chip and linked with said inflation command module and arranged to sense a pressure of said gasbag as a commanding basis for said inflation command module to command and control a speed and time of the inflation and deflation of said gasbag so as to control an expansion degree of said gasbag.

3. The health device, as recited in claim 2, wherein said first housing body further comprises a curved positive stop portion provided at a circumferential portion of said second housing body and configured for restricting a horizontal movement of the waist portion of the user lying on top of said first housing during a lifting and a lowering of said second housing body due to an inflation and deflation of said gasbag.

4. The health device, as recited in claim 1, further comprising an adjust-control module and a heat source received in said receiving cavity of said first housing to generate heat for said first housing to provide a thermal environment for hot-care effect for the waist portion of the user, wherein said adjusting device and said heat source are controllably connected to said adjust-control module in such a manner that said adjust-control module is able to control and adjust said heat source and said adjusting device, and to control and adjust a cooperative relationship between said heat source and said adjusting device.

5. The health device, as recited in claim 1, further comprising an adjust-control module and a lighting device received in said receiving cavity of said first housing, wherein a viewing window having a light-transmittance is formed on said second housing body of said first housing in such a manner that light emitted from said lighting device penetrates through said viewing window, wherein said lighting device and said adjusting device are controllably connected with said adjust-control module so as to control and adjust a cooperatively relationship between said lighting device and said adjusting device.

6. The health device, as recited in claim 5, wherein said lighting device comprises one or more lighting elements, a light processing element and a reflective layer, wherein said one or more lighting elements emit light toward said light processing element for processing the light while said reflective layer is arranged at an opposing side of said light processing element with respect to said one or more lighting elements.

7. The health device, as recited in claim 6, further comprising a heat source provided at a rear side of said lighting device within said receiving cavity of said first housing in order to generate heat for said first housing to provide a thermal environment for hot-care effect for the waist portion of the user, wherein said adjusting device and said heat source are controllably connected with said adjust-control module in such a manner that said adjust-control module is able to control and adjust said heat source and said adjusting device, so as to control and adjust a cooperative relationship between said heat source and said adjusting device.

8. The health device, as recited in claim 7, wherein said first housing body further comprises a curved positive stop portion provided at a circumferential portion of said second housing body and configured for restricting a horizontal movement of the waist portion of the user lying on top of said first housing during a lifting and a lowering of said second housing body due to an inflation and deflation of said gasbag.

9. The health device, as recited in claim 1, further comprising an adjust-control module and a massage device received in said receiving cavity of said first housing, wherein said massage device comprises a vibration motor coupled with said first housing so as to produce vibration at said first housing for massaging the user lying on top of said first housing, wherein said massage device and said adjusting device is controllably connected with said adjust-control module so as to control and adjust a cooperatively relationship between said massage device and said adjusting device.

10. The health device, as recited in claim 9, wherein said first housing body further comprises a curved positive stop portion provided at a circumferential portion of said second housing body and configured for restricting a horizontal movement of the waist portion of the user lying on top of said first housing during a lifting and a lowering of said second housing body due to an inflation and deflation of said gasbag.

11. The health device, as recited in claim 1, wherein said first housing body further comprises a curved positive stop portion provided at a circumferential portion of said second housing body and configured for restricting a horizontal movement of the waist portion of the user lying on top of said first housing during a lifting and a lowering of said second housing body due to an inflation and deflation of said gasbag.

12. A health system, adapted for placing between a surface and a predetermined portion of a user lying on the surface, comprising:

a health portion;

a driving portion coupled with said health portion and configured to support and drive said health portion which is arranged on top of said driving portion to provide a driving force to move said health portion upwardly and downwardly reciprocatedly and to control a driving rhythm of the driving force, so as to lift and lower reciprocatedly said health portion to provide a stretching effect on the predetermined portion of the user, wherein said driving portion further comprises an air adjusting device and a resilient covering which is provided at a bottom portion of said health portion, wherein a circumferential edge of said resilient covering is sealingly connected to said bottom portion of said health portion to form an air receiving chamber portion between said bottom portion of said health portion and said resilient covering, wherein said air receiving chamber portion is formed outside said health portion such that said air adjusting device is communicated with said air receiving chamber portion, wherein said air adjusting device is arranged to selectively inflate air to or deflate air from said air receiving chamber portion such that a gas volume of said air receiving chamber portion is adjusted by said air adjusting device so as to adjust an air pressure of said air receiving chamber portion so as to adjust said driving portion to supply the driving force to said health portion, wherein the driving force is increased when said air receiving chamber portion is inflated with air to increase a size thereof to lift said health portion upwardly for applying a force to the predetermined portion of the user lying on top of said health portion, and that the driving force is reduced when said air receiving chamber portion is deflated with air to reduce a size thereof to lower said health portion downwardly for removing the force applied to the predetermined portion of the user lying on top of said health portion, thereby a reciprocate stretch effect to a spine at the predetermined portion of the user is achieved by upward and downward movements of said health portion by repeatedly inflating and deflating said air receiving chamber portion by said adjusting device;

a detector and a control module which is communicatively connected with said air adjusting device to control said air adjusting device to adjust said gas volume of said air receiving chamber portion, wherein said control module controls said air adjusting device to inflate air into said air receiving chamber portion at intervals and to inject air to said air receiving chamber portion rhythmically, wherein said control module also controls said air adjusting device to rhythmically deflate air from said air receiving chamber portion so that, by controlling said gas volume of said air receiving chamber portion, said control module controls said driving force applied to said health portion to control the force applied by said health portion to the predetermined portion of the user, thereby said control module controls a movement height of said health portion by controlling said gas volume of said air receiving chamber portion, wherein said detector, communicatively connected with said control module, comprises a baroceptor and at least one pressure sensor which is provided in said health portion and capable of detecting a pressure applied by said health portion on the predetermined portion of the user by detecting a pressure applied by the user on the health portion, wherein said baroceptor is configured to detect an air pressure of said air receiving chamber portion so as to allow said control module to obtain an air pressure in said air receiving chamber portion and control said air adjusting device to adjust said gas volume of said air receiving chamber portion according to said pressure detected by said at least one pressure sensor and said air pressure in said air receiving chamber portion detected by said baroceptor, wherein said detector further comprises at least one electromyographic sensor in said health portion, wherein said electromyographic sensor is provided on a surface of said health portion, wherein said resilient covering and said electromyographic sensor are provided on two opposing sides of said health portion respectively, wherein said electromyographic sensor is configured for contacting a skin surface of the predetermine portion of the user to obtain EMG data of the user by acquiring EMG signals generated by lumbar muscles of the user, wherein said detector further comprises a temperature sensor provided on said surface of said health portion for contacting with the skin surface of the predetermined portion of the user to obtain a temperature of the skin surface of the predetermined portion of the user, wherein said electromyographic sensor sends the EMG signals acquired to said control module which analyzes the EMG signals for obtaining a muscle state of the predetermined portion of the user so as for controlling said air adjusting device to adjust said gas volume of said air receiving chamber portion according to the muscle state in order to control the force applied by said health portion on the predetermined portion of the user by controlling an amount of air to be inflated into said air receiving chamber portion by said adjusting device; and at least one health-regain environmental former which is provided in a middle portion of said health portion and forms a health-regain environment by providing a thermal energy so as to control a temperature of a thermal environment of said health-regain environment, wherein said control module is communicatively connected with said health-regain environmental former for adjusting the temperature of said thermal environment through said health-regain environmental former, wherein said health-regain environmental former further comprises at least one heat source device communicatively connected with said control module for generating the thermal energy, wherein said control module controls the temperature of said thermal environment by controlling said heat source device to provide heat before said health system is used, wherein said health-regain environmental former further comprises at least one light source device communicatively connected with said control module which controls said light source device to emit light to form a luminous environment and a light intensity of said luminous environment of said health-regain environment for acting on the skin surface of the predetermined portion of the user, wherein said light source device comprises at least one light source and at least one nonopaque device covered on said light source which generates light irradiated through said nonopaque device to form said luminous environment, wherein said nonopaque device is provided with a transmittance color conversion layer to obtain a desired color light, wherein said at least one heat source device is provided between said light source and said nonopaque device, wherein said nonopaque device is provided at a top of said health-regain environmental former for allowing said nonopaque device in contact with the predetermined portion of the user while said at least one heat source device is fixedly disposed below said nonopaque device, wherein said at least one light source device is provided below said at least one heat source device, wherein said at least one heat source device has a predetermined shape in such a manner that the light generated by said light source passes through said nonopaque device, wherein said control module controls said at least one heat source device and said light source while enabling said light source serving as an additional heat source for forming said thermal environment, wherein two opposing ends of said health portion are gradually lowered toward said middle portion of said health portion to form a limiting portion in said middle portion of said health portion, wherein said limiting portion is provided at top of said health-regain environmental former for allowing said limiting portion to be placed at the predetermined portion of the user so as to restrict the predetermined portion of the user from moving horizontally, wherein said middle portion of said health portion gradually decreases towards said two opposing sides of said health portion to form a curved surface, so that after the predetermined portion of the user is in contact with said health portion, said curved surface of said middle portion is adapted to a curvature of the predetermined portion of the user.

13. The health system, as recited in claim 12, wherein said health portion further comprises at least one massage device communicatively connected with said control module which controls said massage device to provide a massage environment, wherein said massage device comprises a vibration motor provided in said receiving cavity to generate vibration as said massage environment.

14. The health system, as recited in claim 13, wherein said heath portion further comprises at least one magnetic element for providing a magnetic health-regain environment, wherein said at least one magnetic element is provided in a middle of a surface of said nonopaque device.

15. The health system, as recited in claim 14, wherein said health portion further comprises at least one power supply device provided in said receiving cavity and electrically connected to said driving portion, said control module, said detector, said health-regain environmental former, and said massage module for providing a built-in power supply.

16. The health system, as recited in claim 15, wherein said health portion includes a receiving shell and a top cap, wherein an edge of said receiving shell is connected to an edge of said top cap to form a receiving cavity inside said receiving shell and said top cap, wherein said power supply device, said control module, said air adjusting device, and said massage device are fixedly disposed in said receiving shell, wherein said health-regain environmental former is provided in a middle of said receiving shell, wherein said top cap has a health-regain environment forming hole at a middle position thereof, wherein after said edge of said top cap is fittedly connected to said edge of said receiving shell, said health-regain environmental former is fitted into said health-regain environmental forming hole, such that said health-regain environment is formed and said health-regain environmental former is extended to a surface of said top cap, wherein after said health-regain environmental former is embedded in said health-regain environmental forming hole, said surface of said top cap is located on a same curved surface as a top surface of said health-regain environmental former, wherein said air adjusting device is provided on the same side as said health-regain environmental forming hole while said massage device and said air adjusting device are provided on two opposing sides of said health-regain environmental former respectively, wherein said nonopaque device has at least one interval slot and further includes at least two sub-nonopaque devices, wherein said at least one interval slot is disposed between said two sub-nonopaque devices so as to divide said nonopaque device into said two sub-nonopaque devices, wherein said at least one light source is provided correspondingly below said sub-nonopaque device such that a light source rhythm of said at least one light source corresponding to each of said at least two sub-nonopaque devices is controlled by said control module to display a predetermined information by each of said at least two sub-nonopaque devices, wherein said pressure sensor is provided on one of said surface of said top cap and said surface of said health-regain environment former for detecting pressure data and transferring said pressure data to said control module, wherein said electromyographic sensor is provided in said at least one interval slot.

* * * * *